US008901404B2

(12) United States Patent
Ishimura et al.

(10) Patent No.: US 8,901,404 B2
(45) Date of Patent: Dec. 2, 2014

(54) SOUND ADJUSTING SYSTEM AND ELECTRONIC MUSICAL INSTRUMENT

(75) Inventors: Fusako Ishimura, Iwata (JP); Takashi Kato, Hamamatsu (JP); Rento Tanase, Hamamatsu (JP); Keiichi Fukatsu, Hamamatsu (JP)

(73) Assignee: Yamaha Corporation (JP)

( * ) Notice: Subject to any disclaimer, the term of this patent is extended or adjusted under 35 U.S.C. 154(b) by 184 days.

(21) Appl. No.: 13/410,622

(22) Filed: Mar. 2, 2012

(65) Prior Publication Data

US 2012/0222541 A1 Sep. 6, 2012

(30) Foreign Application Priority Data

Mar. 4, 2011 (JP) ..... 2011-048389
Mar. 4, 2011 (JP) ..... 2011-048390

(51) Int. Cl.
*G10C 3/12* (2006.01)
*G10H 1/32* (2006.01)
*H04R 1/02* (2006.01)

(52) U.S. Cl.
CPC . *G10H 1/32* (2013.01); *H04R 1/028* (2013.01)
USPC ..... 84/423 R

(58) Field of Classification Search
CPC ..... G10H 1/32; H04R 1/28; H04R 1/2807; H04R 1/20
USPC ..... 84/423 R
See application file for complete search history.

(56) References Cited

U.S. PATENT DOCUMENTS 2,085,760 A * 7/1937 Loar ..... 84/729
3,978,941 A * 9/1976 Siebert ..... 181/151
6,324,292 B1 11/2001 Mitsuhashi et al.
2004/0252856 A1 12/2004 Masuda
2005/0150368 A1 7/2005 Izumi et al.
2007/0158134 A1* 7/2007 Fryette ..... 181/199

FOREIGN PATENT DOCUMENTS

CN 1259817 A 7/2000
CN 1575031 A 2/2005
CN 1641746 A 7/2005
JP 2000-125387 A 4/2000

(Continued)

OTHER PUBLICATIONS

Chinese Office Action cited in Chinese counterpart application No. CN2012100550341, dated Jan. 6, 2014. English translation provided.

*Primary Examiner* — Jianchun Qin
(74) *Attorney, Agent, or Firm* — Rossi, Kimms & McDowell LLP

(57) ABSTRACT

An electronic keyboard musical instrument, including: a keyboard; a musical-sound signal generating circuit; at least one speaker for emitting sound in accordance with a generated signal; a speaker accommodating body accommodating the speaker in its inner space; and at least one resonator disposed in the accommodating body, wherein the accommodating body includes a sound emission path by which the sound emitted by the speaker is introduced to an exterior of the accommodating body via the inner space for sound propagation to the exterior, a control point of the resonator is located at a position corresponding to an antinode of a sound pressure in a natural vibration mode at a specific frequency generated in the inner space by driving of the speaker, and the resonator resonates at the specific frequency for adjusting the sound pressure, whereby the sound is emitted from the sound emission path to the exterior.

10 Claims, 36 Drawing Sheets

(56) References Cited

FOREIGN PATENT DOCUMENTS

| | | | |
|---|---|---|---|
| JP | 2005-202190 | A | 7/2005 |
| JP | 2009194924 | A | 8/2009 |
| WO | 99/35883 | A1 | 7/1999 |

* cited by examiner (a) (b)

SOUND ADJUSTING SYSTEM AND ELECTRONIC MUSICAL INSTRUMENT

CROSS REFERENCE TO RELATED APPLICATION

The present application claims priority from Japanese Patent Application Nos. 2011-048389 and 2011-048390, which were filed on Mar. 4, 2011, the disclosure of which is herein incorporated by reference in its entirety.

BACKGROUND OF THE INVENTION

1. Field of the Invention

The present invention relates to a sound adjusting system and an electronic musical instrument.

2. Discussion of Related Art

As one example of an electronic keyboard musical instrument having a casing in which a speaker is accommodated, there is disclosed in the following Patent Literature 1 an electronic keyboard musical instrument which has sound emission holes, such as tone escapes. In the disclosed electronic keyboard musical instrument, the sound of the speaker is emitted not only from a sound emission surface of the speaker, but also from the sound emission holes through an inner space of the casing toward a performer, for enabling the performer to listen well to the sound emitted from the speaker.

Patent Literature 1: JP 2005-202190

SUMMARY OF THE INVENTION

In the electronic musical instrument or the like, in a space of the casing which is present on a rear side of the speaker accommodated in the casing, there are generated natural vibration modes at resonance frequencies in accordance with the shape of the casing and the like, due to a vibration of the speaker.

It is an object of the present invention to provide a technique of adjusting an acoustic characteristic by controlling a natural vibration mode at a resonance frequency generated in the casing when the sound is emitted from the speaker.

The above-indicated object of the invention may be attained according to a first aspect of the invention, which provides an electronic keyboard musical instrument, comprising:

a keyboard;

a musical-sound signal generating circuit configured to generate a musical-sound signal in accordance with an operation of the keyboard;

at least one speaker configured to emit sound in accordance with the musical-sound signal generated by the musical-sound signal generating circuit;

a speaker accommodating body which accommodates, in an inner space thereof, the at least one speaker; and at least one resonator disposed in the speaker accommodating body, wherein the speaker accommodating body includes a sound emission path by which the sound emitted by the at least one speaker is introduced to an exterior of the speaker accommodating body via the inner space so as to permit the sound to propagate to the exterior, and wherein a control point of the at least one resonator is located at a position corresponding to an antinode of a sound pressure in a natural vibration mode at a specific frequency generated in the inner space by driving of the at least one speaker, and wherein the at least one resonator resonates at the specific frequency so as to adjust the sound pressure in the natural vibration mode at the specific frequency, whereby the sound is emitted from the sound emission path to the exterior of the speaker accommodating body.

The above-indicated object of the invention may be attained according to a second aspect of the invention, which provides an electronic keyboard musical instrument, comprising:

a keyboard;

a musical-sound signal generating circuit configured to generate a musical-sound signal in accordance with an operation of the keyboard;

at least one speaker configured to emit sound in accordance with the musical-sound signal generated by the musical-sound signal generating circuit;

a casing which accommodates, in an inner space thereof, at least one circuit component and the at least one speaker and which supports the keyboard such that a performance operation portion of the keyboard is exposed; and at least one resonator disposed in the casing, wherein the casing includes a sound emission path by which the sound emitted by the at least one speaker is introduced to an exterior of the casing via the inner space so as to permit the sound to propagate to the exterior, and wherein the at least one resonator includes:

at least one first resonator whose control point is located at a position corresponding to an antinode of a sound pressure in a natural vibration mode at a first frequency, the at least one first resonator resonating at the first frequency so as to reduce the sound pressure at the position corresponding to the antinode of the sound pressure in the natural vibration mode at the first frequency; and, at least one second resonator whose control point is located at a position corresponding to an antinode of a sound pressure in a natural vibration mode at a second frequency which is different from the first frequency and at which is generated a counterforce that suppresses a vibration of the at least one speaker caused when the sound is emitted, the at least one second resonator resonating at the second frequency so as to reduce the sound pressure at the position corresponding to the antinode of the sound pressure in the natural vibration mode at the second frequency.

The above-indicated object of the invention may be attained according to a third aspect of the invention, which provides an electronic keyboard musical instrument, comprising:

a keyboard;

a musical-sound signal generating circuit configured to generate a musical-sound signal in accordance with an operation of the keyboard;

at least one speaker configured to emit sound in accordance with the musical-sound signal generated by the musical-sound signal generating circuit;

a casing which accommodates, in an inner space thereof, at least one circuit component and the at least one speaker and which supports the keyboard such that a performance operation portion of the keyboard is exposed; and at least one resonator disposed in the casing, wherein the casing includes a sound emission path by which the sound emitted by the at least one speaker is introduced to an exterior of the casing via the inner space so as to permit the sound to propagate to the exterior, and wherein the at least one resonator includes:

at least one first resonator whose control point is located at a position corresponding to an antinode of a sound pressure in a natural vibration mode at a first frequency, the at least one first resonator resonating at the first frequency so as to reduce the sound pressure at the position corresponding to the antinode of the sound pressure in the natural vibration mode at the first frequency; and, at least one third resonator whose control point is located at a position corresponding to an antinode of a sound pressure in a natural vibration mode at a third frequency different from the first frequency, the at least one third resonator resonating at the third frequency, whereby the antinode of the sound pressure in the natural vibration mode at the third frequency is located at a position at which the sound emission path communicates with the exterior of the casing, The above-indicated object of the invention may be attained according to a fourth aspect of the invention, which provides a sound adjusting system, comprising:

a sound-signal generating circuit configured to generate a sound signal;

at least one speaker configured to emit sound in accordance with the sound signal generated by the sound signal generating circuit;

a speaker accommodating body which accommodates, in an inner space thereof, the at least one speaker; and at least one resonator disposed in the speaker accommodating body, wherein the speaker accommodating body includes a sound emission path by which the sound emitted by the at least one speaker is introduced to an exterior of the speaker accommodating body via the inner space so as to permit the sound to propagate to the exterior, and wherein a control point of the at least one resonator is located at a position corresponding to an antinode of a sound pressure in a natural vibration mode at a specific frequency generated in the inner space by driving of the at least one speaker, and wherein the at least one resonator resonates at the specific frequency so as to adjust the sound pressure in the natural vibration mode at the specific frequency, whereby the sound is emitted from the sound emission path to the exterior of the speaker accommodating body.

The above-indicated object of the invention may be attained according to a fifth aspect of the invention, which provides a sound adjusting system, comprising:

a sound signal generating circuit configured to generate a sound signal;

at least one speaker configured to emit sound in accordance with the sound signal generated by the sound-signal generating circuit;

a casing which accommodates, in an inner space thereof, at least one circuit component and the at least one speaker, and at least one resonator disposed in the casing, wherein the casing includes a sound emission path by which the sound emitted by the at least one speaker is introduced to an exterior of the casing via the inner space so as to permit the sound to propagate to the exterior, and wherein the at least one resonator includes:

at least one first resonator whose control point is located at a position corresponding to an antinode of a sound pressure in a natural vibration mode at a first frequency, the at least one first resonator resonating at the first frequency so as to reduce the sound pressure at the position corresponding to the antinode of the sound pressure in the natural vibration mode at the first frequency; and, at least one second resonator whose control point is located at a position corresponding to an antinode of a sound pressure in a natural vibration mode at a second frequency which is different from the first frequency and at which is generated a counterforce that suppresses a vibration of the at least one speaker caused when the sound is emitted, the at least one second resonator resonating at the second frequency so as to reduce the sound pressure at the position corresponding to the antinode of the sound pressure in the natural vibration mode at the second frequency.

The above-indicated object of the invention may be attained according to a sixth aspect of the invention, which provides a sound adjusting system, comprising:

a sound-signal generating circuit configured to generate a sound signal;

at least one speaker configured to emit sound in accordance with the sound signal generated by the sound-signal generating circuit;

a casing which accommodates, in an inner space thereof, at least one circuit component and the at least one speaker; and at least one resonator disposed in the casing, wherein the casing includes a sound emission path by which the sound emitted by the at least one speaker is introduced to an exterior of the casing via the inner space so as to permit the sound to propagate to the exterior, and wherein the at least one resonator includes:

at least one first resonator whose control point is located at a position corresponding to an antinode of a sound pressure in a natural vibration mode at a first frequency, the at least one first resonator resonating at the first frequency so as to reduce the sound pressure at the position corresponding to the antinode of the sound pressure in the natural vibration mode at the first frequency; and, at least one third resonator whose control point is located at a position corresponding to an antinode of a sound pressure in a natural vibration mode at a third frequency different from the first frequency, the at least one third resonator resonating at the third frequency, whereby the antinode of the sound pressure in the natural vibration mode at the third frequency is located at a position at which the sound emission path communicates with the exterior of the casing.

The above-indicated object of the invention may be attained according to a seventh aspect of the invention, which provides an electronic keyboard musical instrument, comprising:

a keyboard;

a musical-sound signal generating circuit configured to generate a musical-sound signal in accordance with an operation of the keyboard;

a key support member which supports, from below, the keyboard and the musical-sound signal generating circuit;

at least one speaker configured to emit sound in accordance with the musical-sound signal generated by the musical-sound signal generating circuit;

a speaker box which is disposed below the key support member and which accommodates, in an inner space thereof, the at least one speaker; and at least one resonator disposed in the inner space of the speaker box, wherein the at least one resonator is formed of a tubular body in which one of longitudinally opposite ends thereof is closed so as to provide a closed end portion and the other of the longitudinally opposite ends thereof is open so as to provide an open end portion, and wherein the at least one resonator is disposed such that the open end portion is located at a position corresponding to an antinode of a sound pressure in a natural vibration mode at a specific frequency at which is generated a counterforce that suppresses a vibration of the at least one speaker caused when the sound is emitted, and wherein the at least one resonator resonates at the specific frequency so as to reduce the sound pressure at the position corresponding to the antinode of the sound pressure in the natural vibration mode at the specific frequency.

The above-indicated object of the invention may be attained according to an eighth aspect of the invention, which provides a sound adjusting system, comprising:

a sound signal generating circuit configured to generate a sound signal;

at least one speaker configured to emit sound in accordance with the sound signal generated by the sound signal generating circuit;

a speaker box which accommodates, in an inner space thereof the at least one speaker; and at least one resonator disposed in the inner space of the speaker box, wherein the at least one resonator is disposed such that an open end portion thereof is located at a position corresponding to an antinode of a sound pressure in a natural vibration mode at a specific frequency at which is generated a counterforce that suppresses a vibration of the at least one speaker caused when the sound is emitted, and wherein the at least one resonator resonates at the specific frequency so as to reduce the sound pressure at the position corresponding to the antinode of the sound pressure in the natural vibration mode at the specific frequency.

The above-indicated object of the invention may be attained according to a ninth aspect of the invention, which provides an electronic keyboard musical instrument, comprising:

a casing;

a keyboard disposed along a front surface of the casing and including a plurality of keys;

at least one sound emission hole formed in the front surface of the casing at a height position higher than a height position of the keyboard;

a musical-sound signal generating circuit disposed in an inner space of the housing and configured to generate a musical-sound signal in accordance with an operation of the keyboard;

at least one speaker configured to emit sound in accordance with the musical-sound signal generated by the musical-sound signal generating circuit; and at least one resonator disposed in the inner space of the housing, wherein the casing includes a sound emission path by which the sound emitted from a sound emission surface of the at least one speaker passes through the at least one sound emission hole via the inner space of the casing so as to permit the sound to propagate to an exterior of the casing, and wherein a portion of the at least one resonator is open so as to provide an open portion and the at least one resonator is disposed such that the open portion is located at a position corresponding to an antinode of a sound pressure in a natural vibration mode at a specific frequency generated in the inner space of the housing by driving of the at least one speaker.

The above-indicated object of the invention may be attained according to a tenth aspect of the invention, which provides an electronic keyboard musical instrument, comprising:

a keyboard;

a musical-sound generating circuit configured to generate a musical-sound signal in accordance with an operation of the keyboard;

at least one speaker configured to emit sound in accordance with the musical-sound signal generated by the musical-sound signal generating circuit; and a casing which accommodates, in an inner space thereof, at least one circuit component and the at least one speaker and which supports the keyboard such that a performance operation portion of the keyboard is exposed, and at least one resonator which is disposed in the inner space of the casing and a portion of which is open so as to provide an open portion, wherein the casing defines, as the inner space, a lower first chamber and an upper second chamber which are partitioned partially by a key bed on which the keyboard is mounted, wherein the casing defines sound emission paths through which the sound emitted by the at least one speaker propagates to an exterior of the casing, wherein the sound emission paths include: a first sound emission path which permits the sound emitted from a sound emission surface of the at least one speaker to propagate directly to the exterior of the casing; and a second sound emission path which permits the sound emitted by the at least one speaker to propagate to the exterior of the casing via at least one sound emission hole formed in the second chamber over the keyboard, and wherein the at least one resonator is disposed such that the open portion is located at a position corresponding to an antinode of a sound pressure in a natural vibration mode at a specific frequency generated in the inner space of the casing by driving of the at least one speaker.

According to the present invention, it is possible to adjust an acoustic characteristic by controlling a natural vibration mode at a resonance frequency generated in the casing when the sound is emitted from the speaker.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which:

FIG. 18 is a view for explaining a position of an open end portion of each second resonator according to the embodiment 2;

DETAILED DESCRIPTION OF THE EMBODIMENTS

Embodiment 1

Figure 1:
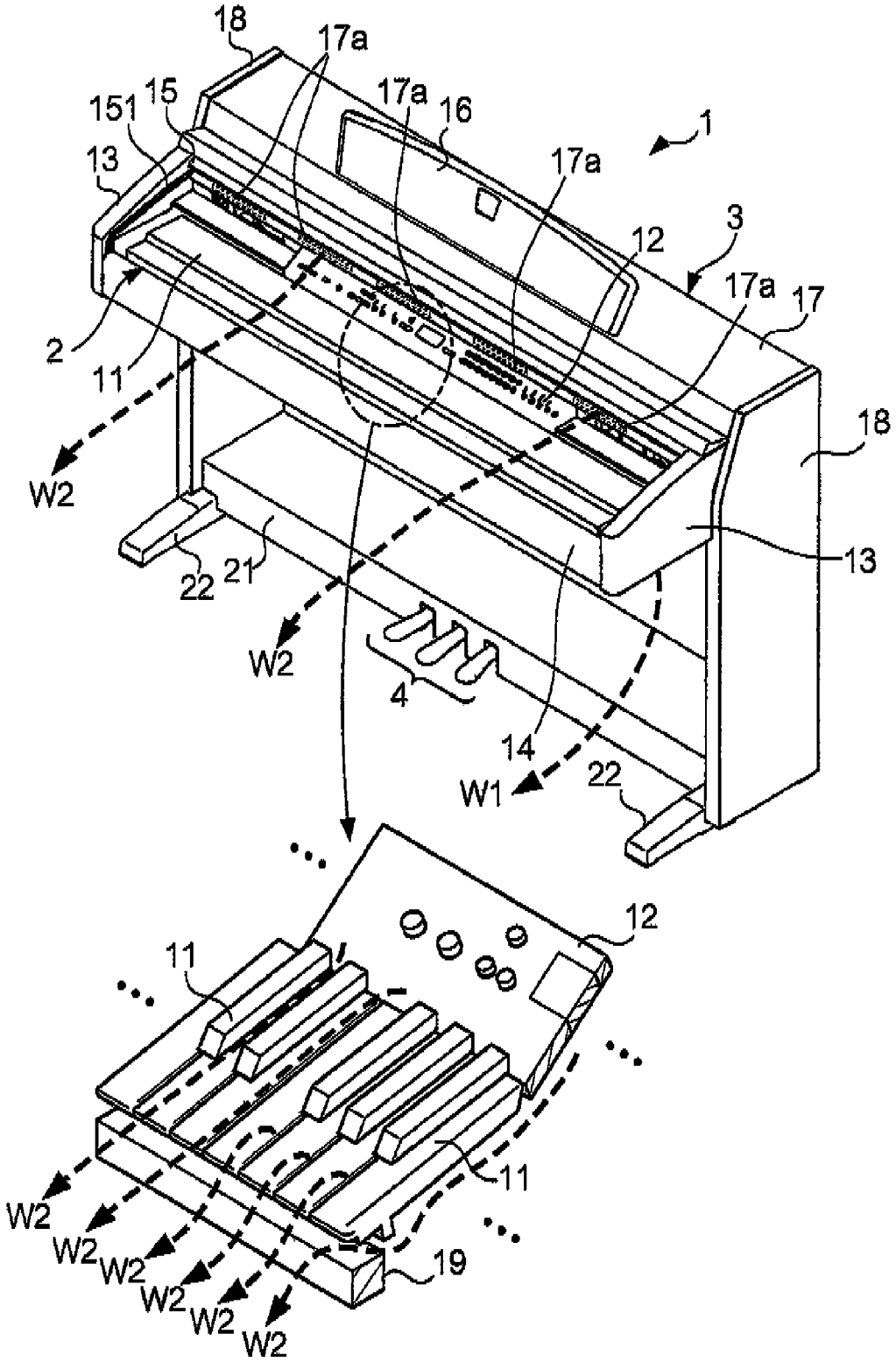
FIG. 1 is a perspective view showing an external appearance of an electronic keyboard musical instrument according to an embodiment 1 of the invention.

FIG. 1 is a perspective view showing an external appearance of an electronic keyboard musical instrument according to an embodiment 1. As shown in FIG. 1, the electronic keyboard musical instrument 1 includes a keyboard unit 2, a casing 3 supporting the keyboard unit 2, and a pedal unit 4 provided in the vicinity of a lower central portion of the casing 3.

The keyboard unit 2 is provided on a front side as seen in FIG. 1, namely, on a performer's side in the electronic keyboard musical instrument 1. The keyboard unit 2 includes: a plate-like key slip portion 14 extending in a horizontal direction; plate-like arm portions 13, 13 respectively extending from one and the other of opposite ends of the key slip portion 14 in a rearward direction; and a key bed 19 (FIG. 3) provided so as to cover a bottom portion of a U-shaped frame constituted by the key slip portion 14 and the arm portions 13, 13. In the frame constituted by the arm portions 13, 13, the key slip portion 14, and the key bed 19, there is accommodated a keyboard 11 in which white keys and black keys are arranged. An operation panel 12 including a power switch and various operation switches is disposed so as to cover an upper portion of the frame on the rear side of the keyboard 11. In the upper portion of the frame at a position higher than a height position of the keyboard 11, there is provided a front plate 11*a* as one surface (a front surface) of the casing 3 on the front side (the performer's side) of the electronic keyboard musical instrument 1, and tone escapes 17*a* (that will be explained) are formed in the front plate 11*a*. Further, a keyboard lid 15 configured to cover the keyboard 11 is provided. The keyboard lid 15 is configured to slide out toward the performer's side by a slide mechanism 151. In a state in which the keyboard lid 15 fully slides out, the keyboard lid 15 covers the keyboard 11. In a state shown in FIG. 1, the keyboard lid 15 slides in toward the rear side, namely, toward a side opposite to the performer's side, so that a performance operation portion of the keyboard 11 is exposed. In each of the keys of the keyboard 11, there is provided a detection switch (not shown) for detecting en associated key pressed by the performer. Each detection switch is configured to output an operation signal in accordance with a detected key to a musical-sound signal detecting circuit described below.

The casing 3 includes side plates 18, 18 which respectively support left and right ends of the keyboard unit 2 and which extend in the vertical direction. The side plates 18, 18 are connected at respective lower ends by a bottom member 21 and at respective upper ends by a roof plate 17. The roof plate 17 covers the upper portion of the electronic keyboard musical instrument 1 following the shapes of the upper portions of the side plates 18, 18. The rear side of the side plates 18, 18, the roof plate 17, and the key bed 19 is covered by a rear plate portion 20. Toe blocks 22, 22 are provided so as to protrude from bottom portions of the respective side plates 18, 18 toward the performer's side. The toe blocks 22 enable the casing 3 to stand erect with high stability. A music stand 16 is provided at a central portion of the upper surface of the roof plate 17, and a plurality of tone escapes 17*a* (each outlined by the dashed line in FIG. 1) are formed around above the keyboard lid 15 so as to be arranged in the width direction of the casing 3. Hereinafter, the tone escape 17*a* will be referred to as the "sound escape portion" or the "TE" where appropriate. Each sound escape portion 17*a* is formed of an escape hole and a saran net covering the outer surface of the escape hole. The TE may be formed of only the escape hole (without the saran net).

In the structure described above, a space is defined as an inner space of the casing 3 by the key slip portion 14, the key bed 19, the arm portions 13, the side plates 18, the roof plate 17, the rear plate portion 20, the keyboard 11, and the operation panel 12. This space is a substantially closed space, but permits the air to flow in and out through the TEs 17*a* and clearances between the keys of the keyboard 11.

The pedal unit 4 is accommodated in a central portion of the bottom member 21 in a state in which pedals thereof protrude toward the performer's side.

Figure 2:
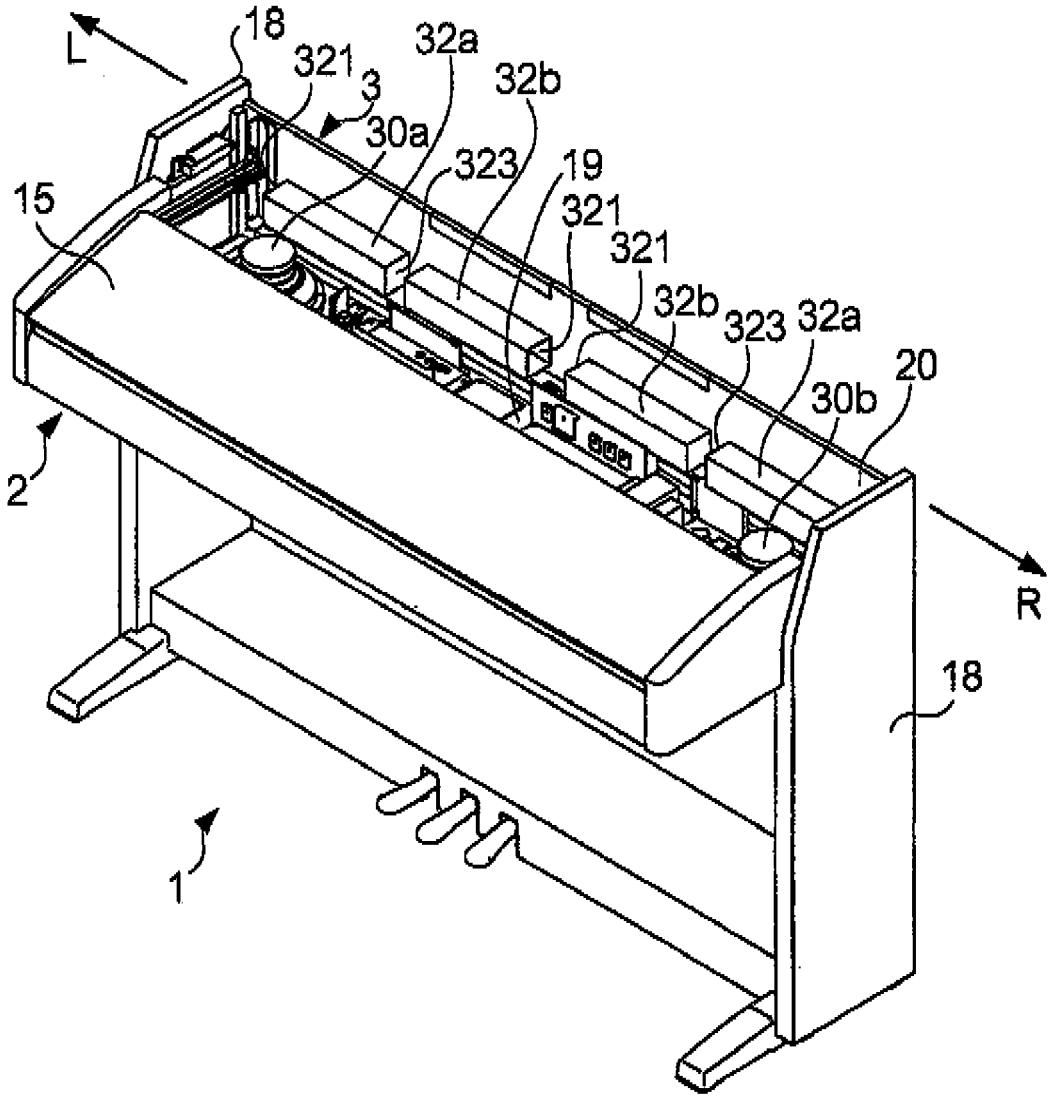
FIG. 2 is a perspective view of the electronic keyboard musical instrument according to the embodiment 1.
Figure 3:
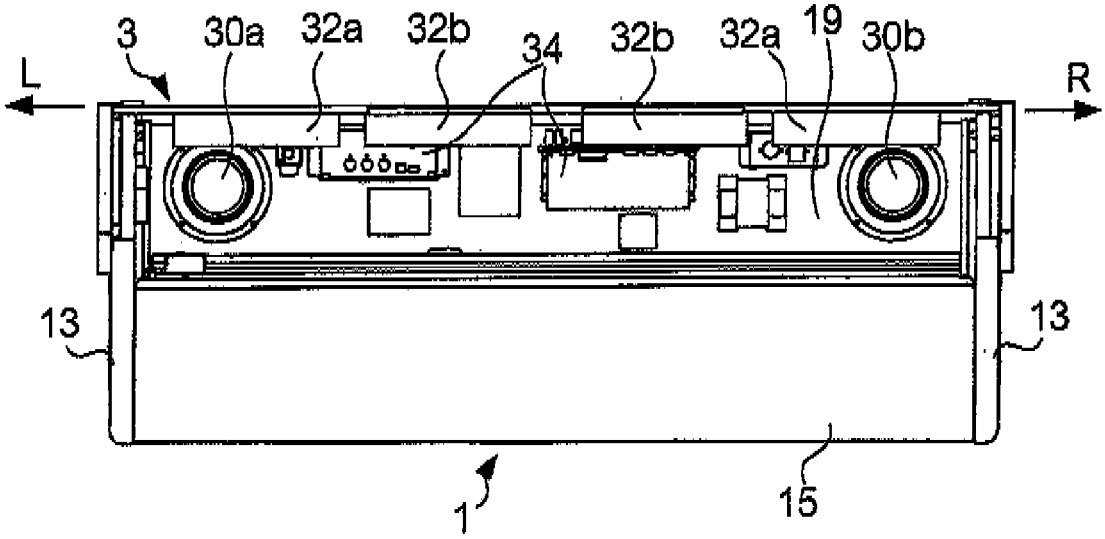
FIG. 3 is a view of the electronic keyboard musical instrument shown in FIG. 2 when viewed from above.

Next, the casing 8 will be explained in detail. FIG. 2 is a perspective view of the electronic keyboard musical instrument 1 shown in FIG. 1 in a state in which the keyboard 11 is covered by the keyboard lid 15 and the roof plate 17 is removed. FIG. 3 is a view showing the electronic keyboard musical instrument 1 of FIG. 2 when viewed from above. As shown in FIGS. 2 and 3, in the inner space of the casing 3, there are disposed two speakers 30 (30*a*, 30*b*) configured to emit sound in accordance with musical-sound signals. Each speaker 80 is installed such that a sound emission surface thereof is directed downward, and there are formed openings for sound emission in the key bed 19 at positions corresponding to the respective speakers 30*a*, 30*b*. The sound emitted from the speakers 30 propagates to the performer through the openings for sound emission. Each of the propagation paths will be hereinafter referred to as a first sound emission path (indicated by the dashed arrow W1 in FIG. 1). In a state in which the performance operation portion of the keyboard 11 is exposed, the sound emitted from the rear-surface side of each speaker 30 opposite to the sound emission surface passes through the inner space of the casing 3 and propagates toward the performer' side through the TEs 17*a* formed in the front plate 11*a* and the clearances between the keys of the keyboard 11. Each of the propagation paths will be hereinafter referred to as a second sound emission path (indicated by the dashed arrow W2 in FIG. 1).

Figure 4:
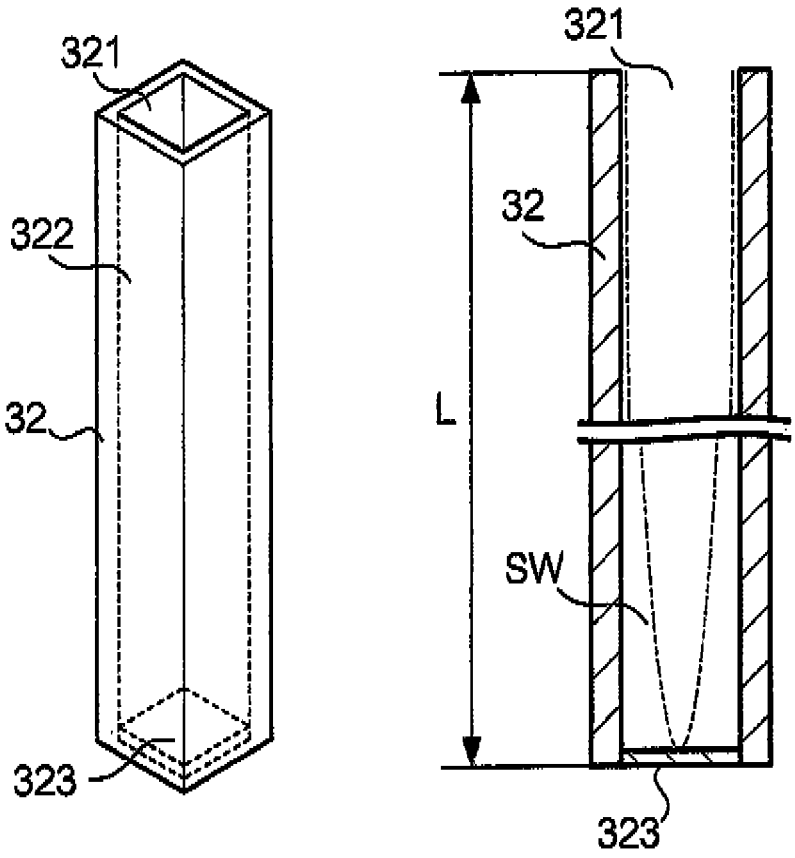
FIG. 4 is a view showing a resonator of the embodiment 1.

In the inner space of the casing 3, there are disposed: four resonators 32 (32*a*, 32*b*) each having a rectangular parallelepiped tubular shape; and a circuit board 34 such as the musical-sound signal generating circuit configured to generate the musical-sound signals based on the operation signals indicative of pressed keys. Further, at least one circuit component is accommodated in the inner space of the casing 3. The resonators 32 according to the present embodiment will be explained with reference to FIG. 4. FIG. 4 shows the resonator 32 as one example of the resonator of the invention. FIG. 4(*a*) schematically shows an external appearance of the resonator 32. The resonator 32 is a resonance tube formed of a material such as metal or synthetic resin so as to have a tubular shape. One of longitudinally opposite ends of the resonator 32 is open so as to provide an open end portion 321 (a control point) and the other of the longitudinally opposite ends thereof is closed so as to provide a closed end portion 323. A hollow region 322 is defined between the open end portion 321 and the closed end portion 323. The hollow region 322 communicates with the open end portion 321. The hollow regions 822 of the respective resonators 32 have the same length L. The vicinity of the open end portion 321 of the resonator 32 may be closed by a flow resistance member having flow resistance and formed of air permeable material such as glass wool, cloth, or gauze.

Referring back to FIGS. 2 and 3, the resonators 82 will be explained. Each resonator 32 is disposed in the inner space of the casing 3 such that one longitudinal surface thereof is in contact with the inner surface of the rear plate portion 20, so as to be located outwardly (rearward) of the speakers 80. Each resonator 32 is fixed using a fixing member, an adhesive or the like. Two 32*a* of the four resonators 32 are disposed such that the respective open end portions 321 are directed toward one and the other of two directions L, R indicated by respective arrows in. FIG. 2, namely, directed toward the outside of the casing 3, while two 32*b* of the four resonators 32 are disposed such that the respective open end portions 321 are directed toward one and the other of the two directions L, R indicated by the respective arrows in FIG. 2, namely, directed toward the inside of the casing 3, such that the respective open end portions 321 face each other.

Figure 5A:
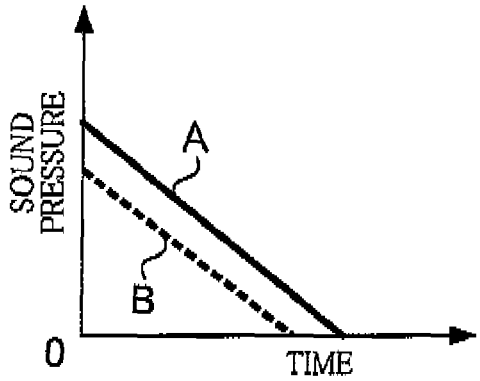
FIGS. 5(*a*)-(*c*) are conceptual diagrams each showing images of a reverberation of a propagation sound in a first sound emission path and a reverberation of a propagation sound in a second sound emission path.
Figure 5B:
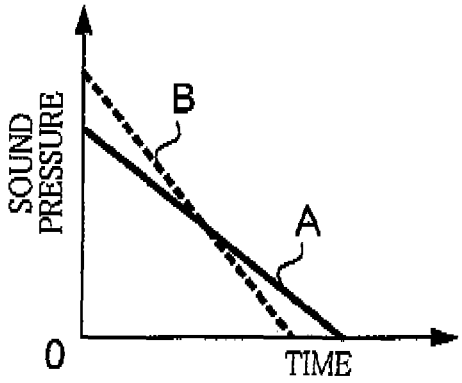
Figure 5C:
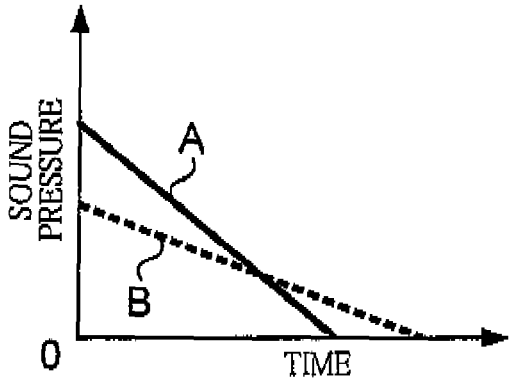
Figure 6A:
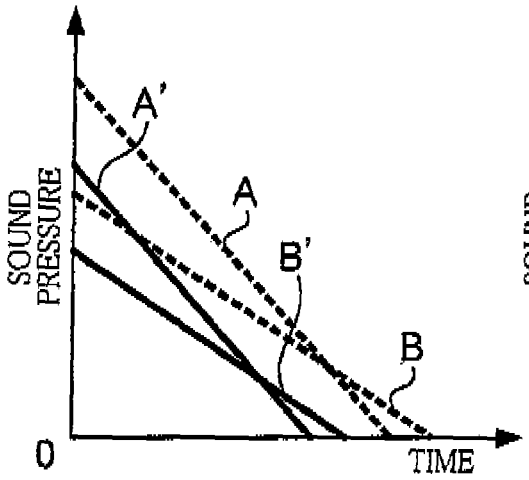
FIGS. 6(*a*)-(*b*) are conceptual diagrams each showing images of the reverberation of the propagation sound in the first sound emission path and the reverberation of the propagation sound in the second sound emission path.
Figure 6B:
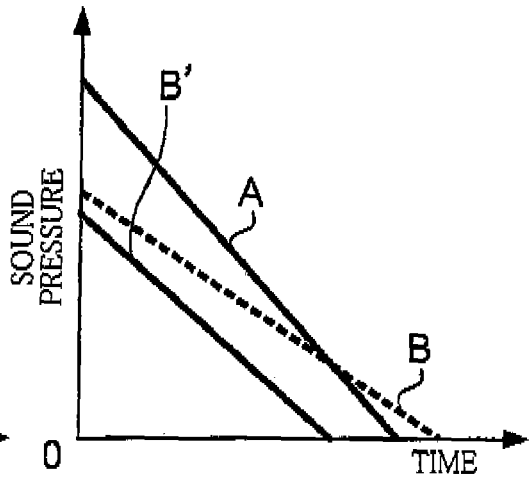

Each TE 17*a* is formed for enhancing acoustic image of musical sound in accordance with the operation of the keyboard 11. As shown in FIG. 5(*a*), it is preferable that a reverberation B of sound for each key which propagates from the second sound emission path (indicated by the dashed arrow W2 in FIG. 1) be smaller in magnitude and length than a reverberation A of sound for each key which is original sound of the musical instrument and which propagates from the first sound emission path (indicated by the dashed arrow W1 in FIG. 1). For instance, where the reverberation B is larger or longer than the reverberation A as shown in FIGS. 5(*b*) and (*c*), the reverberation A is drown out or erased by the reverberation A, resulting in a factor of upsetting a balance in sound crispness and sound volumes among the keys. Where a frequency characteristic of the musical-sound signal inputted to each speaker 30 is adjusted using a digital equalizer before amplification, the reverberation A and the reverberation B before the adjustment are adjusted respectively to a reverberation A' and a reverberation B' as shown in FIG. 6(*a*). While the adjustment merely lowered a sound pressure level of each of the reverberation A and the reverberation B as a whole, the inclination of the reverberation B did not change.

In the present embodiment, owing to provision of the resonators 32 described above, the inclination of the reverberation B is adjusted such that the reverberation B becomes smaller and shorter than the reverberation A, without changing the inclination of the reverberation A, as shown in FIG. 6(*b*). More specifically, each resonator 32 is disposed at a position corresponding to an antinode of a sound pressure in a natural vibration mode at a resonance frequency excited by driving of each speaker 30 among natural vibration modes at resonance frequencies in the inner space of the casing 3, such that a reverberation of sound at the excited resonance frequency becomes a state shown in FIG. 6(*b*).

Here, there will be explained action of reducing a sound pressure by each resonator 32. When the sound wave enters or incident from the inner space of the casing 3 in the open end portion 321 of the resonator 32 shown in FIG. 4(*a*), the sound wave enters an inside of the hollow region 322 from the open end portion 321, is reflected by the closed end portion 323, and is again emitted to the inner space of the casing 3 from the open end portion 321. On this occasion, as shown in FIG. 4(*b*), the sound wave whose wavelength corresponds to four times the length L of the hollow region 322 produces a natural vibration mode SW. While the sound wave repeatedly vibrates, the acoustic energy is consumed due to friction on the inner wall surface of the resonator 32 and due to one of or both of the following two effects: a viscous effect of gaseous molecules at the open end portion 321; and a phase interference effect in which a sound wave continues to be emitted from the resonator, which sound wave is behind by a half wavelength (a half period) from the sound wave at the resonance frequency of the resonator. As a result, the sound pressure is reduced in the vicinity of the open end portion 321 centering around the above-described wavelength corresponding to four times the length L. The resonator 32 is disposed such that the hollow region 322 is connected to or communicates with a space as a target for sound attenuation, whereby the sound in the space enters the open end portion 321 of the resonator 32 and the resonator 32 resonates, so that the sound pressure in the neighborhood of the open end portion 321 is reduced.

The inventors have obtained the following by experiments. For instance, where the width of the casing 3 in the key arrangement direction (hereinafter referred to as the lateral width where appropriate) is about 1300 mm (which is general in a keyboard with 88 keys), a sound wave at a frequency of 280-340 Hz (corresponding to sound of C3-F3 keys) is excited. Accordingly, in order to reduce the sound pressure of the sound wave at the frequency of 280-340 Hz excited in the inner space of the casing 3, the length of the hollow region 322 of the resonator 32 may be made equal to a quarter (¼) of the wavelength of the sound wave in the frequency range.

Here, the natural vibration modes produced in the inner space of the casing 3 will be explained. The natural frequency $f_N$ in a closed hollow rectangular parallelepiped satisfies the following formula (1) where the length in the x-axis direction, the length in the y-axis direction, and the length in the z-axis direction for the dimension of the rectangular parallelepiped are $L_x$, $L_y$, and $L_z$, respectively. In the following formula (1), "$c_0$" represents a sound velocity, and each of "$n_x$," "$n_y$", and "$n_z$" represents a value indicative of a degree of the natural vibration mode and is an arbitrary integer not smaller than 0.

$$f_N = \frac{c_0}{2}\sqrt{\left(\frac{n_x}{L_x}\right)^2 + \left(\frac{n_y}{L_y}\right)^2 + \left(\frac{n_z}{L_z}\right)^2} \quad (1)$$

In the inner space of the rectangular parallelepiped, there exist natural frequencies for arbitrary combinations of the values of degrees $n_x$, $n_y$, $n_z$. The natural frequency obtained from the above formula (1) wherein two of $n_x$, $n_y$, $n_z$ are "0" is a natural frequency in one-dimensional mode. This natural frequency corresponds to a frequency in a natural vibration mode in which the propagation direction of the sound wave is parallel to one axis in the inner space. The natural frequency obtained from the above formula (1) wherein one of $n_x$, $n_y$, $n_z$ is "0" is a natural frequency in two-dimensional mode. This natural frequency corresponds to a frequency in a natural vibration mode in which the propagation direction of the sound wave is parallel to one pair of parallel wall surfaces in the inner space and the sound wave is obliquely incident on other two pairs of parallel wall surfaces. The natural frequency obtained from the above formula (1) wherein none of $n_x$, $n_y$, $n_z$ is "0" is a natural frequency in three-dimensional mode. This natural frequency corresponds to a frequency in a natural vibration mode in which the sound wave is obliquely incident on all of the wall surfaces in the rectangular parallelepiped inner space.

Figure 7A:
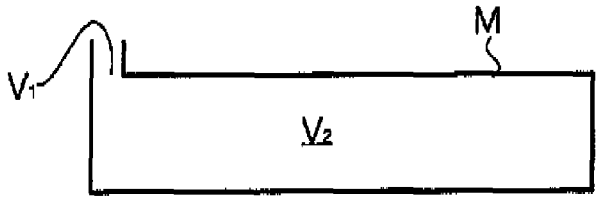
FIGS. 7(*a*)-(*b*) are views each for explaining a wavelength in a natural vibration mode of a casing in the embodiment 1.
Figure 7B:
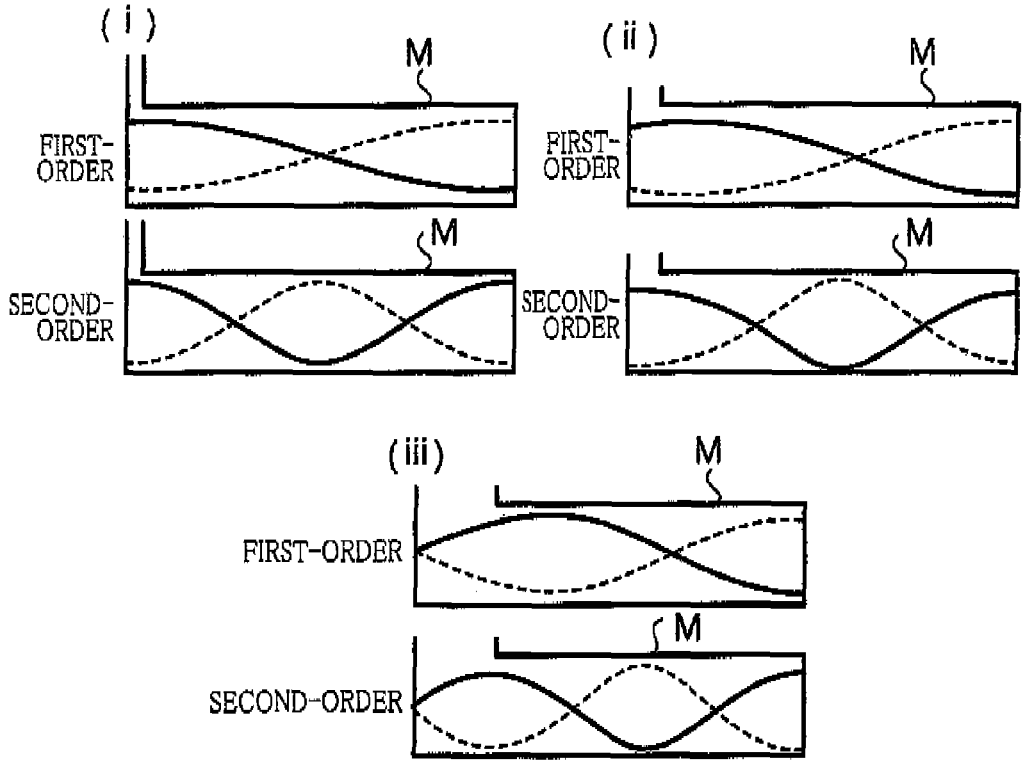

Second-degree ($n_x$=2) natural frequency in the one-dimensional mode in a state in which the casing 3 is hermetically closed, namely, in an instance where the TEs 17*a* and the like are not provided, is 250 Hz according to the above formula (1). This natural frequency corresponds to a frequency whose wavelength corresponds to the lateral width of the casing 3. The frequency in the range of 280-340 Hz obtained from the experiments is higher than this frequency by 15-30% and has a shorter wavelength than that in the closed state. The inventors considered that this is because of influences of the sound emission paths in the casing 3 such as the TEs 17*a* and the clearances between the keys of the keyboard 11. In an acoustic tube M having an open end portion v1 and a hollow region v2 as shown in. FIG. 7(*a*), for instance, the acoustic tube M is similar to an opposite-end closed tube where the open end portion v1 is considerably small with respect to the hollow region v2. Accordingly, the wavelength in first-degree natural vibration mode in the acoustic tube M is a half (½) wavelength as shown in FIG. 7(*b*)(*i*). Where the open end portion v1 of the acoustic tube M is considerably large with respect to the hollow region v2, the acoustic tube M is similar to a one-end open tube. Accordingly, the wavelength in the first-degree natural vibration mode in the acoustic tube M is three-quarter (¾) wavelength as shown in FIG. 7(*b*)(*iii*), which is shorter as compared with FIG. 7(*b*)(*i*). This is true for second-degree natural vibration mode. For the casing 3 in which the TEs 17*a* etc., are provided, the wavelength is the one shown in FIG. 7(*b*)(*ii*) intermediate between the wavelength shown in FIG. 7(*b*)(*i*) and the wavelength shown in FIG. 7(*b*)(*iii*), as apparent from the experiment results. In other words, the wavelength becomes shorter than that in the opposite-end closed tube and becomes longer than that in the one-end open tube, Since the two speakers 30 are driven in the same phase in the inner space of the casing 3, the sound waves, are likely to be excited especially at natural frequencies in second-degree and fourth-degree natural vibration modes in each of which the number of nodes of the sound pressure in the inner space is even. On the contrary, the sound wave is not likely to be excited at a natural frequency in first-degree natural vibration mode in which the number of nodes of the sound pressure is one. Accordingly, the resonator 32 may be designed to have a length equal to a quarter (¼) of the wavelength of a specific frequency that is higher, by 15-80%, than the frequency having the wavelength corresponding to the lateral width of the casing 3. Further, the resonator 32 is disposed in the inner space of the casing 3 such that the open end portion 321 (a control point) of the resonator 32 is located at a position corresponding to at least one antinode of the sound pressure in the natural vibration mode at the specific frequency, thereby reducing the sound pressure, at the specific frequency (here, in the range of 280-340 Hz), of the sound generated in the inner space when the sound is produced upon sound emission by the speakers 30.

Figure 8A:
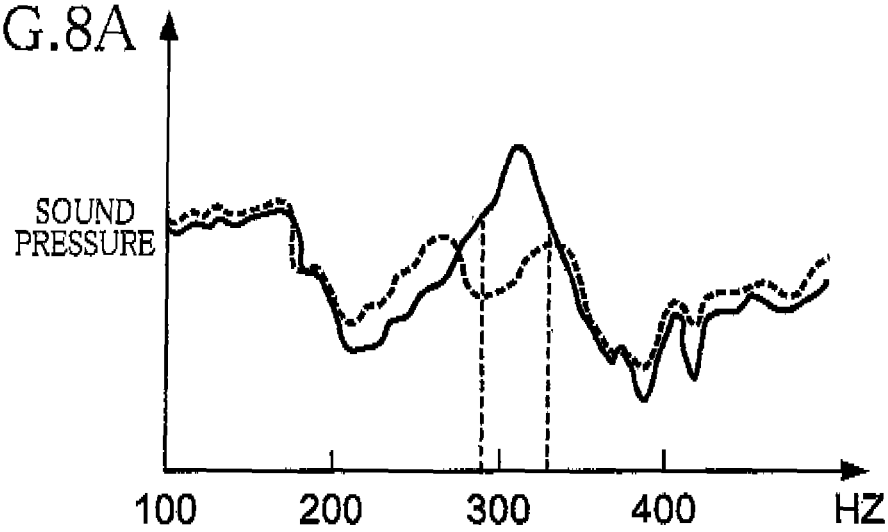
FIGS. 8 (*a*)-(*c*) are views each showing a frequency characteristic in a case in which the resonators are provided and a frequency characteristic in a case in which the resonators are not provided, in the embodiment 1.
Figure 8B:
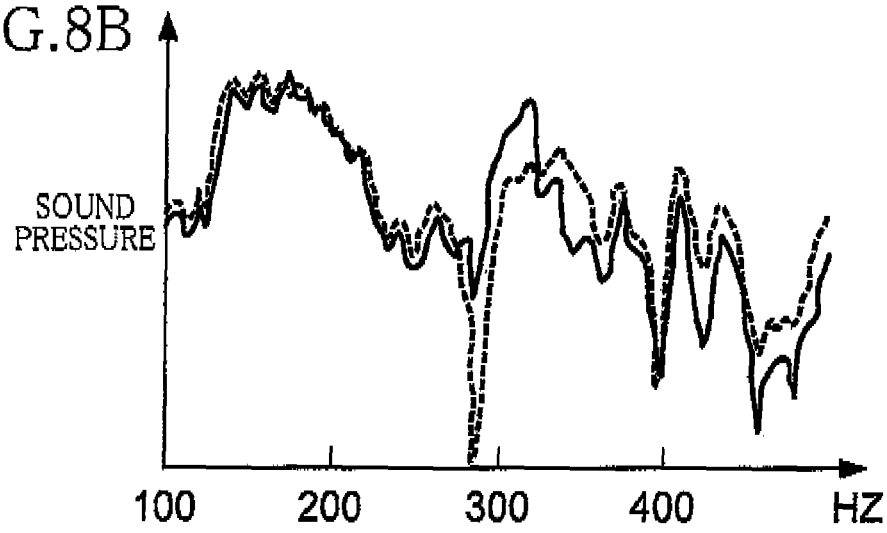
Figure 8C:
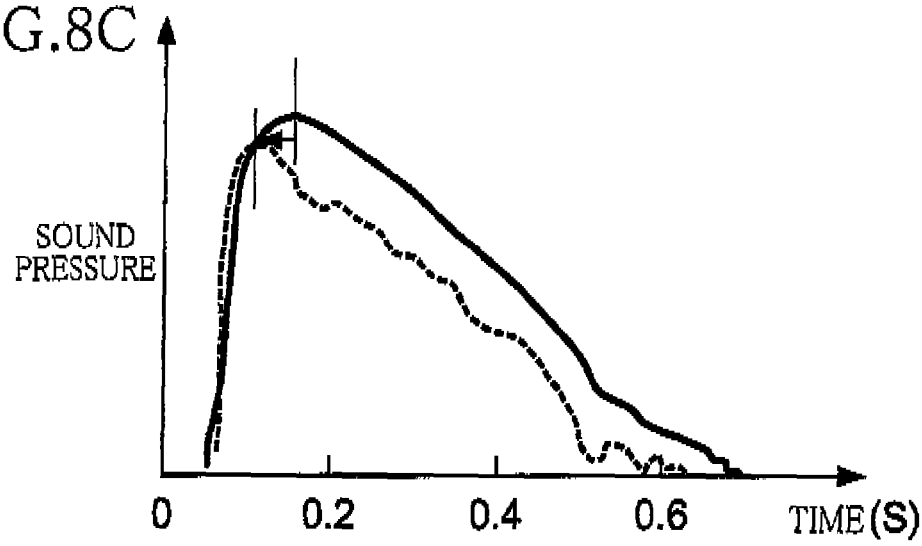

FIG. 8(*a*) shows frequency characteristics in the inner space in an instance in which the resonators 32 designed as described above are disposed in the inner space of the casing 3 and in an instance in which the resonators 32 are not disposed in the inner space of the casing 3. FIG. 8(*b*) shows frequency characteristics at the performer's position in the instance in which the resonators 32 are disposed in the inner space of the casing 3 and in the instance in which the resonators 32 are not disposed in the inner space of the casing 3. The solid line in each of FIGS. 8(*a*) and 8(*b*) shows the frequency characteristic in the case in which the resonators 32 are not disposed in the inner space, and it is to be understood that the sound pressure is excited at the frequency of 280-340 Hz. The dashed line in each of FIGS. 8(*a*) and 8(*b*) shows the frequency characteristic in the case in which the resonators 32 are disposed in the inner space. Owing to the resonators 32, the sound pressure at 280-340 Hz is reduced. FIG. 8(*c*) shows a change in the sound pressure of the sound wave at 280-340 Hz in each of the instance in which the resonators 32 are disposed in the inner space of the casing 3 and the instance in which the resonators 32 are not disposed in the inner space. In FIG. 8(*c*), the solid line indicates the frequency characteristic in the instance in which the resonators 32 are not disposed in the inner space while the dashed line indicates the frequency characteristic in the instance in which the resonators 32 are disposed in the inner space. According to FIG. 8(*c*), unnecessary resonance is suppressed owing to provision of the resonators 32, so that the peak position of the sound pressure is shifted forward, ensuring quick response or rise of the sound. As a result, the sound can be heard clearly.

In the illustrated embodiment, as shown in FIGS. 1-3, each of the four resonators 32 is disposed such that the open end portion 321 is located at the position in the inner space of the casing 3 located outwardly of the positions of the speakers 80 and corresponding to the position of the antinode of the sound pressure in the natural vibration mode at the specific frequency. In the embodiment, there is generated the natural vibration mode with the wavelength that is substantially equal to the dimension of the casing 3 in the key arrangement direction and the positive antinodes of the sound pressure in the natural vibration mode at the frequency as a control target for reducing the sound pressure (hereinafter referred to as the control target frequency where appropriate) are located at one and the other of the opposite ends of the casing 3. Further, the negative antinode of the sound pressure is located in the vicinity of the central portion of the casing 3. Accordingly, the four resonators 32 are disposed such that the open end portions 321 (each as the control point) are located at positions corresponding to all of the antinodes. By thus disposing the open end portions 321 of the resonators 32 at the positions corresponding to all of the antinodes of the sound pressure in the natural vibration mode at the control target frequency, the sound pressure at the frequency in question may be reduced. The open end portions 321 of the resonators 32 may be located at positions corresponding to any of the antinodes of the sound pressure. That is, among the four resonators 32 shown in FIG. 2, the intermediate two resonators 32*b* may be eliminated. Only the two resonators 32*a* located at the opposite ends of the casing 3 except the intermediate two resonators 32*b* may be disposed. Further, one of the two intermediate resonators 32*b* shown in FIG. 2 may be disposed as only one resonator. In other words, the open end portion 321 of the resonator 32 which resonates at the control target frequency is located at the position corresponding to at least one antinode of the sound pressure in the natural vibration mode at the control target frequency. Such an arrangement also ensures the advantage of reducing the sound pressure, as compared with an instance in which the resonators 32 are not provided.

As will be understood from the above, where there is caused a fluctuation in the acoustic characteristic or where it is desired to change the frequency characteristic to be emphasized in particular, namely, where it is desired to decrease or increase the sound pressure at the frequency to be emphasized, depending upon various conditions of the casing such as the shape of the casing and the layout of obstacles (e.g., electronic components such as a power source), it is possible to fabricate the casing with the acoustic characteristic in consonance with the intention of the designer to a certain extent, by disposing the resonators having the dimension in accordance with the frequency at positions in accordance with the frequency.

Embodiment 2

Figure 9:
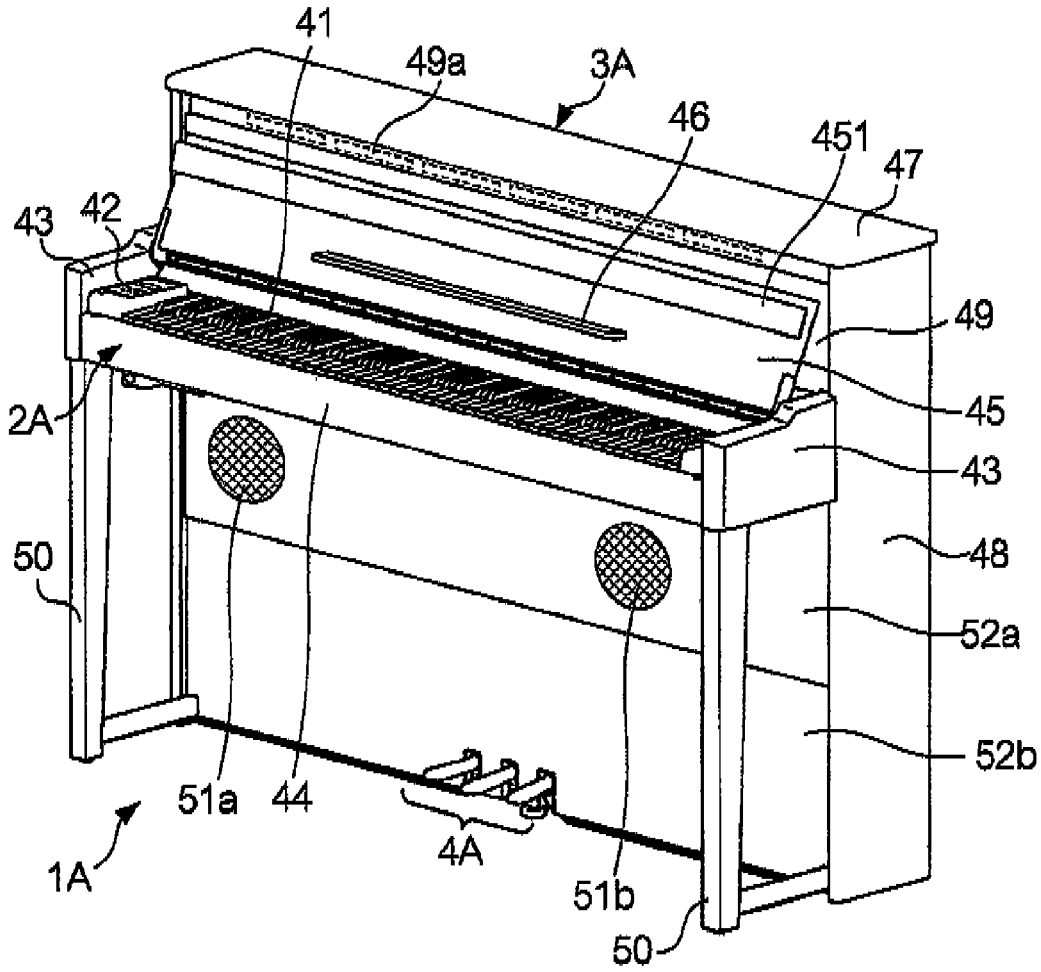
FIG. 9 is a perspective view showing an electronic keyboard musical instrument according to an embodiment 2.

Referring to the perspective view of FIG. 9, there will be explained an electronic keyboard musical instrument 1A according to a second embodiment of the invention. The electronic keyboard musical instrument 1A includes a keyboard unit 2A and a casing 3A supporting the keyboard unit 2A.

The keyboard unit 2A includes: a plate-like key slip portion 44 extending in the horizontal direction; side plates 48, 48 respectively extending from one and the other of opposite ends of the key slip portion 44 toward the rear side; and a key bed 53 (FIG. 12) provided so as to cover a bottom portion of a U-shaped frame constituted by the key slip portion 44 and the side plates 48. In the frame constituted by the side plates 48, 48, the key slip portion 44, and the key bed 53, there is accommodated a keyboard 41 in which white keys and black keys are arranged. A keyboard lid 45 covering the rear-side portion of the keyboard 41 is pivotably provided. In a key block portion 42, a power switch and various operation switches are provided. The keyboard lid 45 has a music stand 46 and a lid front 451 on one surface thereof that can be seen by the performer when the keyboard lid 45 is opened such that the keyboard 41 is visible. Further, the keyboard lid 45 covers the keyboard 41 when pivoted toward the performer's side. In a state shown in FIG. 9, a performance operation portion of the keyboard 41 is exposed. In each of the keys of the keyboard 41, there is provided a detection switch (not shown) for detecting an associated key pressed by the performer. Each detection switch is configured to output an operation signal in accordance with a detected key to a musical-sound signal detecting circuit described below.

Figure 12:
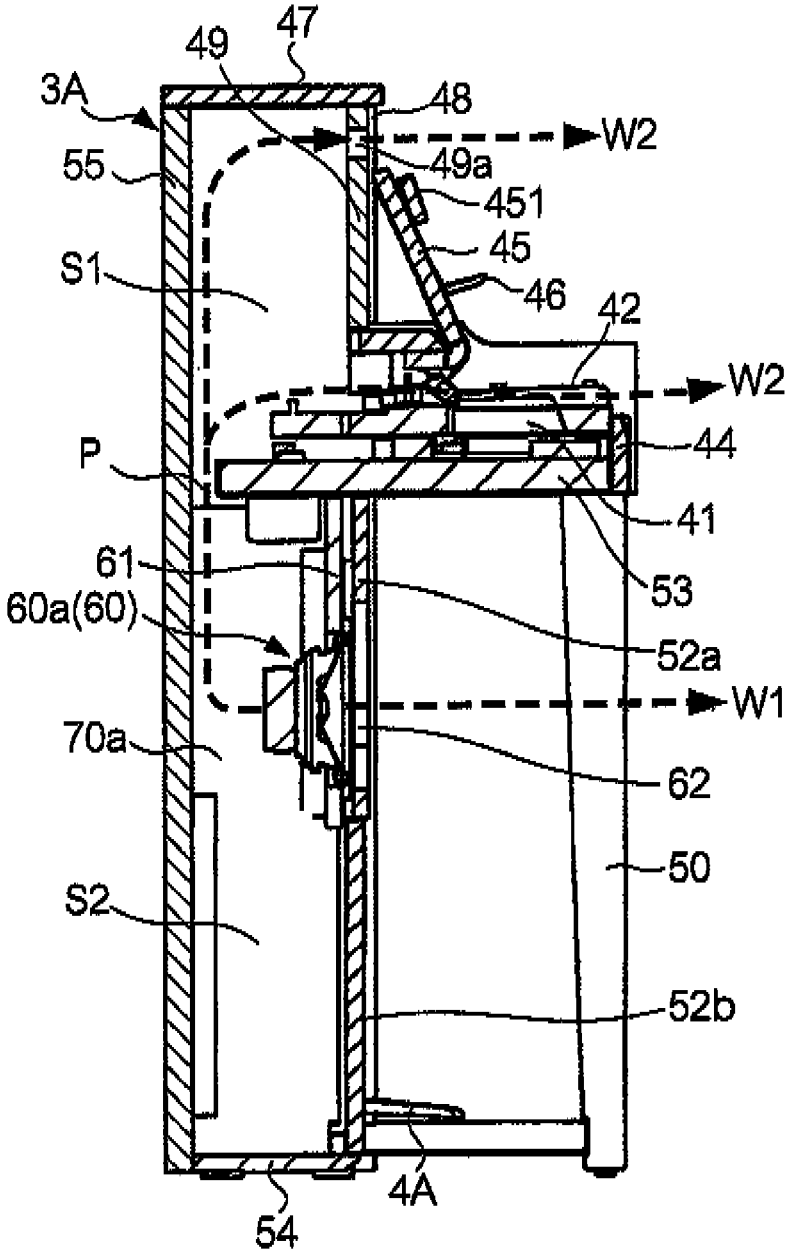
FIG. 12 is a cross-sectional view of the electronic keyboard musical instrument taken along line B-B in FIG. 10.

The casing 3A includes arm portions 43, 43 which respectively support left and right ends of the keyboard unit 2A and which extend in the vertical direction. The side plates 48, 48 on the rear side of the arm portions 43 are connected at respective lower ends by a bottom plate 54 (FIG. 12) and at respective upper ends by a roof plate 47. The rear side of the side plates 48, 48 and the roof plate 47 is covered by a rear plate 55 (FIG. 12). An upper front plate 49 is attached so as to cover from the upper end portion of the roof plate 47 to the rear-side portion of the keyboard 41, and tone escapes (TEs) 49*a* each outlined by the dashed line in FIG. 9 are formed at the upper portion of the upper front plate 49. Further, an upper lower-front plate 52*a* and a lower lower-front plate 52*b* are attached so as to cover from the bottom surface of the key bed 53 to the lower end portion of the bottom plate 54. At respective positions of the upper lower-front plate 52*a* corresponding to two speakers 60 (FIG. 12), there are provided sound emission holes from which sound from the corresponding speakers 60 is emitted and saran nets 51*a*, 51*b*. Front leg portions 50, 50 are provided so as to extend from the bottom portions of the respective arm portions 48, 43 toward the performer's side, whereby the casing 8A can stand erect with high stability. Further, a pedal unit 4A is accommodated in the central portion of the lower lower-front plate 52*b* in a state in which pedals thereof protrude toward the performer' side.

In the structure described above, a space is defined as an inner space of the casing 3A by the roof plate 47, the side plates 48, the upper front plate 49, the rear plate 55, the keyboard 41, the upper lower-front plate 52*a*, the lower lower-front plate 52*b*, and the bottom plate 54. As in the illustrated embodiment 1, this space is a substantially closed space, but permits the air to flow in and out through the TEs 49*a* and clearances between the keys of the keyboard 41.

Figure 10:
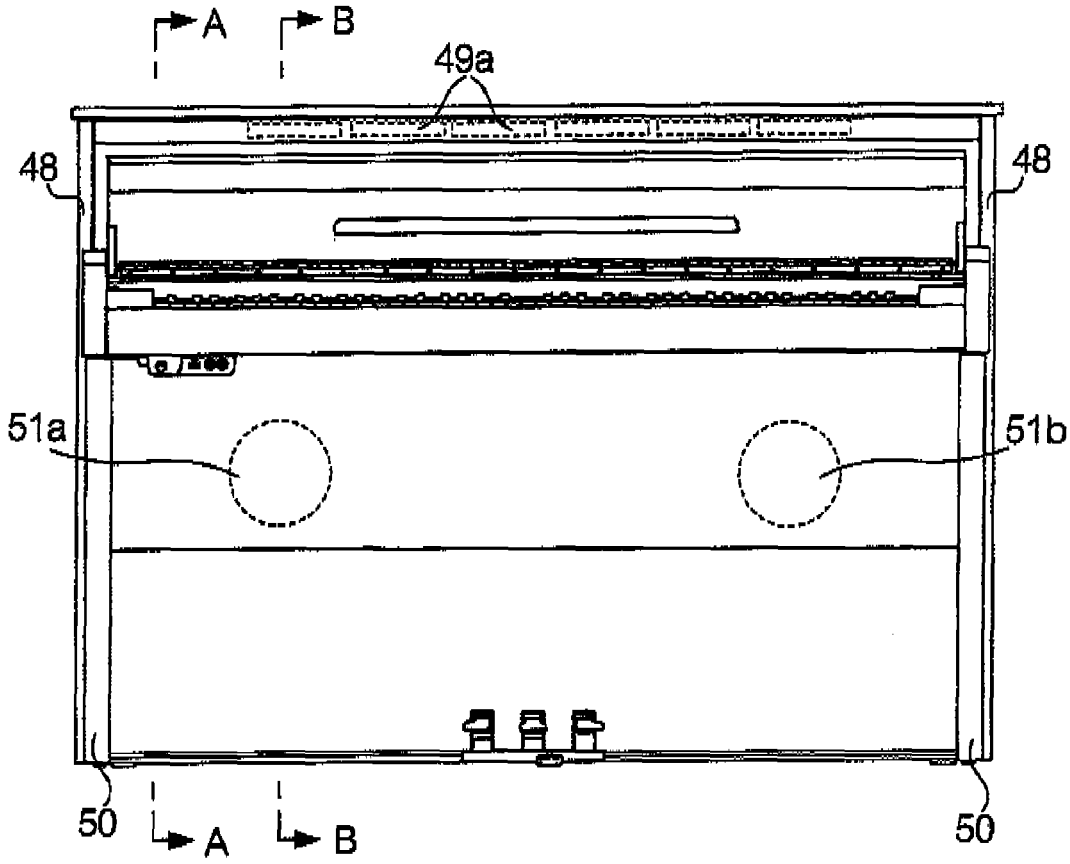
FIG. 10 is a front view of the electronic keyboard musical instrument shown in FIG. 9.
Figure 11:
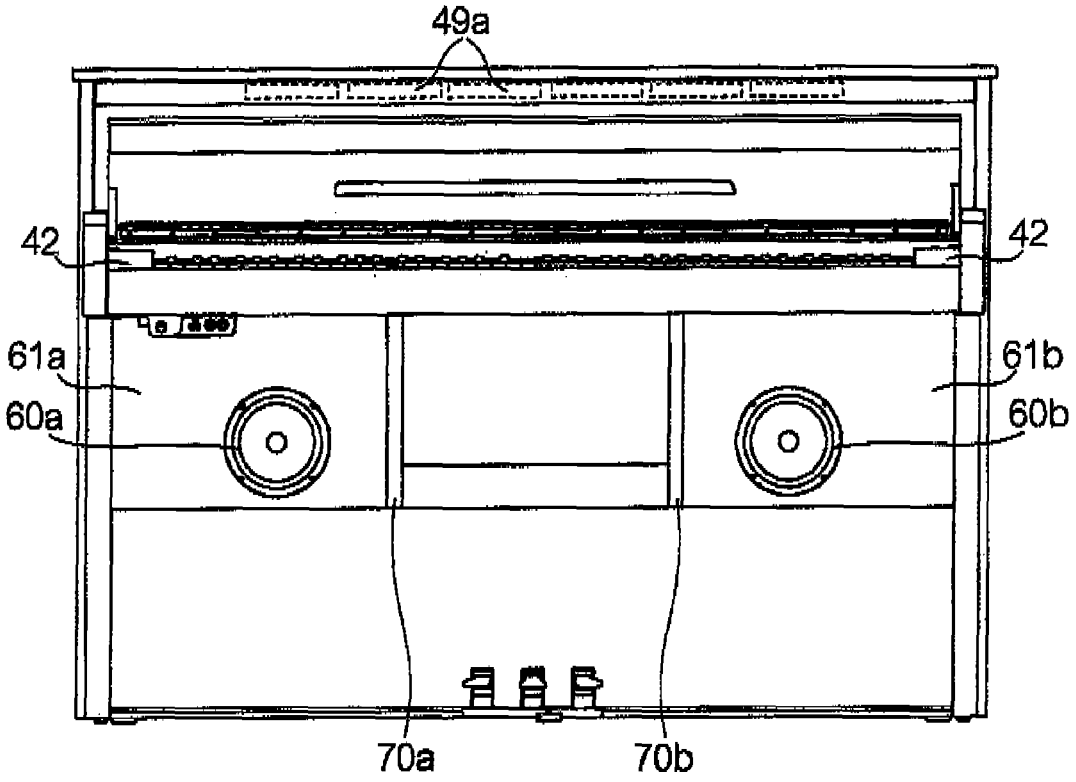
FIG. 11 is a view of the electronic keyboard musical instrument shown in FIG. 10 in a state in which an upper lower-front plate is removed.

Next, the inner structure of the casing 3A will be explained. FIG. 10 is a front view of the electronic keyboard musical instrument 1A shown in FIG. 9, FIG. 11 is a view of the electronic keyboard musical instrument 1A shown in FIG. 10 in a state in which the upper lower-front plate 52*a* is removed. FIG. 12 is a cross-sectional view of the electronic keyboard musical instrument 1A taken along line B-B in FIG. 10.

As shown in FIG. 12, the key bed 53 is supported by the front leg portions 50, the upper lower-front plate 52*a*, the lower lower-front plate 52*b*, and the side plates 48. An acoustic path space P is formed between the key bed 53 and the rear plate 55. The inner space of the casing 3A is constituted such that an upper acoustic path space above the key bed 53 (hereinafter referred to as an "upper inner space S1") and a lower acoustic path space in which the speakers 60*a*, 60*b* are disposed (hereinafter referred to as a "lower inner space S2") are connected via the acoustic path space P between the key bed 53 and the rear plate 55. As shown in FIG. 12, the acoustic path space P has a dimension in the depth direction smaller than those of the upper inner space S1 and the lower inner space 82. The inner space of the casing 3A has a complicated configuration as compared with a simple rectangular configuration of the inner space of the casing 3 in the illustrated embodiment 1. As shown in FIG. 12, baffle plates 61 (61*a*, 61*b*) on which the speakers 60 (60*a*, 60*b*) are installed are attached to the upper lower-front plate 52*a* of the casing BA. As shown in FIGS. 11 and 12, there are disposed, in the inner space of the casing 3A below the key bed 53, partition plates 70 (70*a*, 70*b*) each extending from the lower surface of the key bed 53 to the bottom plate 54, so as to enable the speakers 60*a*, 60*b* to be provided spatially independently of each other in the key arrangement direction. Each speaker 60 is installed such that a sound emission surface thereof is directed toward the performer's side, and a hole 62 for sound emission is formed in the upper lower-front plate 52*a* at a position corresponding to the sound emission surface of each speaker 60. The sound emitted from each speaker 60 propagates to the performer through the corresponding hole 62. Each of the propagation paths will be hereinafter referred to as a first sound emission path W1. The sound emitted from the rear-surface side of each speaker 60 opposite to the sound emission surface passes from the lower inner space S2 to the upper inner space S1 through the narrow acoustic path space P and propagates toward the performer' side through the TEs 49*a* formed in the front plate 49 and the clearances between the keys of the keyboard 41. Each of the propagation paths will be hereinafter referred to as a second sound emission path W2.

Figure 13:
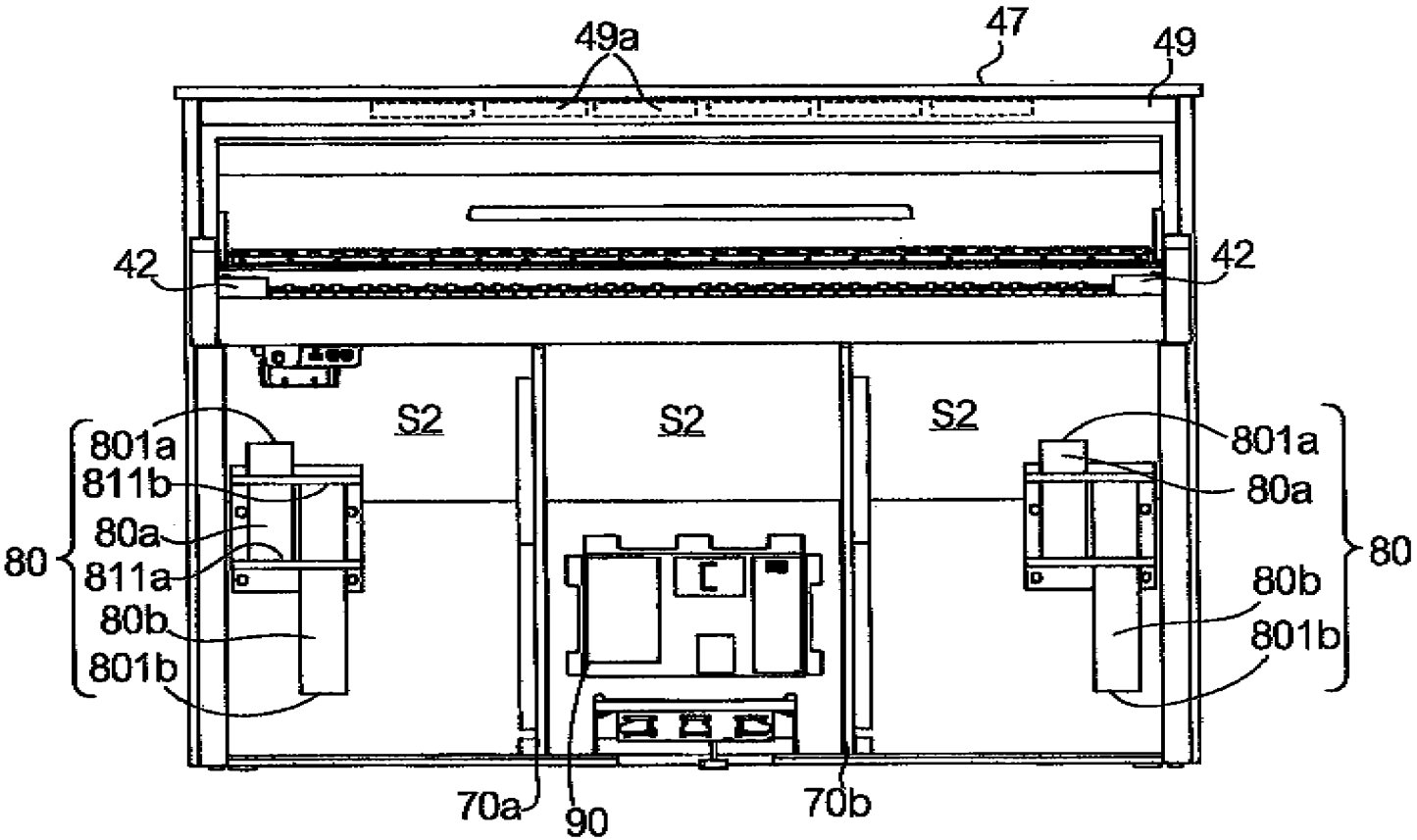
Figure 14:
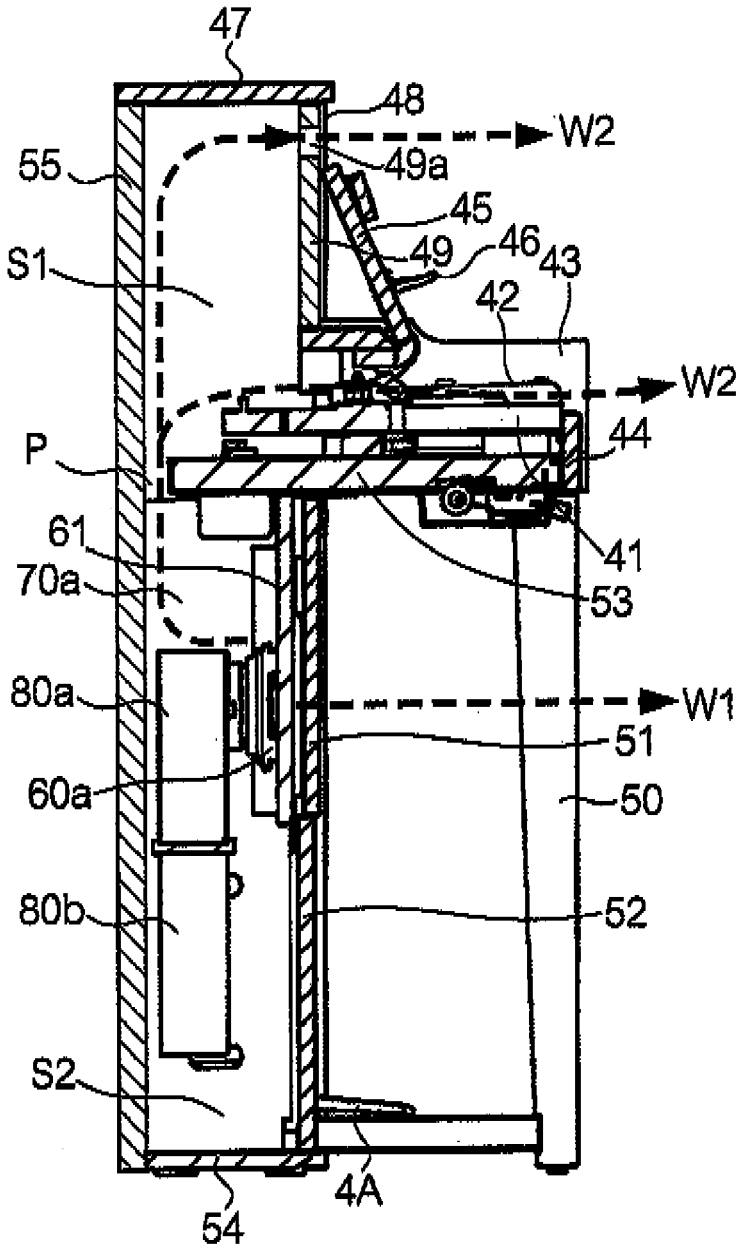
FIG. 14 is a cross-sectional view of the electronic keyboard musical instrument taken along line A-A in FIG. 11.

FIG. 13 shows the electronic keyboard musical instrument 1A in a state in which the upper lower-front plate 52*a*, the lower lower-front plate 52*b*, and the baffle plates 61 on which the speakers 60 are installed are removed. As shown in FIG. 13, in a space between the partition plate 70*a* and the partition plate 70*b*, a circuit board 90 such as a musical-sound signal generating circuit and a sound source circuit, and the pedal unit 4A are disposed. Among the spaces partitioned by the partition plates 70*a*, 70*b* in the lower inner space S2, in each of two spaces in which the respective speakers 60*a*, 60*b* are provided (hereinafter each of the two spaces will be referred to as the speaker installation space), a resonator 80 constituted by a first resonator 80*a* and a second resonator 80*b* is disposed. FIG. 14 shows a cross section of the electronic keyboard musical instrument 1A taken along line A-A in FIG. 10. As shown in FIG. 14, each resonator 80 is disposed in the lower inner space S2 so as to be located outwardly of the corresponding speaker 60.

The positions of the partition plates 70*a*, 70*b* will be explained. The inner space of the casing 3A of the electronic keyboard musical instrument 1A according to the embodiment 2 has a dimension in the height direction larger than that of the inner space of the casing 3 of the electronic keyboard musical instrument 1 according to the illustrated embodiment 1. Accordingly, in the inner space of the casing 3A, there are produced the two-dimensional natural vibration mode in the height direction and in the key arrangement direction. Therefore, the number of the natural vibration modes excited by the driving of the speakers is increased, as compared with the illustrated embodiment 1.

Figure 15A:
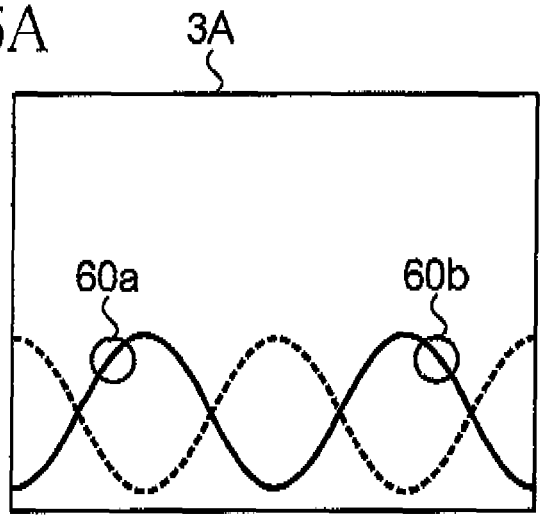
FIGS. 15(*a*)-(*b*) are views for explaining positions of respective partition plates in the embodiment 2.
Figure 15B:
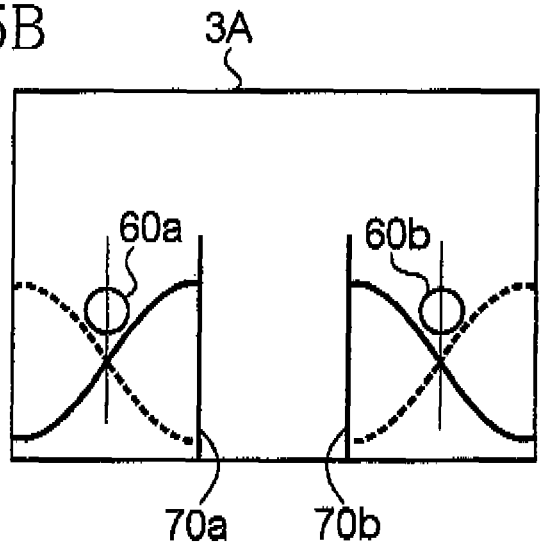

FIG. 15(*a*) is a simplified view showing the casing 3A in which the partition plates 70 are not provided, when viewed from the front side. As shown in FIG. 15(*a*), when the fourth-degree natural vibration mode SW2 is being generated in the key arrangement direction, for instance, the speakers 60 are likely to vibrate where the speakers 60*a*, 60*b* are located at positions corresponding to antinodes of the sound pressure in the natural vibration mode SW2. As a result, the natural vibration mode SW2 tends to be excited. On the other hand, as shown in FIG. 15(*b*), where the partition plates 70*a*, 70*b* are disposed such that the speakers 60*a*, 60*b* are located at positions corresponding to nodes of the sound pressure in the natural vibration mode SW2, the natural vibration mode SW2 does not tend to be excited even by the vibration of the speakers 60.

Since the positions at which the speakers 60 are installed are limited by the electronic components disposed in the casing 3A, the size of the casing 3A and the like, it is rather difficult to change the positions of the speakers. In view of this, in the casing 3A according to the present embodiment, the positions corresponding to the nodes of the sound pressure in the natural vibration mode generated in the inner space are adjusted by the partition plates 70, thereby reducing the number of the natural vibration modes excited by the vibration of the speakers 60.

Figure 16:
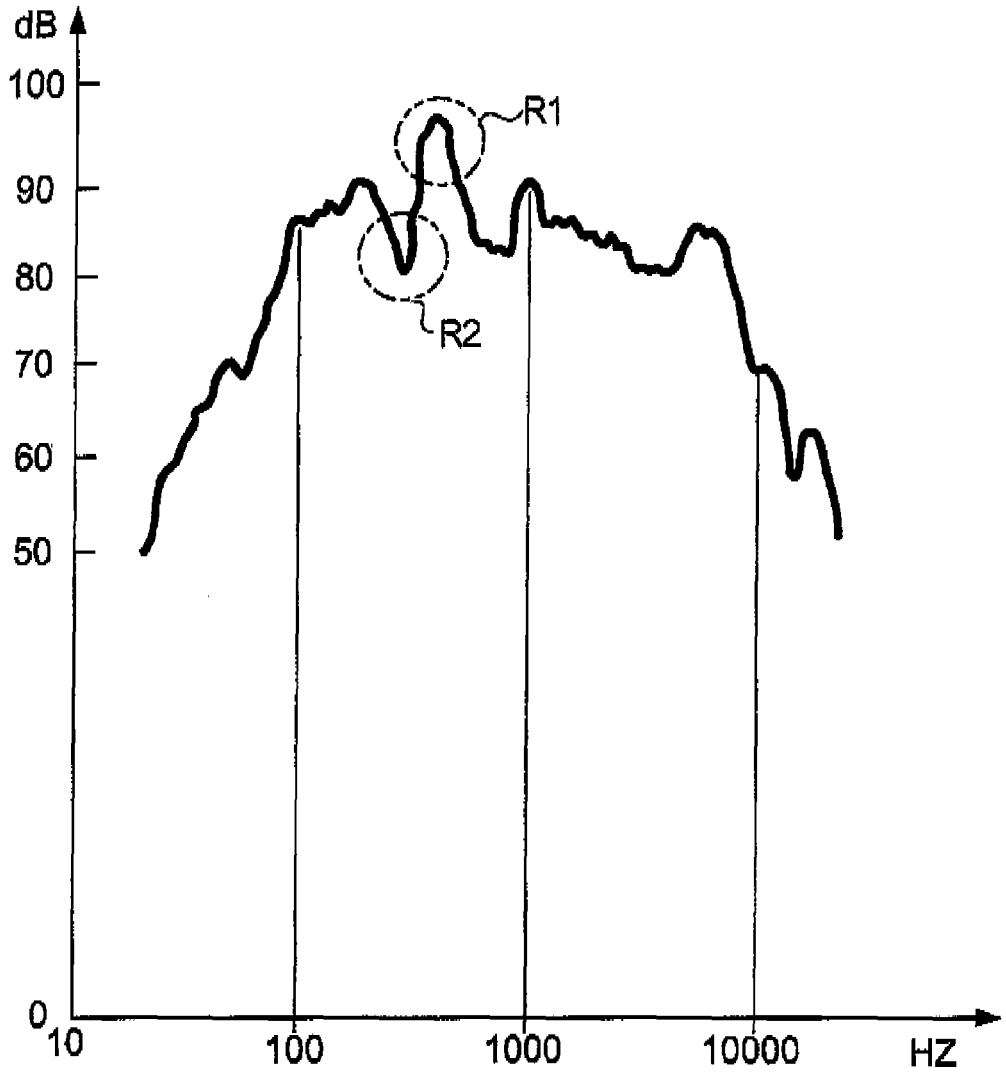
FIG. 16 is a graph showing a listening sound-pressure frequency characteristic at a performer's position in an instance where the partition plates are provide in the embodiment 2.
Figure 17A:
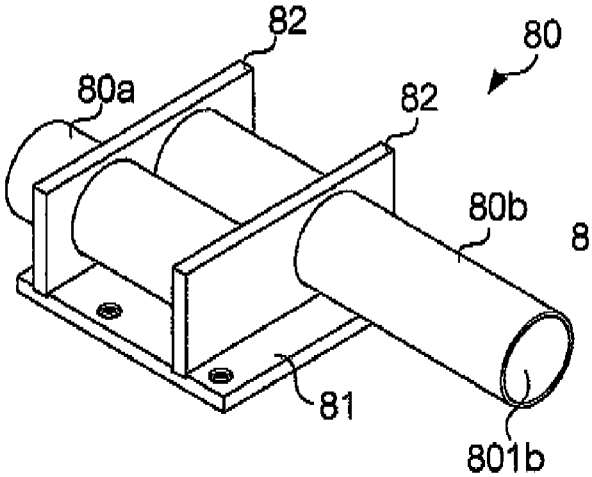
FIGS. 17(*a*)-(*d*) are views showing resonators according to the embodiment 2.
Figure 17B:
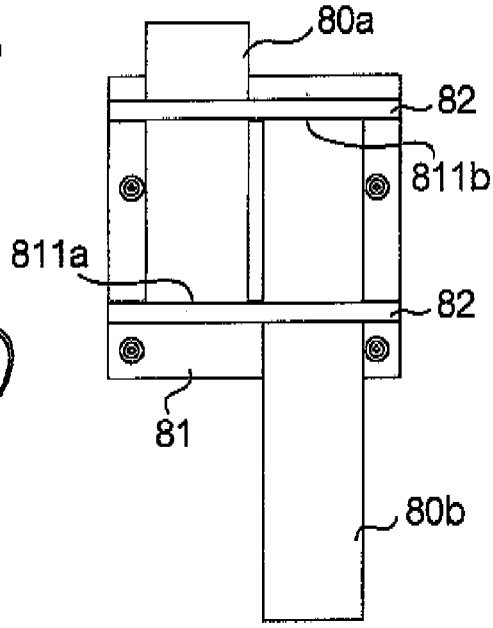
Figure 17C:
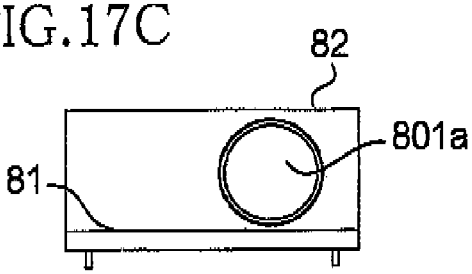
Figure 17D:
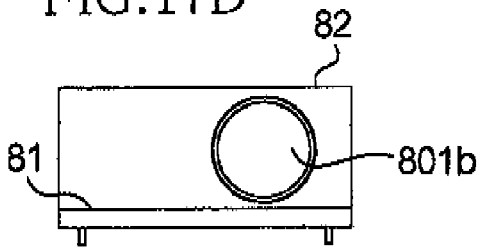

FIG. 16 shows a listening sound-pressure frequency characteristic at the performer's position in the case in which the partition plates 70 are provided as described above. As apparent from FIG. 16, a peak is generated at a portion indicated by an encircled portion R1, and a dip is generated at a portion indicated by en encircled portion R2. As in the illustrated embodiment 1, the frequency at which the peak is generated is a frequency of the sound wave excited by the vibration of each speaker 60 (i.e., the frequency corresponding to the dashed line B in each of FIGS. 5(*b*) and 5(*c*)). It is considered that the dip is generated due to a counterforce which suppresses the vibration of the speaker 60. That is, the vibration is suppressed because of a counterforce that a diaphragm of the speaker 60 pushes the air toward the inner space at a timing when the sound pressure becomes positive in a rear-side space located rearward of the sound emission surface of the speaker 60 and a counterforce that the diaphragm of the speaker 60 pushes the air toward the outer space at a timing when the sound pressure becomes negative in the rear-side space.

The resonator 80 provided in each speaker installation space of the casing 3A according to the present embodiment is for suppressing the peak and the dip shown in FIG. 16. The structure of the resonator 80 according to the present embodiment will be explained with reference to FIG. 17. FIG. 17(*a*) is a perspective view showing an external appearance of the resonator 80. FIG. 17(*b*) is a plan view of the resonator 80 shown in FIG. 17(*a*). FIG. 17(*c*) is a rear view of the resonator 80. FIG. 17(*d*) is a front view of the resonator 80.

As shown in FIG. 17(*a*), the resonator 80 is constructed such that a cylindrical first resonator 80*a* and a cylindrical second resonator 80*b* are attached to an attachment plate 81. Like the resonator 32 in the illustrated embodiment 1, each of the first resonator 80*a* and the second resonator 80*b* is formed of a material such as metal, synthetic resin or the like, so as to have a tubular shape, and has a hollow region. As shown in FIGS. 17(*b*)-(*d*), one of longitudinally opposite ends of each of the first resonator 80*a* and the second resonator 80*b* is open so as to provide an open end portion 801*a*, 801*b* (as a control point) while the other of the longitudinally opposite ends is closed by a corresponding attachment members 82 so as to provide a closed end portion 811*a*, 811*b*. The attachment plate 81 and the attachment members 82 constitute a holding member for disposing, in the casing 3A, the first resonator 80*a* and the second resonator 80*b* as a unit.

The first resonator 80*a* is one example of a resonator according to the present invention and one example of a first resonator of the present invention. The first resonator 80*a* has a function of reducing the sound pressure of the sound wave at the specific frequency excited by the vibration of the each speaker 60, namely a function of suppressing the peak indicated by R1 in FIG. 16. The length of the hollow region of the first resonator 80*a* is designed to be equal to a length corresponding to a quarter (¼) of the wavelength of the sound wave at the frequency at which the peak is generated.

The second resonator 80*b* is one example of the resonator according to the present invention and one example of a second resonator of the present invention. The second resonator 80*b* has a function of releasing or weakening the counterforce that suppresses the vibration of each speaker 60, namely a function of suppressing the dip indicated by R2 in FIG. 16. The length of the hollow region of the second resonator 80*b* is designed to be equal to a length corresponding to a quarter (¼) of the wavelength of the sound wave at the frequency at which the dip is generated.

Figure 19A:
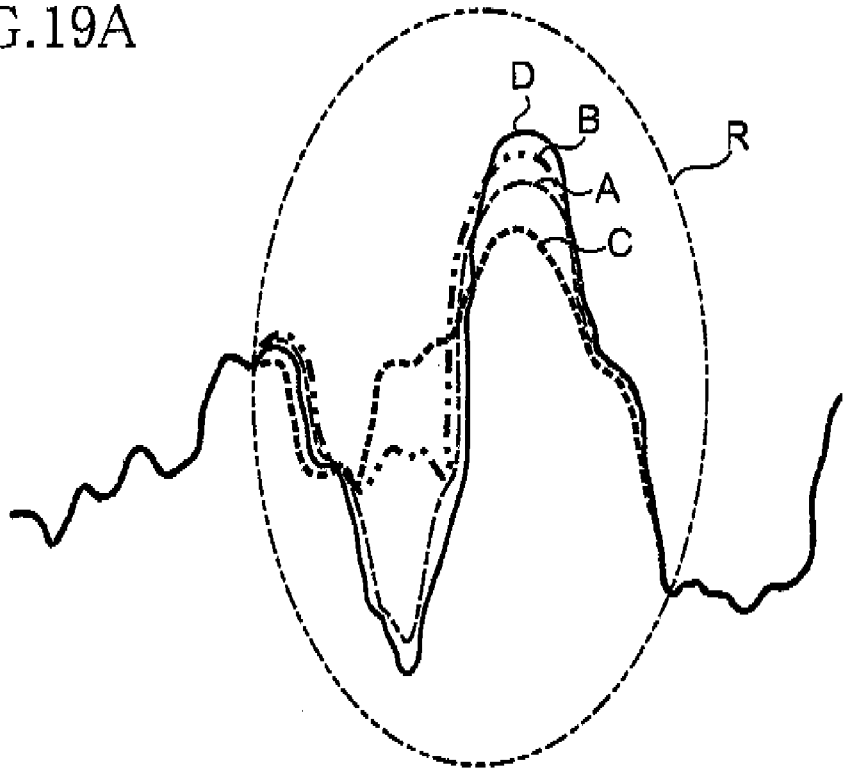
FIG. 19A is a diagram showing listening sound-pressure frequency characteristics at an encircled portion R in FIG. 16 for respective installation patterns of the resonators.

As in the illustrated embodiment 1, the position of the open end portion 801*a* of the first resonator 80*a* in each speaker installation space is a position corresponding to an antinode of the sound pressure in the natural vibration mode at the frequency at which the peak is generated. The position of the open end portion 801*b* of the second resonator 80*b* in each speaker installation space is on a boundary surface which is distant from the center of the speaker 60 (i.e., the axis of a voice coil of the speaker) by a distance corresponding to a substantially quarter (¼) of the wavelength of the sound pressure at the frequency at which the dip is generated. The position of the open end portion 801*b* of the second resonator 80*b* is a position which corresponds to an antinode of the sound pressure in the natural vibration mode at the frequency at which the dip is generated and which is in the vicinity of the baffle plate 61 on which the speaker is mounted. The sound wave which includes the frequency enters the hollow region from the open end portion 801*b* of the second resonator 80*b*, whereby the second resonator 80*b* resonates. As a result, the sound pressure is reduced in the vicinity of the open end portion 801*b* centering around the frequency, so that the counterforce of the speaker 60 is released or weakened. The position of the open end portion 801*b* of the second resonator 80*b* in each speaker installation space may be a position: which corresponds to an antinode of the sound pressure in the natural vibration mode at the frequency at which the dip is generated as shown in FIG. 16 and FIG. 19A; and at which a node of the sound pressure in the natural vibration mode at the frequency at which the dip is generated is located in the vicinity of the center of the speaker 60 (the center of the speaker 60 corresponding to each position on the axis of the voice coil of the speaker) by resonance, at the frequency at which the dip is generated, of the second resonator 80*b* which is located at the position corresponding to the antinode of the sound pressure in the natural vibration mode. Here, the vicinity of the center of the speaker 80 at which the node of the sound pressure is located is preferably a region within a distance of $\lambda/8$ from the center of the speaker 60 ($\lambda$: the wavelength of the sound pressure at the frequency at which the dip is generated). The node of the sound pressure in the natural vibration mode at the frequency at which the dip is generated is thus located in the region within the distance of $\lambda/8$ from the center of the speaker 60, whereby the counterforce of the speaker 60 is released or weakened as described above.

Figure 18:
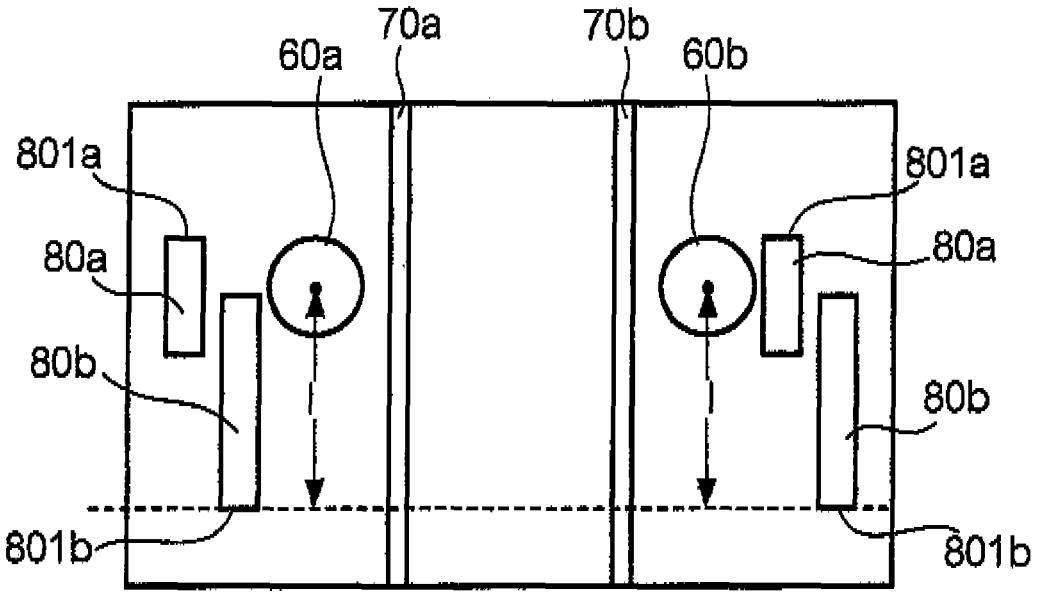
FIG. 18 is a view of the electronic keyboard musical instrument shown in FIG. 10 in a state in which the upper lower-front plate, a lower lower-front plate, and speakers are removed.

Here, the inventors have obtained the following by experiments. That is, in the electronic keyboard musical instrument 1A according to the present embodiment in which the TEs 49*a* are formed at positions above the keyboard 41, a more enhanced advantage is ensured by disposing each first resonator 80*a* such that the open end portion 801*a* is located at a position where the open end portion 801*a* is nearer to the corresponding side plate 48 than the corresponding speaker 60 in the lateral direction (the key arrangement direction) in the corresponding speaker installation space, namely, at a position nearer to the external space, in the vicinity of a mid point in the speaker installation space in the height direction. Further, the inventors also obtained from the experiments that the open end portion 801*b* of the second resonator 80*b* is desirably located near to the bottom portion of the speaker installation space, namely, the open end portion 801*b* is desirably located on a lower boundary surface in the lower inner space S2 shown in FIG. 18, which lower boundary surface is distant from the center of the speaker 60 by a distance 1 corresponding to a substantially quarter (¼) of the wavelength of the sound wave at which the counterforce with respect to the vibration of the speaker 60 is generated. The natural vibration modes in the casing 3A vary depending upon the positions of the Ts 49*a* and the like, it is desirable that the positions of the open end portions of the respective first and second resonators 80*a*, 80*b* be adjusted by experiments and the like in accordance with the layout of the TEs 49*a*.

Figure 19B:
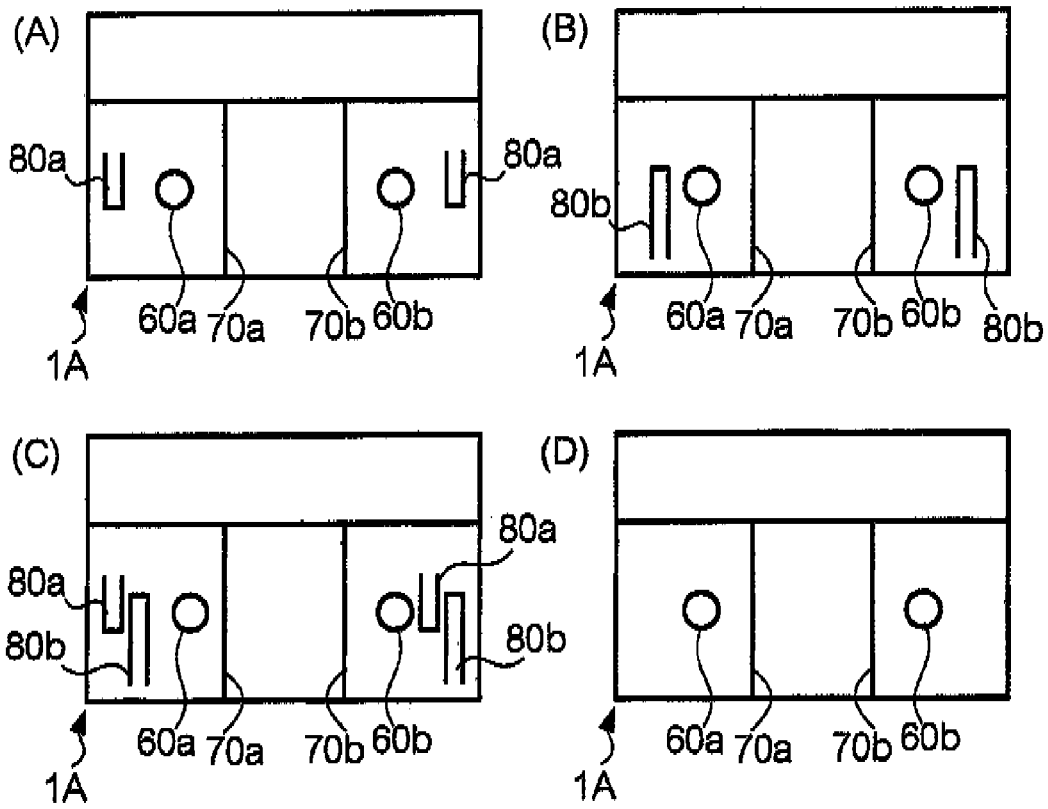
FIG. 19B are views showing the installation patterns of the resonators.

FIG. 19A shows frequency characteristics measured by the inventors. More specifically, the waveform A indicates a case in which only the first resonator 80*a* is disposed in each speaker installation space of the lower inner space S2 as shown in FIG. 19B(A). The waveform B indicates a case in which only the second resonator 80*b* is disposed in each speaker installation space of the lower inner space S2 as shown in FIG. 19B(B). The waveform C indicates a case in which the first resonator 80*a* and the second resonator 80*b* are disposed in each speaker installation space of the lower inner space S2 as shown in 19B(C). The waveform D (similar to that shown in FIG. 16) indicates a case in which none of the first resonator 80*a* and the second resonator 80*b* are disposed in each speaker installation space of the lower inner space S2 as shown in 19B(D). In FIG. 19A, portions corresponding to the portions R1, R2 in FIG. 16 are enlarged.

As shown in FIG. 19A, concerning the portion at which the dip is generated, the counterforce that suppresses the vibration of the speakers 60*a*, 60*b* is released or weakened and the sound pressure of the sound wave at the frequency at which the dip is generated is increased as indicated by the waveform B in the case in which only the second resonator 80*b* is disposed, as apparent from a comparison with the case in which the resonators 80 are not disposed. Concerning the portion at which the peak is generated, the sound pressure of the sound wave excited at the specific frequency is reduced as indicated by the waveform A in the case in which only the first resonator 80*a* is disposed, as apparent from a comparison with the case in which the resonators 80 are not disposed. As indicated by the waveform C, in the case in which the first resonator 80*a* and the second resonator 80*b* are disposed, the sound pressure at the portion of the dip is increased as compared with the waveform B and the sound pressure at the portion of the peak is reduced as compared with the waveform A. Thus, it is to be understood that the provision of the first resonator 80*a* and the second resonator 80*b* ensures enhanced advantages.

In the casing 3A of the electronic keyboard musical instrument 1A according to the present embodiment in which the two-dimensional natural vibration mode may be generated, it is possible to reduce the number of the natural vibration modes excited by the vibration of the speakers 60 by disposing the partition plates 70 such that each speaker 60 is located at the position corresponding to the node of the sound pressure in the natural vibration mode. Further, by disposing the resonator 80 in each speaker installation space, the first resonator 80*a* configured to resonate at the frequency of the excited sound wave reduces the sound pressure at the frequency in question while the second resonator 80*b* configured to resonate at the frequency at which the counterforce that suppresses the vibration of the speaker 60 is generated releases or weakens the counterforce and thereby increases the sound pressure of the sound wave at the frequency in question.

In the present embodiment, the dip is reduced by disposing the second resonator 80*b* configured to resonate at the frequency at which the counterforce with respect to the vibration of the speaker 60 is generated, such that the open end portion 801*b* is located at the position which is distant in the downward direction from the center of the speaker 60 by the distance corresponding to a quarter (¼) of the wavelength of the sound wave at the frequency in question. As the cause for the occurrence of the dip, it is considered that the node of the sound pressure in the natural vibration mode at the frequency at which the dip is generated is located in the vicinity of each TE 49*a*. In other words, while the natural vibration mode at the frequency at which the dip is generated is excited by the vibration of each speaker 60, the sound pressure in the vicinity of the TE 49*a* is weakened, so that the sound volume emitted from the TE 49*a* becomes small. Accordingly, in such an instance, the open end portion of the second resonator 80*b* configured to resonate at the frequency at which the dip is generated may be located at the position in the inner space of the casing 3A corresponding to the node in the natural vibration mode at the frequency in question, such that the vicinity of the TE 49*a* corresponds to the antinode of the sound pressure in the natural vibration mode at the frequency in question. Such an arrangement forcibly produces the position of the node in the natural vibration mode at the frequency at which the dip is generated, owing to the open end portion 801*b* of each second resonator 80*b*. As a result, the sound pressure in the vicinity of the TE 49*a* is controlled to be the antinode, thereby increasing the sound pressure at the frequency at which the dip is generated. In this instance, the second resonator 80*b* functions as a third resonator of the present invention.

Embodiment 3

Figure 20:
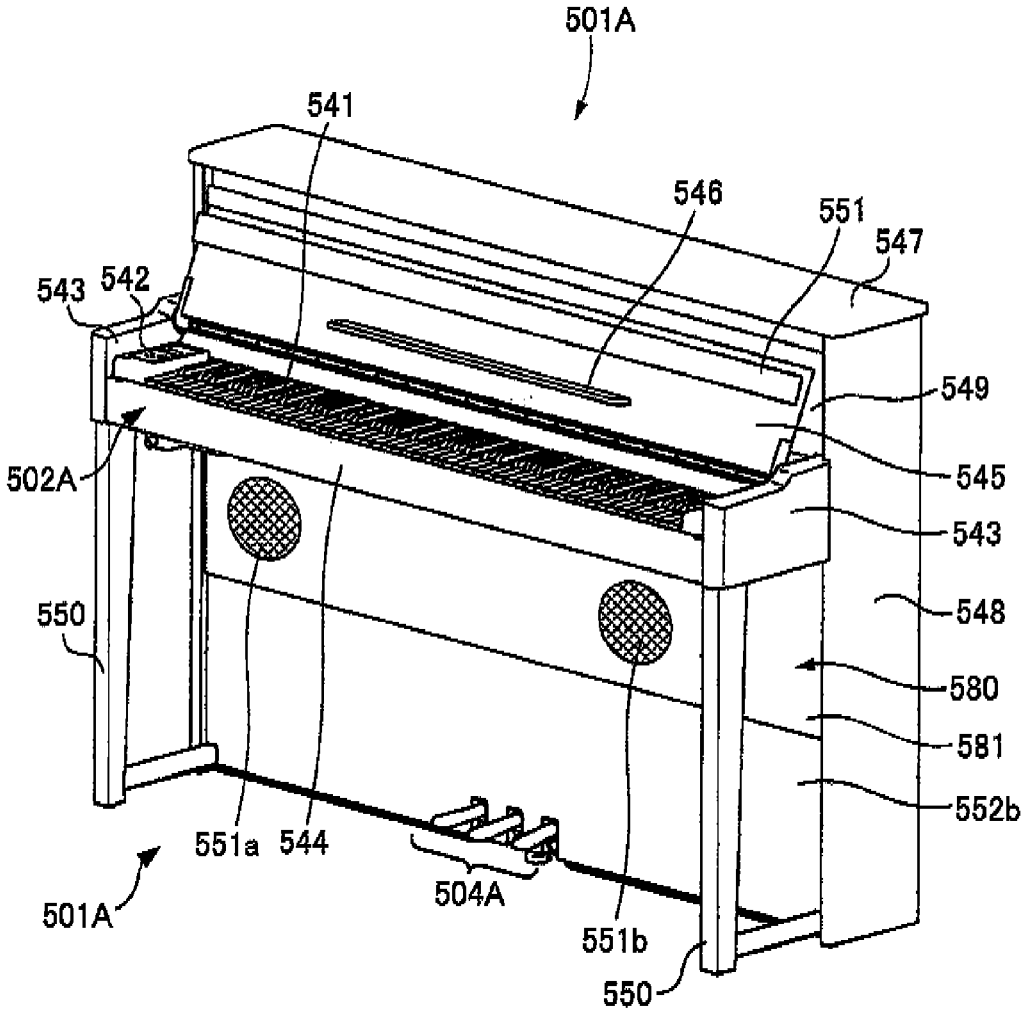
FIG. 20 is a perspective view of an electronic keyboard musical instrument according to an embodiment 3.

Referring to the perspective view of FIG. 20, there will be explained an electronic keyboard musical instrument 501A according to an embodiment 3 of the invention. The electronic keyboard musical instrument 501A includes a keyboard unit 502A and a casing 503A (FIG. 22) supporting the keyboard unit 502A.

The keyboard unit 502A includes: a plate-like key slip portion 544 extending in the horizontal direction; side plates 548, 548 respectively extending from one and the other of opposite ends of the key slip portion 544 toward the rear side; and a key bed 553 provided so as to cover a bottom portion of a U-shaped frame constituted by the key slip portion 544 and the side plates 548, 648. In the frame constituted by the side plates 548, 548, the key slip portion 544, and the key bed 558, there is accommodated a keyboard 541 in which white keys and black keys are arranged. A keyboard lid 545 covering the rear-side portion of the keyboard 541 is pivotably provided. In a key block portion 542, a power switch and various operation switches are provided. The keyboard lid 545 has a music stand 546 and a lid front 551 on one surface thereof that can be seen by the performer when the keyboard lid 545 is opened such that the keyboard 541 is visible. Further, the keyboard lid 545 covers the keyboard 541 when pivoted toward the performer's side. In a state shown in FIG. 20, a performance operation portion of the keyboard 541 is exposed. In each of the keys of the keyboard 541, there is provided a detection switch (not shown) for detecting an associated key pressed by the performer. Each detection switch is configured to output an operation signal inn, accordance with a detected key to a musical-sound signal detecting circuit 534 described below. The key slip portion 544 functions as a key support member for supporting, from below, the keyboard 541 and the musical-sound signal detecting circuit 534.

The casing 503A includes arm portion 543, 543 which respectively support left and right ends of the keyboard unit 502A and which extend in the vertical direction. The side plates 548, 548 on the rear side of the arm portions 543 are connected at respective lower ends by a bottom plate 547 (FIG. 22) and at respective upper ends by a roof plate 547. The rear side of the side plates 548, 548 and the roof plate 547 is covered by a rear plate 555. An upper front plate 549 is attached so as to cover from the upper end portion of the roof plate 547 to the rear-side portion of the keyboard 541. The key bed 553 is supported by front leg portions 550, 550 from below. The musical-sound signal detecting circuit 534 is accommodated in the casing 503A.

Figure 23:
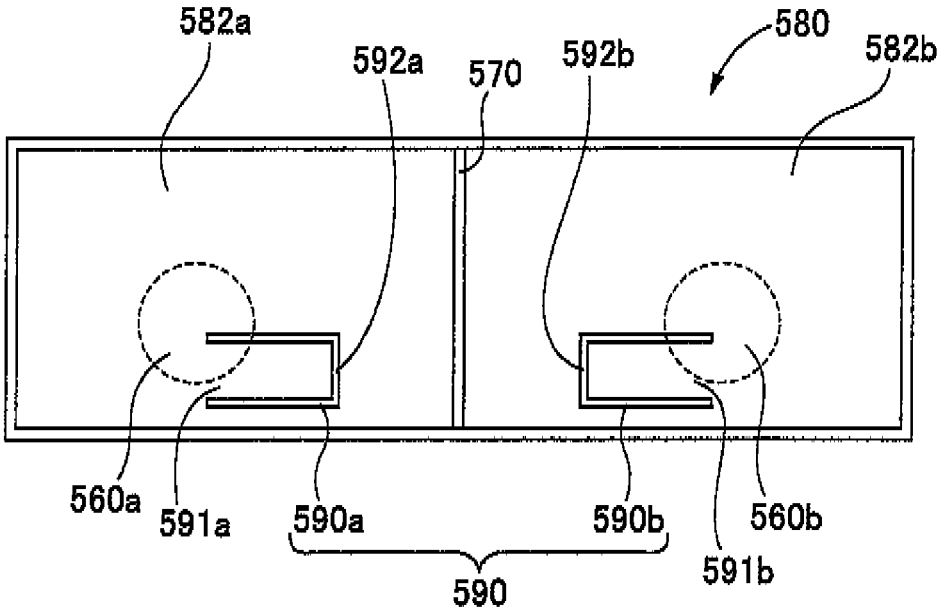
FIG. 23 is a view showing positions of speakers and installation positions of resonators in a speaker box

A speaker box 580 is provided below the key bed 663. The speaker box 580 is fixed to the left and right side plates 548, 548 and is disposed such that a front plate 581 of the speaker box 580 does not protrude frontward from the front ends of the respective side plates 548. The speaker box 580 has an inner space 582 which is partitioned by a partition plate 570 in the left-right direction, so as to provide an inner space 582*a* and an inner space 582*b* (FIG. 23). In the inner spaces 582*a*, 582*b* of the speaker box 580, rear-surface portions of respective speakers 560*a*, 560*b* (that will be explained) are respectively located. At respective positions of the front plate 581 corresponding to the two speakers 560, there are provided sound emission holes from which sound from the corresponding speakers 560 is emitted and saran nets 551*a*, 551*b*. Tone escapes (TEs) 581 are formed in the front plate 581 at a height position higher than the height position at which the saran nets 551*a*, 551*b* are provided. Each of the inner spaces 582*a*, 582*b* of the speaker box 580 is a substantially closed space, but permits the air to flow in and out through the TEs 581*a*. Accordingly, the sound emitted from the rear-surface side of each speaker 560 opposite to a sound emission surface thereof passes through the inner space 582*a*, 582*b* and is introduced to an exterior via the TEs 581*a*. A lower front plate 552*b* is provided below the speaker box 580. The lower front plate 552*b* extends downward so as to be substantially flush with the front plate 581 of the speaker box 580.

The front leg portion 550, 550 are provided so as to extend from the bottom portions of the respective arm portions 543, 543 [toward the performer's side], whereby the casing 503A can stand erect with high stability. Further, a pedal unit 504A is accommodated in the central portion of the lower front plate 552*b* in a state in which pedals thereof protrude toward the performer's side.

Figure 21:
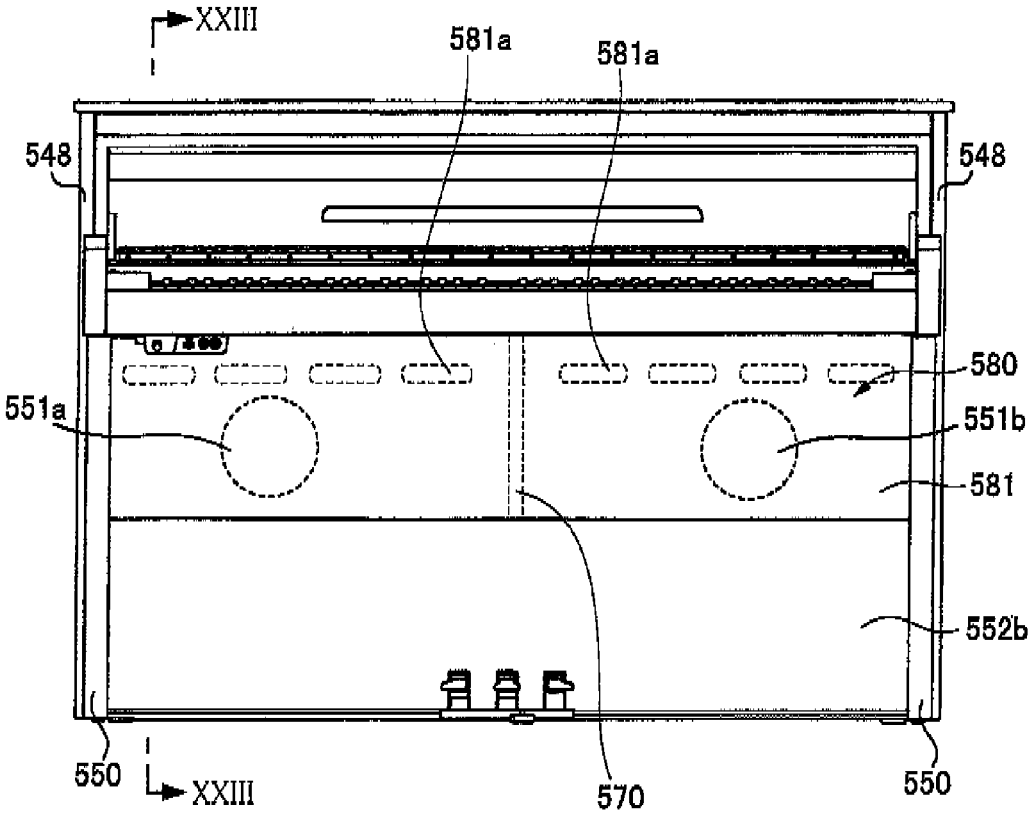
FIG. 21 is a front view of the electronic keyboard musical instrument shown in FIG. 20.
Figure 22:
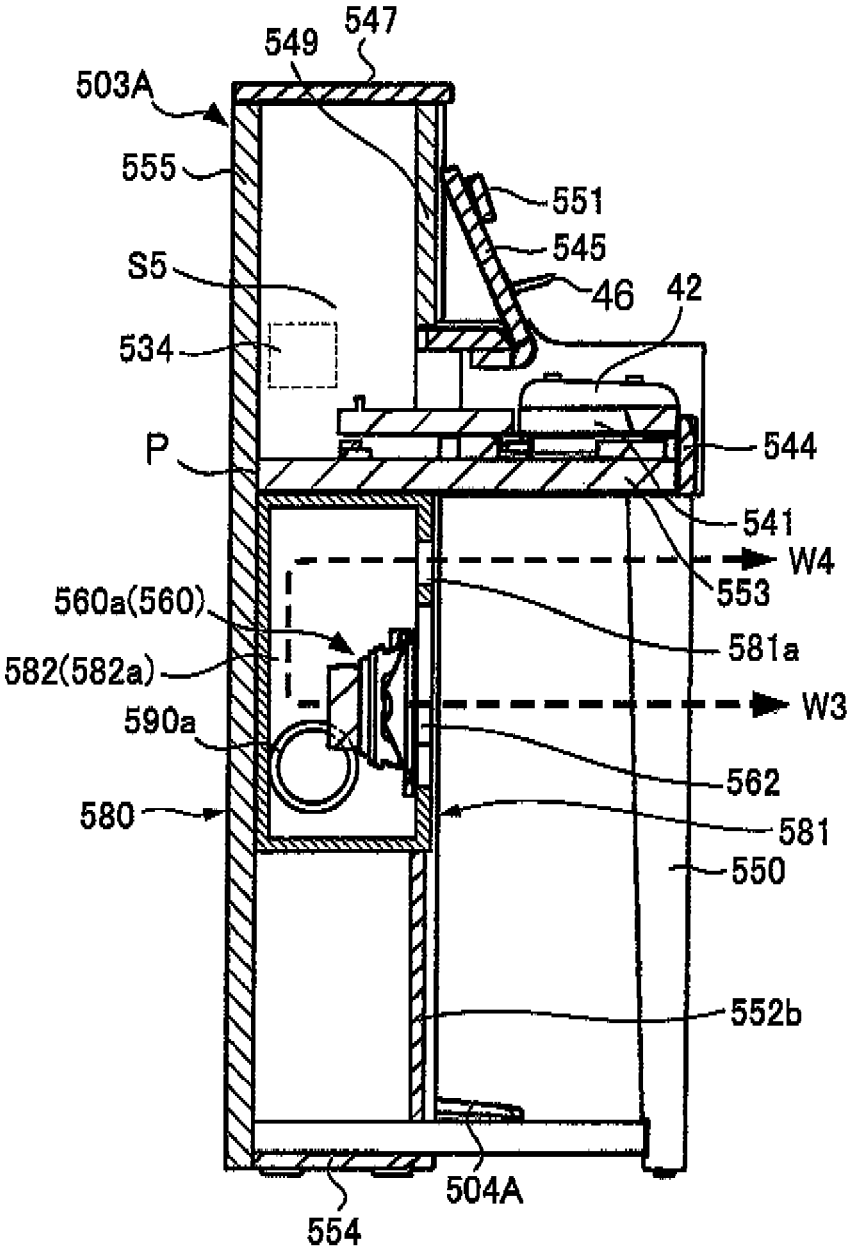
FIG. 22 is a cross-sectional view of the electronic keyboard musical instrument taken along line XXII-XXII in FIG. 21.

Next, the inner structure of the casing 503A will be explained. FIG. 21 is a front view of the electronic keyboard musical instrument 501A shown in FIG. 20. FIG. 22 is a cross-sectional view of the electronic keyboard musical instrument 501A taken along line in XXII-XXII in FIG. 21.

Each speaker 560 is installed such that the sound emission surface thereof is directed toward the performer's side, and a hole 562 for sound emission is formed in the front plate 581 at a position corresponding to each speaker 560. The sound emitted from each speaker 560 propagates to the performer's side through the corresponding hole 562. Each of the propagation paths will be hereinafter referred to as a third sound emission path W3. The sound emitted from the rear-surface side of each speaker 560 opposite to the sound emission surface passes through the corresponding inner space 582*a*, 582*b* and propagates toward the performer' side through the TEs 581*a* formed in the front plate 581. Each of the propagation paths will be hereinafter referred to as a fourth sound emission path W4.

FIG. 23 is a view for explaining positions of the speakers 560 and an installation position of a resonator 590 in the inner space 582 of the speaker box 580. The resonator 590 is constituted by a cylindrical third resonator 590*a* (as one example of the second resonator of the invention) and a cylindrical fourth resonator 590*b* (as one example of the second resonator of the invention). The third resonator 590*a* and the fourth resonator 590*b* are disposed in the respective inner spaces 582*a*, 582*b* so as to be fixed to the wall of the speaker box 580. One of longitudinally opposite ends of each of the third resonator 590*a* and the fourth resonator 590*b* is open so as to provide an open end portion 591*a*, 591*b* (as a control point) while the other of the longitudinally opposite ends is closed so as to provide a closed end portion 592*a*, 592*b*.

The third resonator 590*a* has a function of reducing the sound pressure of the sound wave at the specific frequency excited by vibration of the corresponding speaker 560, namely a function of suppressing the dip indicated by R2 in FIG. 16. The length of the hollow region of the third resonator 590*a* is designed to be equal to a length corresponding to a quarter (¼) of the wavelength of the sound wave at the frequency at which the dip is generated.

The fourth resonator 590*b* has a function of reducing the sound pressure of the sound wave at the specific frequency excited by the vibration of the corresponding speaker 560, namely a function of suppressing the dip indicated by R2 in FIG. 16. The length of the hollow region of the fourth resonator 590*b* is designed to be equal to a length corresponding to a quarter (¼) of the wavelength of the sound wave at the frequency at which the dip is generated.

Figure 24A:
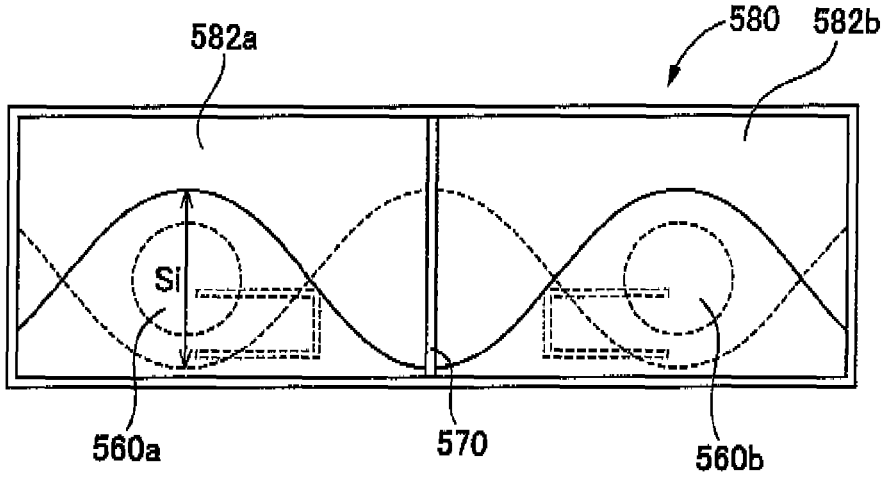
FIG. 24A is a view showing a sound pressure in a case where the resonators are not provided in the speaker box.
Figure 24B:
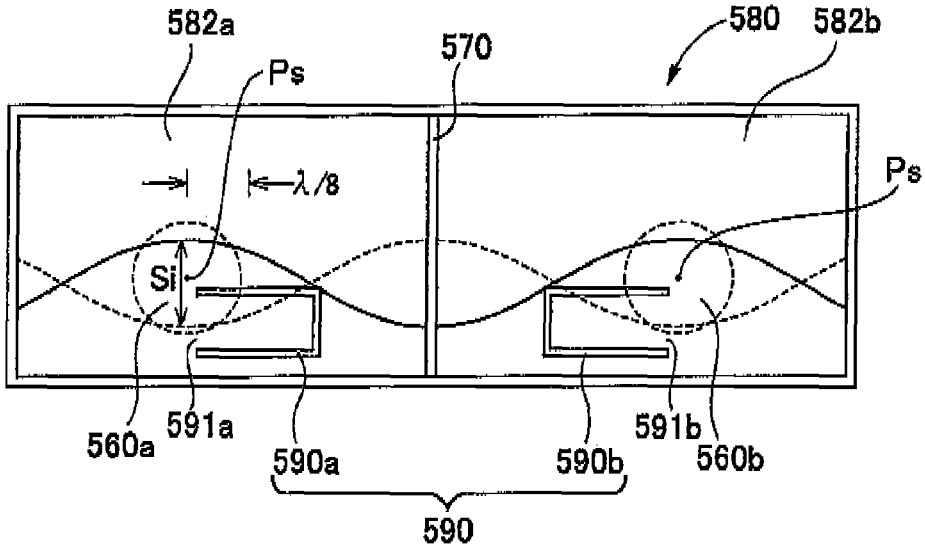
FIGS. 24B and 24 C are views each showing a sound pressure in a case where the resonators are provided in the speaker box.

In the inner spaces 582*a*, 582*b* in each of which each of the speakers 560 are disposed, the open end portion 591*a* of the third resonator 590*a* is located at a position corresponding to an antinode of the sound pressure in the natural vibration mode at the frequency at which the dip is generated, and the open end portion 591*b* of the fourth resonator 590*b* is located at a position corresponding to an antinode of the sound pressure in the natural vibration mode at the frequency at which the dip is generated. The sound wave which includes the frequency at which the dip is generated enters the hollow regions of the respective third and fourth resonators 590*a*, 590*b* from the open end portions 591*a*, 591*b* thereof, and the third resonator 590*a* and the fourth resonator 590*b* resonate, whereby the sound pressure is reduced in the vicinity of the open end portions 591*a*, 591*b* centering around the frequency in question. This effect will be explained with reference to FIG. 24. FIG. 24A shows the sound pressure in the natural vibration mode at the frequency at which the dip is generated in a case in which the resonator 590 is not provided in the inner space 582. FIG. 24B shows the sound pressure in the natural vibration mode at the frequency at which the dip is generated in a case in which the resonator 590 is provided in the inner space 582. As shown in FIG. 24A, it is considered that the dip indicated by R2 in FIG. 16 occurs when the antinode of the sound pressure in the natural vibration mode at a frequency fd at which the dip is generated is located in the vicinity of each speaker 560*a*, 560*b*. Where the resonator 590 is disposed in the inner space 582 of the speaker box 580 such that each open end portion 591*a*, 591*b* is located at the position corresponding to the antinode of the sound pressure in the natural vibration mode at the frequency fd, the resonator 590 resonates, so that the sound pressure at the frequency fd in question is reduced and the counterforce that suppresses the vibration of the speakers 560 is released or weakened. As a result, the occurrence of the dip at the frequency fd is restrained. More specifically, each of the open end portion 591*a* of the third resonator 590*a* and the open end portion 591*b* of the fourth resonator 590*b* is located in the corresponding speaker installation space within the speaker box at a position (in FIG. 24B): which corresponds to an antinode of the sound pressure in the natural vibration mode at the frequency fd at which the dip is generated as shown in FIG. 16 and FIG. 19A; and at which the magnitude Si of the sound pressure in the natural vibration mode at the frequency fd becomes smaller by resonance of the third resonator 590*a* and the fourth resonator 590*b* at the frequency fd.

Figure 24C:
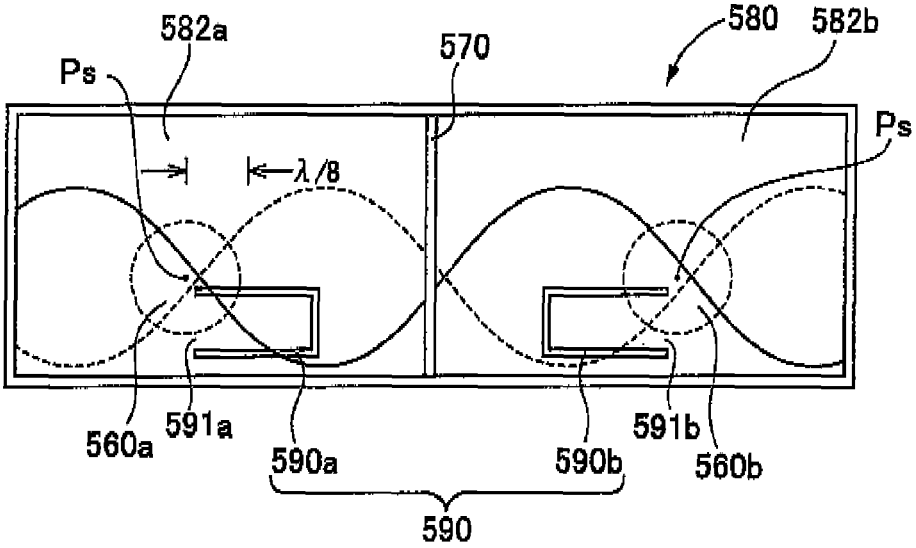

As shown in FIG. 24C, each of the open end portion 591*a* of the third resonator 590*a* and the open end portion 591*b* of the fourth resonator 590*b* may be located in the corresponding speaker installation space at a position: which corresponds to an antinode of the sound pressure in the natural vibration mode at the frequency fd; and at which a node of the sound pressure in the natural vibration mode at the frequency fd is located in the vicinity of the center Ps of the corresponding speaker 560*a*, 560*b* (the center of the speaker 560*a*, 560*b* corresponding to each position on the axis of the voice coil of the speaker) by resonance, at the frequency fd, of the third resonator 590*a* and the fourth resonator 590*b* each of which is located at the position corresponding to the antinode of the sound pressure in the natural vibration mode. Here, the vicinity of the center Ps of the speaker 560 at which the node of the sound pressure is located is preferably a region within a distance of $\lambda/8$ from the center Ps of the speaker 560 ($\lambda$: the wavelength of the sound pressure in the natural vibration mode at the frequency fd). The node of the sound pressure is thus located in the region within a distance of $\lambda/8$ from the center Ps of the speaker 560, whereby the counterforce of the speaker 560 is released or weakened as described above. According to the arrangement, where the antinode of the sound pressure in the natural vibration mode at the frequency fd is located at the center Ps of the speaker 560 as shown in FIG. 24A, each of the open end portions 591*a*, 591*b* of the resonator 590 is disposed so as to be located at the position corresponding to the antinode of the sound pressure in the natural vibration mode at the frequency fd such that the distance from the center Ps is less than λ/8.

Explanation is continued. FIG. 24A shows a state of a standing wave generated in the speaker box in an instance where the third resonator 590*a* and the fourth resonator 590*b* do not exist in the speaker box. FIG. 24 C shows a state in which the open end portions 591*a*, 591*b* of the respective third and fourth resonators 590*a*, 590*b* are located in the vicinity of the corresponding centers Ps of the speakers 560*a*, 560*b* with respect to the state in which the standing wave is present in the speaker box as shown in FIG. 24A, whereby natural vibration mode of the standing wave is changed such that each of the positions of the centers PS of the respective speakers 560*a*, 560*b* is located at a position corresponding to a node of the standing wave. Where the third resonator 590*a* and the fourth resonator 590*b* are disposed at respective positions at which the mode of the standing wave becomes such a natural vibration mode, the diaphragm of the speaker 560 tends to vibrate, so that an action in which the dip shown in FIG. 16 and FIG. 19A becomes smaller may take place. Where the antinode of the sound pressure in the natural vibration mode at the frequency fd is located at the center Ps of the speaker 560 as shown in FIG. 24A, the above-indicated action may practically take place, as long as a distance by which each of the positions of the respective third and fourth resonators 590*a*, 590*b* and the centers Ps of the corresponding speakers 560*a*, 560*b* are away from each other is up to λ/8. Accordingly, it is preferable that the open end portions 591*a*, 591*b* of the respective third and fourth resonators 590*a*, 590*b* be disposed in a range within the distance of λ/8 from the center Ps of the speaker 560.

Figure 25A:
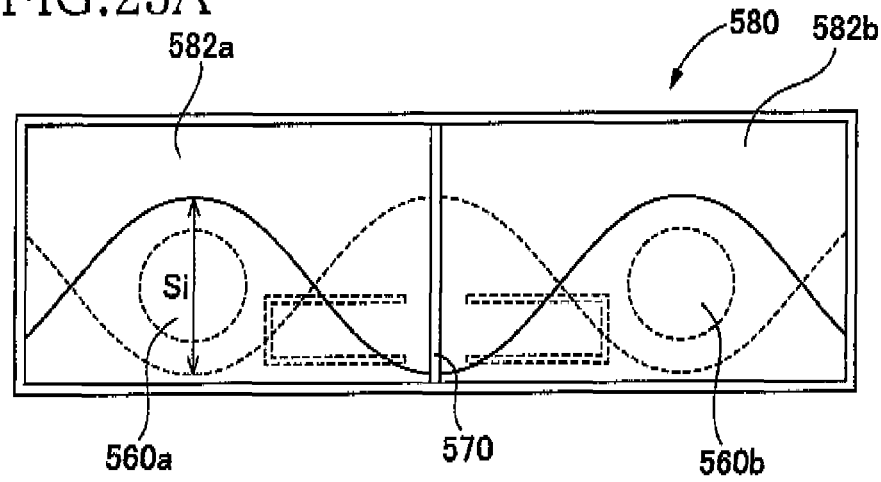
FIG. 25A is a view showing a sound pressure in a case where the resonators are not provided in the speaker box.
Figure 25B:
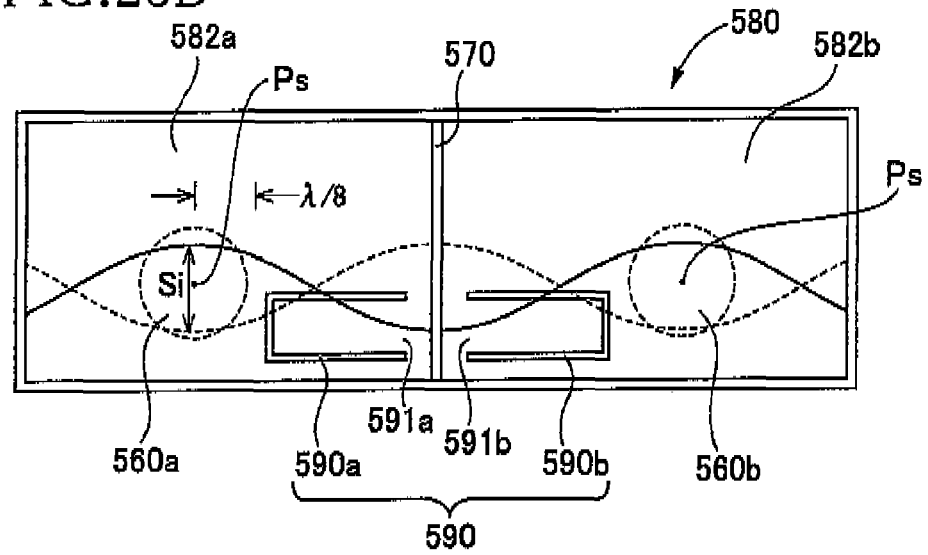
FIGS. 25B and 25C are views each showing a sound pressure in a case where the resonators are provided in the speaker box.

As a modification of the present embodiment, the resonator 590 may be disposed as shown in FIG. 25B. That is, the resonator 590 may be disposed such that each of the open end portions 591*a*, 591*b* of the respective third and fourth resonators 590*a*, 590*b* is located at the position: which corresponds to the antinode of the sound pressure in the natural vibration mode at the frequency at which the dip is generated in a case in which the resonator 590 is not disposed; and which is sufficiently away from the centers Ps of the corresponding speakers 560*a*, 560*b*. According to this arrangement, the magnitude Si of the sound pressure in the natural vibration mode at the frequency at which the dip is generated becomes smaller as shown in FIG. 25B, thereby restraining the occurrence of the dip.

Figure 25C:
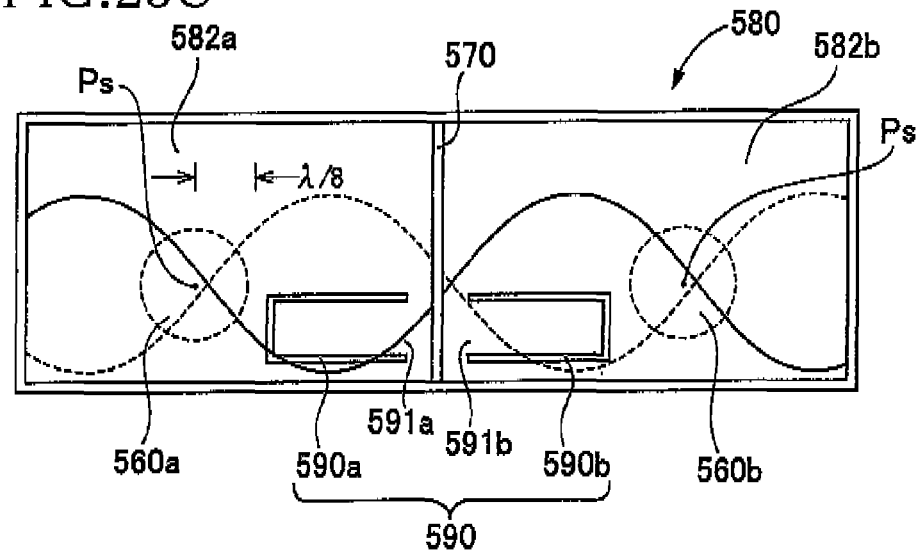

As shown in FIG. 25C, each of the open end portions 591*a*, 591*b* of the respective third and fourth resonators 590*a*, 590*b* may be disposed at a position: which corresponds to an antinode of the sound pressure in the natural vibration mode at the frequency at which the dip is generated; and which is sufficiently away from the centers Ps of the corresponding speakers 560*a*, 560*b*, whereby the node of the sound pressure in the natural vibration mode at the frequency at which the dip is generated is located in the vicinity of the center Ps of the corresponding speaker 560*a*, 560*b* as shown in FIG. 25C, so as to restrain the occurrence of the dip.

Modified Embodiments

Hereinafter, there will be explained modifications of the illustrated embodiments.

Figure 26A:
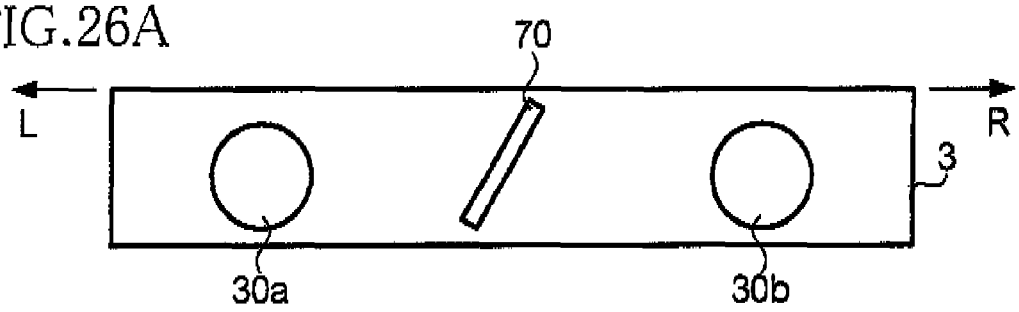
FIGS. 26(*a*)-(*b*) are simplified views each showing an inner space of a casing according to a modified embodiment 1 when viewed from above.
Figure 26B:
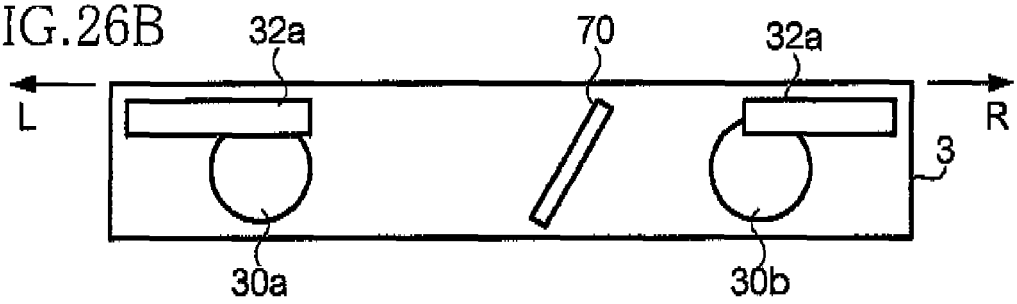
Figure 27A:
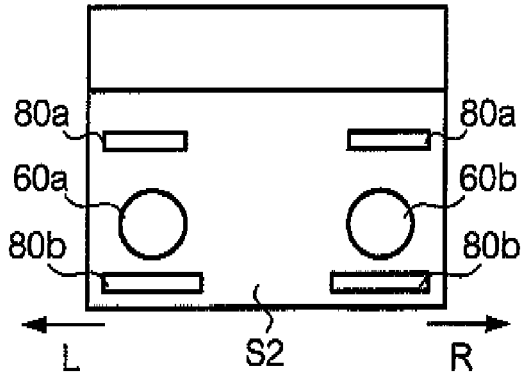
FIGS. 27(*a*)-(*d*) are simplified views each showing an inner space of a casing according to a modified embodiment 2 when viewed from above.
Figure 27B:
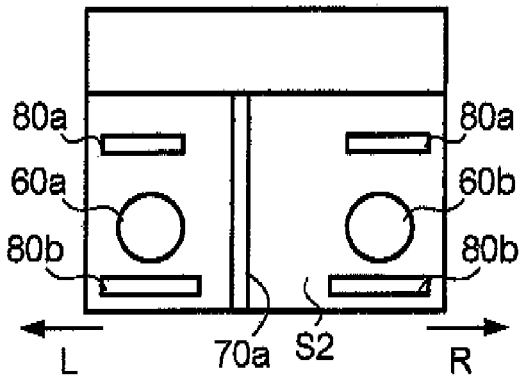
Figure 27C:
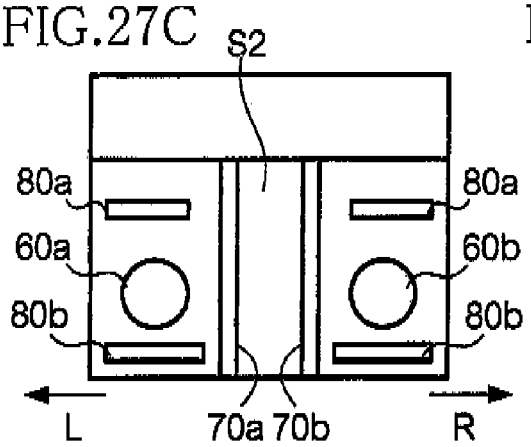
Figure 27D:
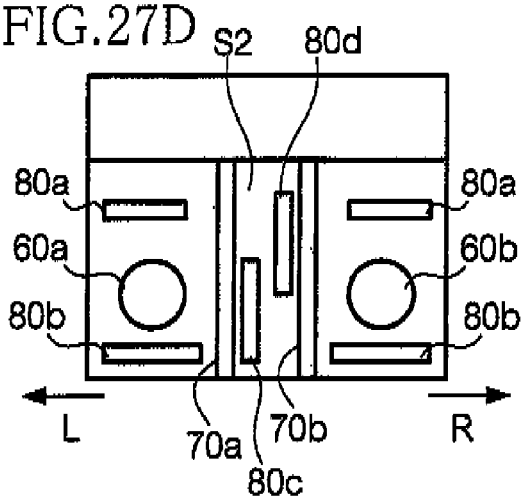

(1) in the illustrated embodiment 1, the four resonators 32 are disposed in the inner space of the casing 8. The embodiment 1 may be modified as follows. FIG. 26 is a simplified view of the inner space of the casing 3 when viewed from above. As shown in FIG. 26(*a*), no resonators 32 may be provided, and the partition plate 70 may be disposed between the speaker 30*a* and the speaker 30*b* such that each of the speakers 30*a*, 30*b* is located in the inner space at the position corresponding to the node of the sound pressure in the natural vibration mode. Further, as shown in FIG. 26(*b*), the partition plate 70 may be disposed as in FIG. 26(*a*), and each resonator 32*a* may be disposed in each of the spaces partitioned by the partition plate 70, such that the open end portion 321 of the resonator 32*a* is located at the position corresponding to the antinode of the sound pressure in the natural vibration mode.

(2) The layout of the first resonator 80*a* and the second resonator 80*b* in the inner space of the casing 3A in the illustrated embodiment 2 is not limited to that in the embodiment 2, but may be modified as follows. FIG. 27 are simplified views each showing the lower inner space of the casing 3A according to this modified embodiment, when viewed from the front side. FIG. 27(*a*) shows an arrangement in which the partition plate 70 is not provided and the two first resonators 80*a* are disposed respectively at one and the other of the two positions above the two speakers 60*a*, 60*b* while the two second resonators 80*b* are disposed respectively at one and the other of the two positions below the two speakers 60*a*, 60*b*. The open end portion 801*a* of the first resonator 80*a* and the open end portion 801*b* of the second resonator 80*b* provided on the side of the speaker 60*a* are directed in a direction indicated by an arrow L. The open end portion 801*a* of the first resonator 80*a* and the open end portion 801*b* of the second resonator 80*b* provided on the side of the speaker 60*b* are directed in a direction indicated by an arrow R. As in the embodiment 2, each of the open end portions 801*a* of the respective first resonators 80*a* is located at the position corresponding to the antinode of the sound pressure in the natural vibration mode at the excited frequency while each of the open end portions 801*b* of the respective second resonators 80*b* is located on the boundary surface which is distant from the gravity position of each speaker 60*a*, 60*b* by a distance corresponding to a quarter (¼) of the wavelength of the frequency at which is generated the counterforce that suppresses the vibration of each speaker 60*a*, 60*b*.

In the layout of the first resonators 80*a* and the second resonators 80*b* shown in FIG. 27(*a*), the partition plate 70 may be provided as shown in FIGS. 27(*b*) and 27(*c*). In FIG. 27(*b*), only one partition plate 70 is provided. In this arrangement, the partition plate 70 may be disposed such that the position of the speaker 60*a* corresponds to the node of the sound pressure in the natural vibration mode, for instance. In other words, the partition plate 70 may be disposed such that the position of at least one speaker corresponds to the node of the sound pressure in the natural vibration mode, thereby reducing the number of the natural vibration modes excited by the vibration of the at least one speaker.

In the layout shown in FIG. 27(*c*), resonators 80*c*, 80*d* may be disposed between partition plates 70*a*, 70*b*, as shown in FIG. 27(*d*). Like the first resonator 80*a* and the second resonator 80*b*, each of the resonators 80*c*, 80*d* has an open end portion and a hollow region. The resonator 80*c* is disposed such that the open end portion thereof is directed downward while the resonator 80*d* is disposed such that the open end portion thereof is directed upward. The resonator 80*c* may be configured to resonate at the same frequency as the second resonator 80*b*, and the resonator 80*d* may be configured to resonate at the same frequency as the first resonator 80*a*. The resonator 80*c* and the resonator 80*d* may be configured to resonate at other frequencies.

Figure 28A:
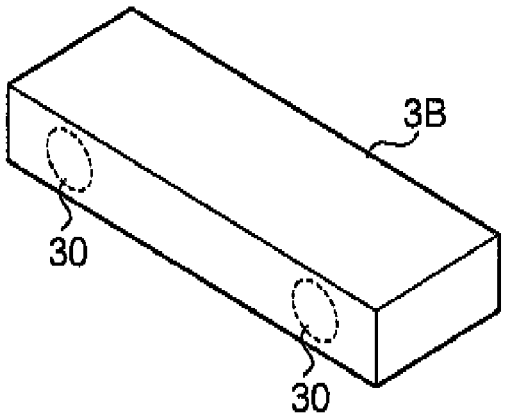
FIGS. 28(*a*)-(*c*) are views respectively for explaining shapes of casings of the electronic keyboard musical instrument according to a modified embodiment 3.
Figure 28B:
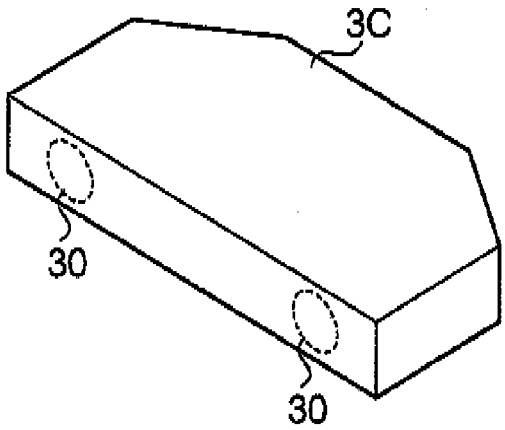
Figure 28C:
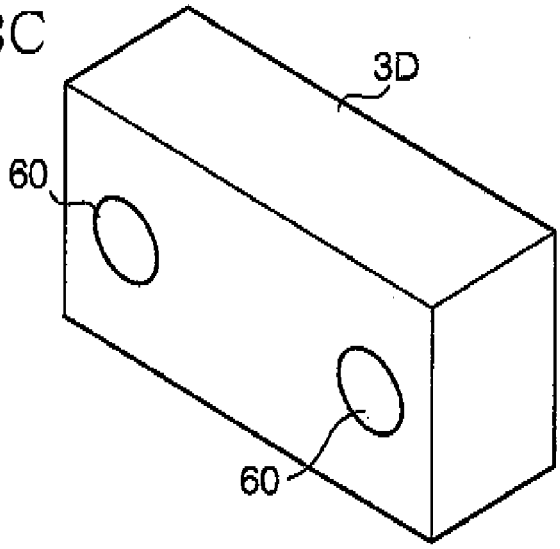

(3) The casing of the electronic keyboard musical instrument in each of the illustrated embodiments may have a shape shown in FIG. 28. The casing may have a rectangular parallelepiped shape like a casing 3B shown in FIG. 28(*a*) or a shape in which the upper surface and the bottom surface have a polygonal shape like a casing 3C shown in FIG. 28(*b*). That is, the casing may have a shape in which the one-dimensional natural vibration mode is generated in the key arrangement direction in the inner space of the casing, as in the illustrated embodiment 1. In this instance, each speaker 30 may be disposed such that the sound emission surface thereof is directed toward the bottom surface or the upper surface of the casing. Further, the casing may have a rectangular parallelepiped shape like a casing 3D shown in FIG. 28(*c*). That is, the casing may have a shape other than the shape in the illustrated embodiment 2, as long as the shape permits the two dimensional natural vibration mode to be generated in the height direction and in the key arrangement direction, as in the embodiment 2. In this instance, each speaker 60 may be disposed such that the sound emission surface thereof is directed toward the performer's side or toward the rear side.

(4) In the illustrated embodiments 1-3, the resonators having the tubular shape are used. There may be used various resonators utilizing panel vibration resonance, Helmholtz resonance, bending panel vibration, piston panel vibration, and the like. In essence, the resonator needs to be designed so as to suit sound field in the inner space of the casing of the electronic keyboard musical instrument and may be configured to control acoustic energy in the inner space of the casing. There will be hereinafter described concrete examples.

Figure 29A:
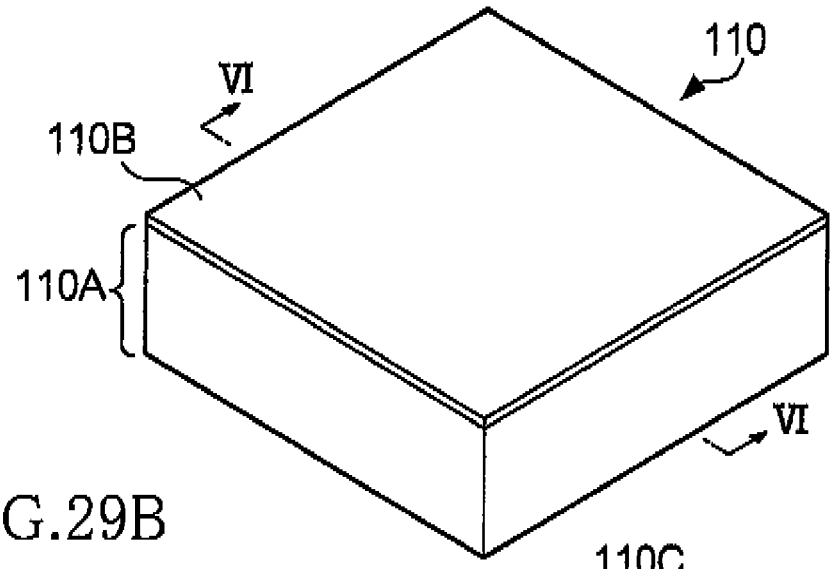
FIG. 29(*a*) is a schematic view showing an external appearance of a panel vibration resonator according to a modified embodiment 4 and FIG. 29(*b*) is a cross-sectional view of the panel vibration resonator viewed along arrows VI-VI in FIG. 29(*a*)
Figure 29B:
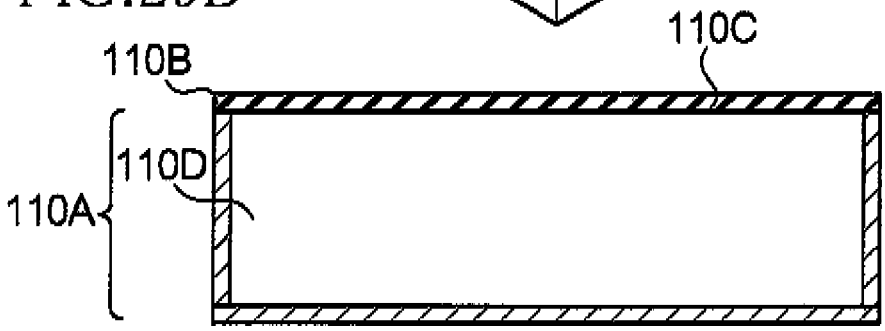

FIG. 29(*a*) schematically shows an external appearance of a panel vibration resonator 110. FIG. 29(*b*) is a cross-sectional view of the panel vibration resonator 110 as viewed along arrows VI-VI in FIG. 29(*a*). The panel vibration resonator 110 includes a casing 110A and a vibrating portion 110B. The casing 110A is a rectangular parallelepiped box-like member whose upper portion is entirely open. The casing 110A has an opening 110C, a rectangular parallelepiped gaseous layer 110D as a hollow region communicating with the opening 110C. While the casing 110A is formed of wood, for instance, the casing 110A may be formed of other material such as synthetic resin or metal, as long as the material for the casing 110A is relatively harder than the vibrating portion 110B. The vibrating portion 110B is a rectangular member with elasticity in the form of a plate or a diaphragm. For instance, the vibrating portion 110B is a panel formed of a material having elasticity and causing elastic vibration, such as synthetic resin, metal, fiber board, or closed-cell foam or is a diaphragm formed of an elastic material or a high molecular compound. The periphery of one surface of the vibrating portion 110B is supported by the casing 110A, such that the opening 110C of the casing 110A is closed. The opening 110C of the casing 110A is closed by the vibrating portion 110B, whereby the gaseous layer 110D is formed in the closed space of the panel vibration resonator 110. The gaseous layer 110D is a layer formed of gaseous particles. Here, the gaseous layer 110D is an air layer formed of air molecules. An elastic body such as a porous material may be provided in the gaseous layer 110D. The panel vibration resonator 110 is disposed such that the vibrating portion 110B is located at a position corresponding to an antinode of a sound pressure of a sound wave at a target frequency. Where sound is generated in the space, the panel vibration resonator 110 resonates in accordance with the sound pressure of the sound. Owing to the resonance, there is generated a difference between the sound pressure in the space and the pressure in the gaseous layer 110D of the panel vibration resonator 110. The pressure difference causes the vibrating portion 110B to vibrate, so that the acoustic energy is consumed and is subsequently emitted again. This action reduces the sound pressure in the space in the vicinity of the surface of the panel vibration resonator 110, namely, in the vicinity of the surface of the vibrating portion 110B.

Figure 30A:
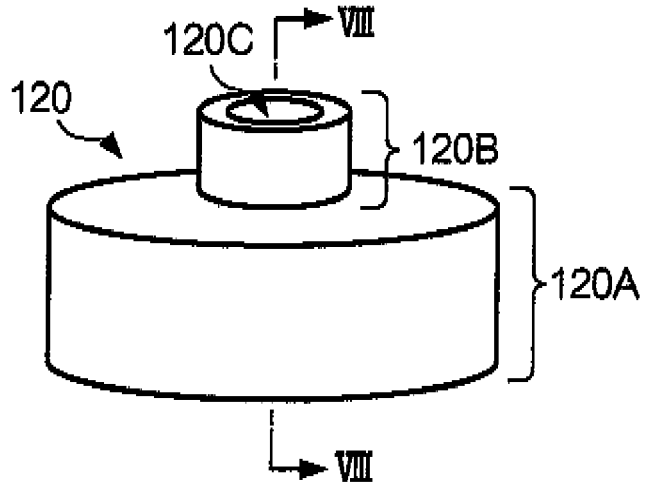
FIG. 30(*a*) is a schematic view showing an external appearance of a Helmholtz resonator according to a modified embodiment 4 and FIG. 30(*b*) is a cross-sectional view of the Helmholtz resonator viewed along arrows VIII-VIII in FIG. 30(*a*)
Figure 30B:
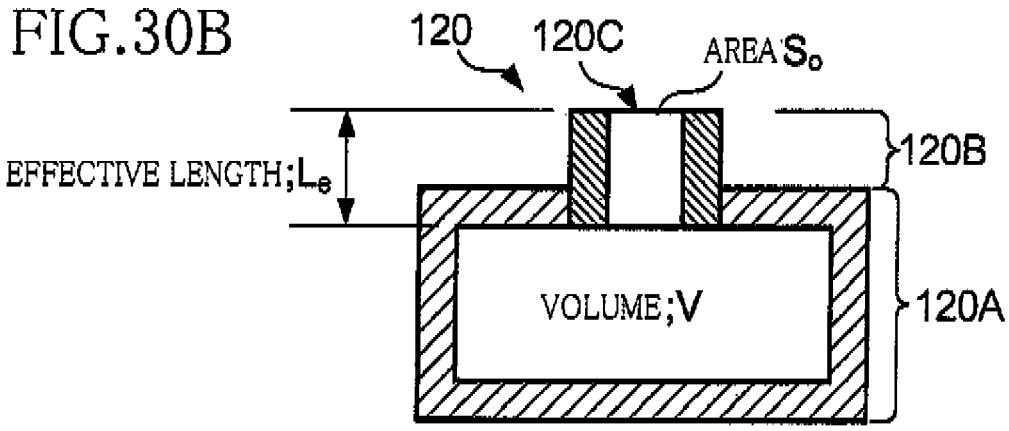

FIG. 30(*a*) schematically shows an external appearance of a Helmholtz resonator. FIG. 30(*b*) is a cross-sectional view of the Helmholtz resonator 120 as viewed along arrows VIII-VIII in FIG. 30(*a*). The Helmholtz resonator 120 includes a body portion 120A and a tubular portion 120B. In the Helmholtz resonator 120, a space formed in the body portion 120A and the tubular portion 120B is a hollow region communicating with an opening 120C.

The body portion 120A is formed of fiber reinforced plastic FRP, for instance, so as to have a cylindrical shape. In an inside of the body portion 120A, a gaseous layer is formed. The tubular portion 120B is the so-called opposite-end open tube formed of vinyl chloride, for instance. The tubular portion 120B is inserted into an opening of the body portion 120A, so as to be connected to each other. The Helmholtz resonator 120 is disposed such that the opening 120C is located at a position corresponding to an antinode of a sound pressure of a sound wave at a target frequency. In this arrangement, when sound enters the opening 120C, the Helmholtz resonator 120 resonates, thereby reducing the sound pressure in the vicinity of the opening 120C. That is, the Helmholtz resonator 120 forms a spring-mass system in which a gas inside the tubular portion 120E corresponds to a mass component and the gaseous layer in the body portion 120A corresponds to a spring component. Due to friction between the inner wall of the tubular portion 120B and the air, sound energy is converted into thermal energy, thereby reducing the sound pressure while increasing particle velocity, in the vicinity of the opening 120C. A resonance frequency f of the spring-mass system of the Helmholtz resonator 120 satisfies a relationship indicated by the following formula (3) wherein $L_e$ represents an effective length of the tubular portion 120B. As shown in FIG. 30(*b*), the effective length $L_e$ is obtained by correcting a length of a cavity of the tubular portion 120B from one end to the other end, using an open end correction value. Further, in the formula (3), V represents a volume (i.e., capacity) of the gaseous layer formed in the body portion 120A and $S_o$ represents an area of the opening 120C.

$$f=c_0/2\pi\cdot(S_0/L_e\cdot V)^{1/2} \quad (3)$$

Here, the Helmholtz resonator 120 has a single tubular portion 120B. A plurality of tubular portions 120E may be provided. Further, the opening 120C of the tubular portion 120B or the vicinity thereof may be closed by a flow resistance member having a flow resistance and air permeability, such as glass wool, cloth, or gauze.

Figure 31A:
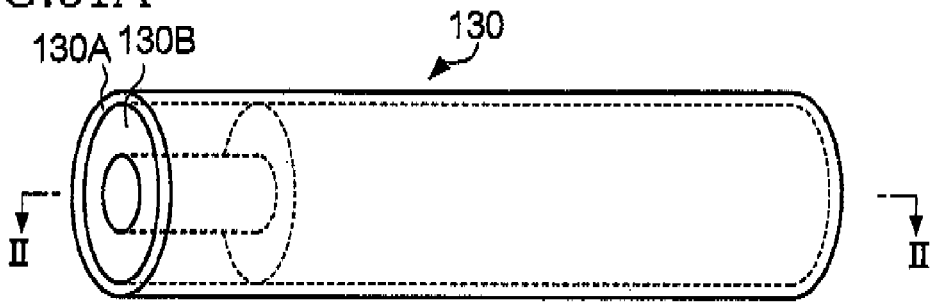
FIG. 31(*a*) is a schematic view showing an external appearance of a resonator according to a modified embodiment 4 and FIG. 31(*b*) is a cross-sectional view of the resonator viewed along arrows II-II in FIG. 31(*a*)
Figure 31B:
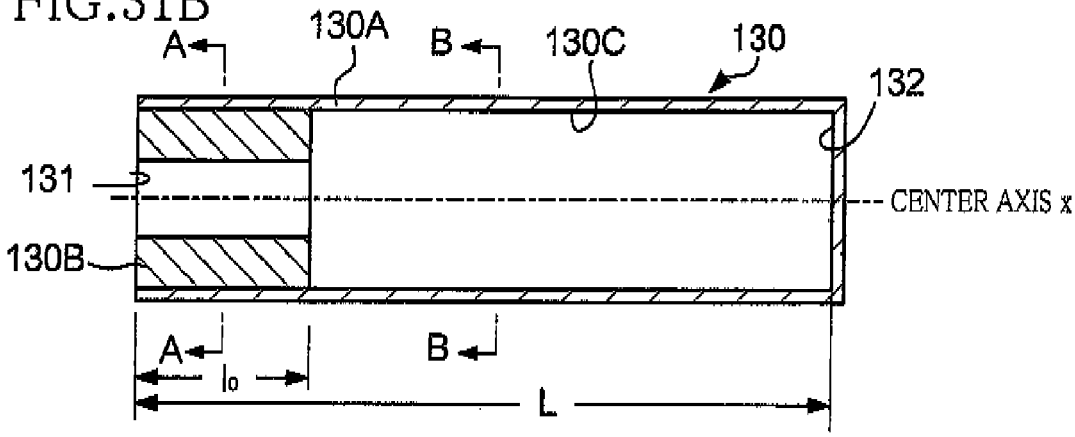

FIG. 31 shows a resonator according to the modified embodiment. FIG. 31(*a*) shows an external appearance of the resonator according, to the modified embodiment. The resonator 130 has a tubular shape in which one end (the left end in FIG. 31) is open and the other end (the right end in FIG. 31) is closed. The resonator 130 is composed of a pipe member 130A and a resistance member 130B. The pipe member 130A is one example of the casing according to the invention and is formed of a material such as metal or plastic, so as to have a cylindrical shape. The pipe member 130A is the so-called one-side-end open pipe and extends in one direction. The resistance member 130B is a member in which a cylindrical cavity is formed through central portions of both circular surfaces of the cylinder. The resistance member 130B is provided such that the outer circumferential surface of the cylinder is in contact with the inner circumferential surface of the pipe member 130A in the vicinity of the open end of the pipe member 130A. The resistance member 130B is formed of urethane foam as one example of a porous material, and functions as a resistance against motion of gaseous particles (here, air molecules), so as to inhibit the motion of the gaseous particles. In the region in which the resistance member 130B is disposed, the resistance against the motion of the gaseous particles is increased, as compared when the resistance member 130B is not disposed. As a physical amount that quantitatively represents a value of the resistance, characteristic impedance of the medium is used.

FIG. 31(*b*) shows a cross section of the resonator 130 taken along line II-II in FIG. 31(*a*). That is, FIG. 31(*b*) is a view showing a cross section that includes an x axis (which will be described), along the extension direction of the pipe member 130A. Where the resonator 130 is cut at any position, in its extension direction, at which the resistance member 130B is provided, the cross-sectional shape of the pipe member 130A is constant and the dimension thereof is constant. Similarly, the cross-sectional shape of the resistance member 130B is constant and the dimension thereof is constant. The pipe member 130A has a circular open end 131 at one end thereof and a similar circular closed end 132 at the other end thereof. The closed end 132 is regarded to acoustically behave in a manner similar to a perfect reflection plane (i.e., a rigid wall). In an inside of the pipe member 130A, a cylindrical hollow region 130C is formed extending between the open end 131 and the closed end 132. The hollow region 130C is held in communication with an exterior space through the open end 131. Here, a length between opposite ends of the hollow region 130C which is a distance between the open end 131 and the closed end 132 is represented as L. A line passing through the center of the cross section of the hollow region 130C orthogonal to the extending direction of the hollow region 130C is represented as the center axis x indicated by the long dashed short dashed line in FIG. 31(*b*). A diameter of the open end 131 of the pipe member 130A is sufficiently smaller, e.g., not larger than a half (½), of the wavelength of the resonance frequency of the resonator 180. Accordingly, where the pipe member 180A is used par se without the resistance member 130B, it is considered that a sound wave that travels in the hollow region 130C is only a plane wave that travels along the center axis x. Hence, in the hollow region 130C, the sound pressure is substantially uniformly distributed in a region in which the position with respect to a direction along the center axis x is the same, namely, in a region which is included in the cross section orthogonal to the center axis x. The resistance member 130B is disposed in the hollow region 130C so as to extend from a position of the open end 131 as one end. That is, the resistance member 180B extends in a longitudinal direction along the center axis x. The length of the resistance member 130B in the longitudinal direction, in other words, a distance between the one end located at the open end 131 and the other end, is represented as $l_0$. Since the resistance member 130B has a cavity extending through the cylinder in the longitudinal direction, the open end 131 and the closed end 132 of the pipe member 130A communicate with each other through the cavity. Here, this cavity is a region in which there exists no member that increases the resistance with respect to the motion of the gaseous particles. The resonance frequency of the resonator 130 is shifted toward a low-frequency side with an increase in the length $l_0$ of the resistance member 130B, namely, with a decrease in the length $L-l_0$ of the hollow region 130C.

(5) In the resonator, there may be provided an adjusting mechanism for adjusting the resonance frequency of the resonator. By using the resonator having the adjusting mechanism for adjusting the resonance frequency, as the resonator disposed in the casing of the electronic keyboard musical instrument, the resonance frequency can be adjusted by the adjusting mechanism even where the sound pressures in the natural vibration modes at a plurality of different frequencies are reduced. Accordingly, it is possible to use resonators common in the shape and size. Hereinafter, examples of such an adjusting mechanism will be explained.

(a) In the tubular resonator described in the illustrated embodiments 1-3, there may be used, as the adjusting mechanism for adjusting the length of the hollow region of the resonator, a member formed of a porous material such as urethane foam and serving as a resistance with respect to motion of gaseous particles (here, air molecules) for inhibiting the motion of the gaseous particles. Such a member may be bonded to the closed end portion of the hollow region of the resonator, thereby changing the length of the hollow region. The resonance frequency is shifted to the lower-frequency side with an increase in the length of the hollow region.

Figure 32:
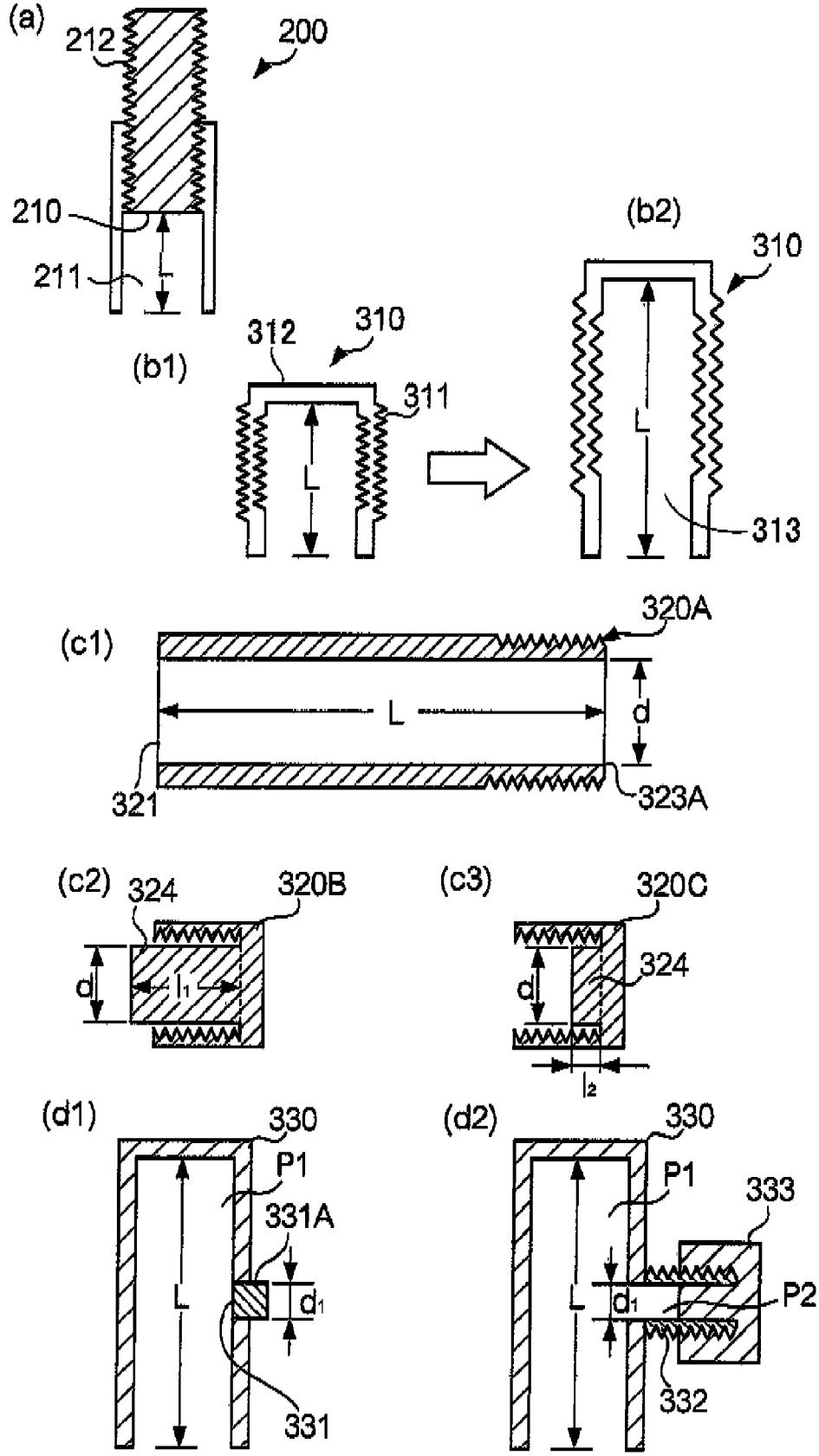
FIGS. 32(*a*)-(*d*2) are views each showing a tubular resonator having an adjusting mechanism according to a modified embodiment 5.

(b) One example of the adjusting mechanism is shown in FIG. 32(*a*). More specifically, in a cylindrical resonator 200 similar to the resonator in each of the embodiments 2, 3, there may be provided a cylindrical member 212 for adjusting a length of a hollow region 211 by adjusting the position of an open end portion 210. In this instance, the cylindrical member 212 has an outside diameter which is the same as the inside diameter of the hollow region 211. At a portion of the resonator 200 into which the cylindrical member 212 is inserted, there is formed an opening whose size is the same as the outer periphery of the cylindrical member 21. Further, an internal thread is formed on the inner circumference of the hollow region 211 and an external thread is formed on the outer circumference of the cylindrical member 212. The cylindrical member 212 is fitted in the hollow region 211 by engagement of the internal thread and the external thread. By rotating the cylindrical member 212 relative to the resonator 200, the length L of the hollow region is adjusted. The resonance frequency is shifted to the lower-frequency side with an increase in the length of the hollow region 211.

(c) One example of the adjusting mechanism is shown in FIG. 32(*b*1). More specifically, like the resonator in each of the embodiments 2, 3, a cylindrical resonator 310 shown in FIG. 32(*b*1) has an open end portion and a closed end portion 312. The resonator 310 has a bellows-like circumferential surface 311 formed of a flexible material. By moving the closed end portion 312 upward, the length L of a hollow region 313 increases as shown in FIG. 32(*b*2). The resonance frequency is shifted to the lower-frequency side with an increase in the length L of the hollow region 313.

(d) The following arrangement is one example of the adjusting mechanism. For instance, the surface on the side of the closed end portion (i.e., on the closed end side) of the resonator in the embodiment 1 is formed so as to be open for thereby providing an opened portion, and an external thread is formed on an outer circumferential surface of the tubular portion on the closed end side. The length of the hollow region of the thus formed tubular portion may be adjusted by a lid which closes the surface on the closed end side and which has an internal thread for engagement with the external thread. FIG. 32(*c*1) shows a cross section of a tubular portion 320A formed as described above. The tubular portion 320A has a hollow region with a length L and an open end portion 321 and an opened portion 323A on the closed end side. The external thread is formed over a suitable distance on the outer circumferential surface of the tubular portion 320A on the closed end side. FIGS. 32(*c*2) and 32(*c*3) show examples of the lid. As shown in FIGS. 32(*c*2) and 32(*c*3), in each of the lid 320B and the lid 320C, an internal thread which engages the external thread of the tubular portion 320A is formed. Further, each of the lid 320B and the lid 320C has a protrusion 324 having a diameter slightly smaller than a diameter d of the hollow region of the tubular portion 320A. The diameter d corresponds to twice a distance between the center of the tubular portion 320A and the inner circumferential surface of the tubular portion 320A. The lengths l1, l2 of the protrusions 324 of the respective lids 320B, 320C are mutually different, namely, l1>l2.

By fitting each of the protrusions 324 of the respective lids 320B, 320C into the opened portion 323A on the closed end side of the tubular portion 320A, the tubular portion 320A is closed on the closed end side, so that a closed end portion is formed. Where the lid 320B is fitted into the tubular portion 320A by an amount corresponding to the length l1 of the protrusion 324, for instance, the length of the hollow region of the tubular portion 820A is equal to L−l1. Where the lid 320C is fitted into the tubular portion 320A by an amount corresponding to the length l2 of the protrusion 324, for instance, the length of the hollow region of the tubular portion 320A is equal to L−l2. Accordingly, the length of the hollow region is larger in the case in which the lid 320C is fitted into the tubular portion 320A than the case in which the lid 320E is fitted into the tubular portion 820A. Thus, the length of the hollow region of the tubular portion 320A is adjusted by a plurality of lids having the protrusions 324 with mutually different lengths, whereby the resonance frequency of the resonator can be adjusted. Further, the length of the hollow region of the tubular portion 320A may be adjusted by changing the amount by which the protrusion of the lid is fitted into the tubular portion 320A. In the state in which the lid 320B is fitted into the tubular portion 320A by the amount corresponding to the length of the protrusion 824 shown in FIG. 32(*c*2) and in the state in which the lid 320C is fitted into the tubular portion 320A by the amount corresponding to the length of the protrusion 324 shown in FIG. 32(*c*3), the dimension (the length) of the tubular portion 320A in the longitudinal direction of the resonator is apparently the same. Therefore, it is possible to reduce a wasteful space in disposing, in the inner space of the casing 3, the resonators, the electronic components and the like.

(e) In each of the above modified embodiments (a)-(d), the resonance frequency of the resonator is adjusted by adjusting the length of the hollow region of the tubular resonator. The resonance frequency may be adjusted by adjusting a volume of the hollow region of the tubular resonator without changing the length of the hollow region. FIG. 32(*d*1) is a view showing a cross section of a resonator according to this modified embodiment. As shown in FIG. 32(*d*1), a resonator 330 has a tubular shape in which one end is open and the other end is closed. The resonator 330 has a hollow region P1. At a portion of one surface of the resonator 330, an opening 331 having a diameter dl is formed. In FIG. 32(*d*1), the opening 331 is closed by a plug member 331A. The plug member 331A which closes the opening 331 is removably attached to the resonator 330. When the resonance frequency of the resonator 330 is adjusted, a tubular member 332 is attached to the end of the opening 831, in place of the plug member 331A, as shown in FIG. 32(*d*2). The tubular member 332 is open at its opposite ends, and an external thread is formed on its outer circumferential surface. To this tubular member 332, a lid 383 is connected which has a shape similar to the shape of the lids shown in FIGS. 32(*c*2) and 32(*c*3) and which has an internal thread to engage the external thread of the tubular member 332. In a state in which the lid 333 is connected to the tubular member 332, a space P2 is formed so as to extend from the opening 331 connected to the hollow region P1 to the protrusion of the lid 333, whereby the volume of the hollow region of the resonator 330 is increased. The increase in the volume of the hollow region of the resonator 330 shifts the resonance frequency of the resonator 330 toward the low-frequency side.

The above-described resonators shown in FIG. 32 are suitably used in an instance in which the same resonator is used in a plurality of different models having mutually different casing structures, in an instance in which the acoustic characteristic varies by the layout or the addition of internal components due to design changes of products, and the like.

(f) Referring next to FIG. 33, there will be explained one example of a Helmholtz resonator equipped with the adjusting mechanism. Like the Helmholtz resonator 120 described above, a Helmholtz resonator 410 shown in FIG. 38(*a*) includes a body portion 410A and a tubular portion 410B. The body portion 410A has a pot-like shape having a neck portion 411. The neck portion 411 has a tubular path whose outside diameter is equal to an inside diameter of the tubular portion 410B. An internal thread is formed on the inner circumferential surface of the tubular portion 410B while an external thread is formed on the outer circumferential surface of the neck portion 411. By engagement of the internal thread and the external thread, the tubular portion 410B is fitted onto the neck portion 411 of the body portion 410A. By rotating the body portion 410A relative to the tubular portion 410B, a tube length L defined by the neck portion 411 and the tubular portion 410E is adjusted. The resonance frequency of the Helmholtz resonator 410 is shifted toward the low-frequency side with an increase in the tube length L. In the Helmholtz resonator 120 shown in FIG. 30, the circumferential surface of the tubular portion 120B may be formed like bellows using a flexible material as in the modified embodiment (c) explained above, and the length of the hollow region of the tubular portion 120B may be adjusted by moving the body portion 120A to change the length of the tubular portion 120B.

Figure 33A:
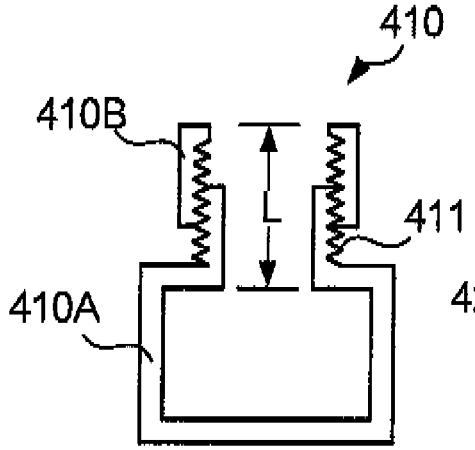
FIGS. 33(*a*) and (*b*) are views each showing a Helmholtz resonator having an adjusting mechanism according to a modified embodiment 5.
Figure 33B:
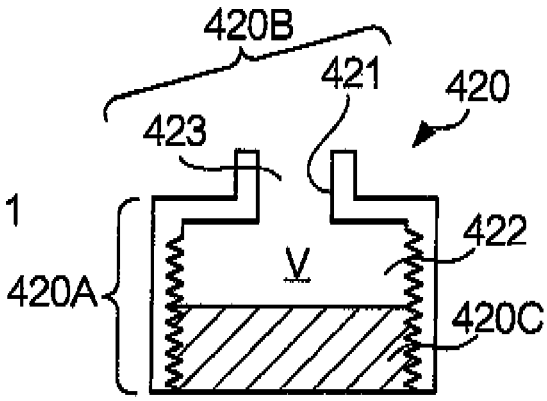

In the Helmholtz resonator 410 shown in FIG. 33(*a*), the resonance frequency is adjusted by adjusting the tube length L. The resonance frequency may be adjusted by adjusting a volume of the body portion 410A. FIG. 33(*b*) shows a Helmholtz resonator 420 equipped with an adjusting mechanism for adjusting the volume of the body portion. The Helmholtz resonator 420 includes a body portion 420A having a hollow region 422 and a tubular portion 420B which has an opening 421 communicating with an exterior and a tubular path 423 extending from the opening 421 to the hollow region 422 of the body portion 420A. An internal thread is formed on the inner circumferential surface of the body portion 420A, and a cylindrical member 420C is inserted in an opening formed on the bottom of the body portion 420A. The cylindrical member 420C has an outside diameter equal to an inside diameter of the body portion 420A, and an external thread is formed on the outer circumferential surface of the cylindrical member 420C for engagement with the internal thread of the body portion 420A. By rotating the cylindrical member 420C relative to the body portion 420A and moving the cylindrical member 420C away from the body portion 420A, the volume of the hollow region 422 of the body portion 420A is increased. The resonance frequency is shifted toward the low-frequency side with an increase in the volume of the hollow region 422 of the body portion 420A. The Helmholtz resonator may have only one of or both of the adjusting mechanism for adjusting the tube length as shown in FIG. 33(*a*) and the adjusting mechanism for adjusting the volume of the hollow region of the body portion as shown in FIG. 33(*b*).

The Helmholtz resonator 120 shown in FIG. 30 may have an adjusting mechanism for adjusting the inside diameter of the tubular portion 120B. As the adjusting mechanism, there may be used a cylindrical member whose opposite ends are open and which has an outside diameter equal to the diameter of the hollow region of the tubular portion 120B and has the same length as the hollow region of the tubular portion 120B, for instance. This cylindrical member is installed on the tubular portion 120B, thereby decreasing the diameter of the tubular portion 120B. The resonance frequency is shifted toward the low-frequency side with a decrease in the inside diameter of the tubular portion 120B. An adjusting mechanism for adjusting the resonance frequency of the panel vibration resonator, the bending panel vibration resonator, etc., may be formed by attaching an additional member such as a weight, to a vibration panel formed of a material having elasticity and causing elastic vibration, such as synthetic resin, metal, fiber board, or closed-cell foam. The additional member may be attached to a region of the vibration panel including a position at which the amplitude becomes maximum when the vibration panel undergoes bending vibration. The resonance frequency in the bending system is shifted toward the low-frequency side with an increase in the mass of the vibration panel.

Figure 34A:
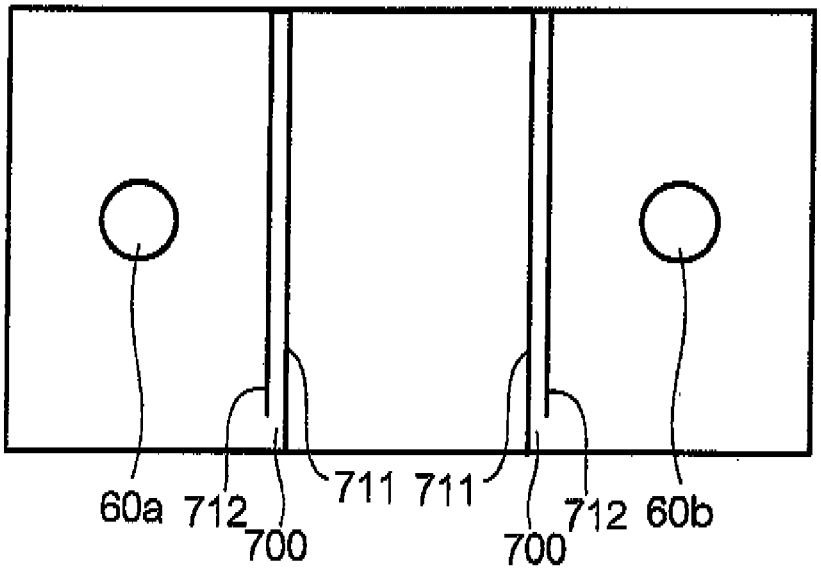
FIG. 34(*a*) is a view showing an installation example of a partition•resonance member according to a modified embodiment 6 and FIG. 34(*b*) is a view schematically showing an external appearance of the partition•resonance member.
Figure 34B:
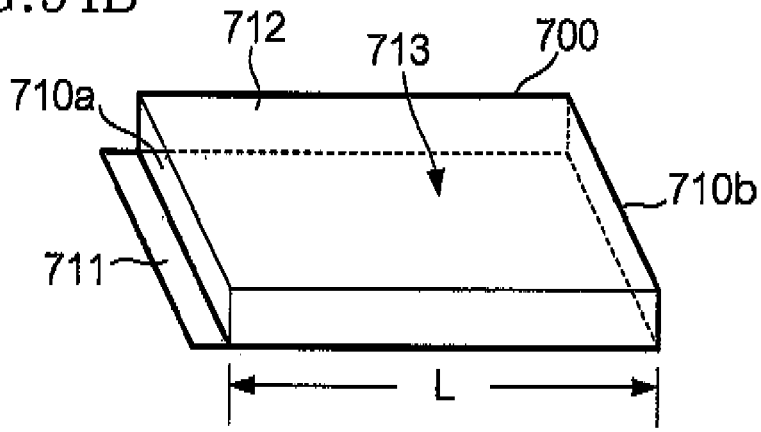

(6) In the embodiments 2, 3, the partition plates 70 are used. By disposing an electric component such as a circuit board at the position of each partition plate 70, the electric component may be used as the partition plate. In the embodiment 2, each resonator 80 is attached to the inner wall of the rear plate 55. The resonator may be formed integrally with the other member provided in the inner space of the casing 3A (such as the inner wall of each side plate 48 and the bottom surface of the key bed 53). For instance, there may be used a partition-resonance member in which the resonator and the partition plate are integrally formed, as shown in FIG. 34. FIG. 34(*a*) is a simplified view showing a speaker installation space. A partition-resonance member 700 shown in FIG. 34(*a*) has a rectangular parallelepiped shape in which a bottom portion 710*a* is open and an upper portion 710*b* is closed. In a state in which each partition-resonance member 700 is disposed in the speaker installation space as shown in FIG. 34(*b*), one 712 of two opposing surfaces 711, 712 of the partition resonance member 700 that is located nearer to the corresponding speaker 60*a*, 60*b* is shorter than the other 711 of the two opposing surfaces 711, 712. In an inside of the partition-resonance member 700, a hollow region 713 is formed. To permit the partition-resonance member 700 to function as the second resonator, for instance, the length of the surface 712 may be designed such that the length L of the hollow region 713 is equal to a length corresponding to a quarter (¼) of the wavelength of the frequency at which the sound pressure is desired to be reduced.

Figure 35:
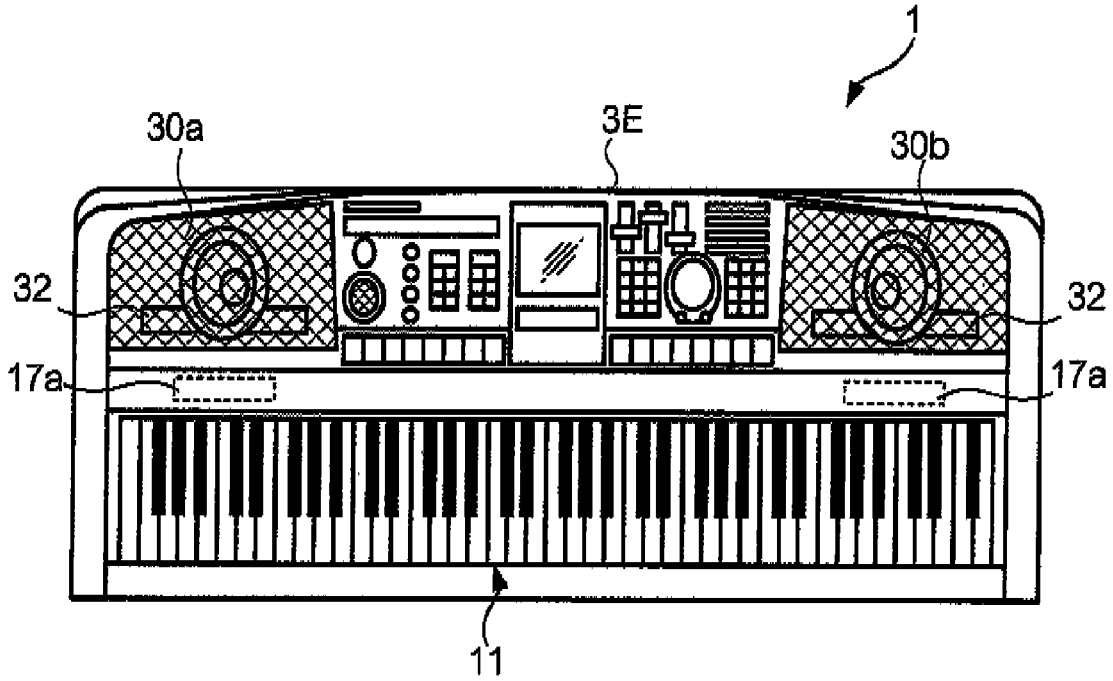
FIG. 35 is a view showing an electronic keyboard musical instrument according to a modified embodiment 7.

(7) One example of the electronic keyboard musical instrument described in the illustrated embodiment 1 may include a desktop-type electronic piano or the like shown in FIG. 35. In the electronic keyboard musical instrument shown in FIG. 35, the keyboard 11 is provided in a casing 3E, and the TEs 17*a* are formed above the keyboard 11. In an inner space of the casing 3E, the speakers 30 (30*a*, 30*b*) are disposed such that the sound emission surface of each speaker 30 is directed upward. Further, the resonators 32 are disposed in a lower space which is below the speakers 30. In the inner space of the casing 3E, a space in which the speakers 30 are disposed and a space in which the keyboard 11 is disposed are connected to each other. The casing 3E has: first sound emission paths through which sound from the speakers 30 propagates from the sound emission surfaces to an external space; and second sound emission paths through which sound from the speakers 30 propagates to the external space from the TEs 17*a* and the clearances in the keyboard 11 via the space on the rear side of the speakers 30, namely, the lower space present below the speakers 30. As in the embodiment 1, the open end portion of each resonator 32 is located at a position in the speaker installation space corresponding to an antinode of the sound pressure in natural vibration mode at the frequency at which the sound pressure is desired to be reduced. As the second sound emission path, there may be formed a sound emission path through which sound propagates from a clearance at a portion where an upper case and a lower case of the electronic keyboard musical instrument are connected, toward the keyboard 11 or rearward.

(8) As explained above, the tubular resonator in the embodiments and the modified embodiments is a tube in which a cross section perpendicular to the longitudinal direction is uniform at any arbitrary position in the longitudinal direction, and may be referred to as an acoustic damper formed of a tubular member whose one end is acoustically closed or shielded so as to function as a closed or shielded end. Further, the Helmholtz-type resonator in the embodiments and the modified embodiments is a container having a hollow portion and may be referred to as an acoustic damper wherein one end of the hollow portion is open and a portion on the other side opposite to the one end is formed as a cavity portion having an area larger than an area of the opening at the one end. Moreover, the Helmholtz-type resonator in a narrow sense may be referred to as an acoustic damper wherein a void having a prescribed length from the one end in the depth direction has a uniform cross section and a portion located further in the depth direction is formed as the cavity portion having a cross sectional area larger than that of the void. In short, the resonator in the embodiments and the modified embodiments is defined as an acoustic damper wherein one end is open and the cavity portion is formed at a position distant from the one end in the depth direction.

(9) In the embodiments and the modified embodiments, the TEs are formed in the electronic keyboard musical instrument. The electronic keyboard musical instrument may not have the TEs. In short, the electronic keyboard musical instrument may be arranged to have the second sound emission paths through which the sound of the speaker propagates to the exterior space from a route which passes the inner space of the casing in which the speakers are provided and which is acoustically connected to the outside of the casing such as the clearances between the keys of the keyboard. Further, the second sound emission path through which the sound of the speakers propagates to the exterior space via the inner space of the casing in which the speakers are provided is not limited to the TEs and the clearances between the keys. For instance, the invention may be applicable to an electronic stringed musical instrument, such as an electronic guitar or an electronic violin, which has a speaker in its inside and which has a path through which sound on the rear side of the emission surface of the speaker is introduced to an exterior, an electric stringed musical instrument, such as an electric guitar, which has a speaker and which has a path through which sound on the rear side of the emission surface of the speaker is introduced to an exterior, an electronic percussion instrument, such as a percussion, which has a speaker and which has a path through which sound on the rear side of the emission surface of the speaker is introduced to an exterior, etc.

Figure 36A:
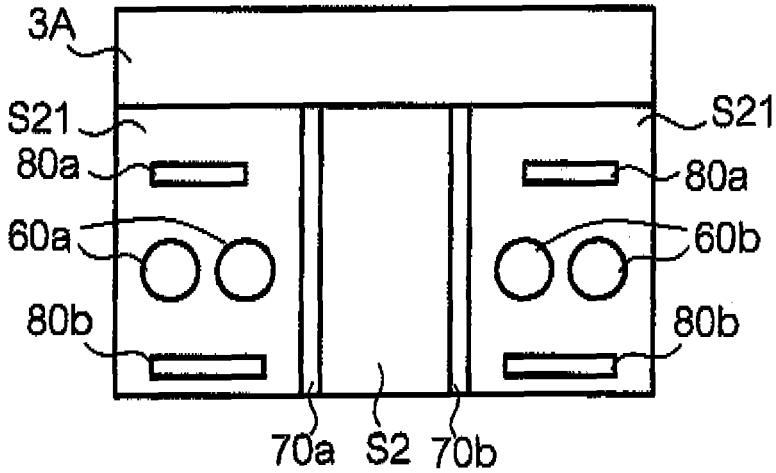
FIGS. 36(*a*)-(*c*) are views each showing an installation example of the speakers and the resonators in the inner space of the casing according to the embodiment 2.
Figure 36B:
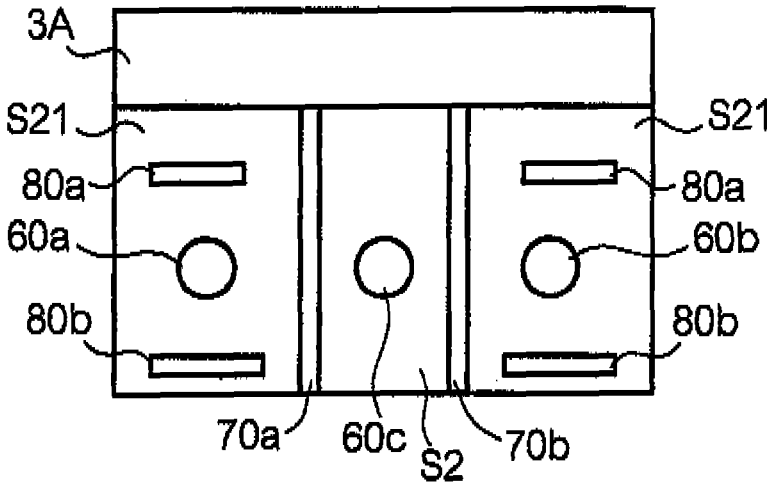
Figure 36C:
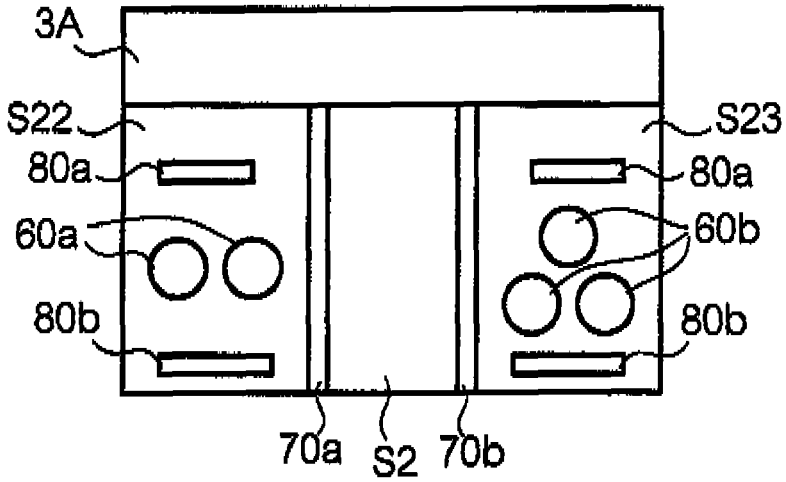

(10) In the embodiments 2, 3 and the modified embodiment 2, only one speaker is disposed in each of the partitioned spaces in the lower inner space S2 of the casing 3A. As shown in FIG. 36(*a*), a plurality of speakers 60*a* and a plurality of speakers 60*b* may be respectively disposed in corresponding partitioned spaces S21, S21, for instance. Further, as shown in FIG. 36(*b*), a speaker 60*c* may be disposed in a space of the lower inner space S2 in which no resonators 80 are provided. Moreover, as shown in FIG. 36(*c*), in the lower inner space 82, two speakers 60*a* may be disposed in a space S22 in which the resonator 80 is provided while three speakers 60*b* may be disposed in the other space S23 in which the resonator 80 is provided. In short, the inner space is partitioned into a plurality of spaces such that two or more speakers are divided into at least two groups, and the resonator 80 is provided in at least two of the plurality of spaces in each of which at least one speaker is disposed.

(11) In the embodiments 2, 3, the electronic keyboard musical instrument is illustrated. The invention is applicable to an acoustic system having a speaker and a sound emission path through which vibration from the rear side of the sound emission surface of the speaker is introduced to an exterior. For instance, the invention may be applied to a speaker box installed on an automobile. Concretely, the invention may be applied to a system in which a casing structure is complicated and which has the first resonator configured to reduce the sound pressure in the natural vibration mode at least one specific frequency and the resonator configured to reduce the counterforce with respect to the motion of the speaker which is generated at a frequency different form the specific frequency, for dealing with sound generated in the casing.

What is claimed is:

1. A sound adjusting system, comprising:

a sound-signal generating circuit configured to generate a sound signal;

at least one speaker configured to emit sound in accordance with the sound signal generated by the sound signal generating circuit;

a speaker accommodating body which accommodates, in an inner space thereof, the at least one speaker; and at least one resonator disposed in the speaker accommodating body, wherein the speaker accommodating body includes a sound emission path by which the sound emitted by the at least one speaker is introduced to an exterior of the speaker accommodating body via the inner space so as to permit the sound to propagate to the exterior, wherein a control point of the at least one resonator is located at a position corresponding to an antinode of a sound pressure in a natural vibration mode at a specific frequency generated in the inner space by driving of the at least one speaker, wherein the at least one resonator resonates at the specific frequency so as to adjust the sound pressure in the natural vibration mode at the specific frequency, whereby the sound is emitted from the sound emission path to the exterior of the speaker accommodating body, wherein the at least one resonator is formed of a tubular body in which one of longitudinally opposite ends thereof is closed so as to provide a closed end portion and the other of the longitudinally opposite ends thereof is open so as to provide an open end portion, and wherein the at least one resonator is disposed such that the open end portion is located at the position corresponding to the antinode of the sound pressure in the natural vibration mode at the specific frequency.

2. The sound adjusting system according to claim 1, wherein the speaker accommodating body is a casing which accommodates, in an inner space thereof, at least one circuit component and the at least one speaker and which supports a keyboard such that a performance operation portion of the keyboard is exposed.

3. The sound adjusting system according to claim 1, wherein the speaker accommodating body is a speaker box which accommodates, in an inner space thereof, the at least one speaker.

4. The sound adjusting system according to claim 1, wherein the at least one resonator is disposed such that the open end portion is located at the position corresponding to the antinode of the sound pressure in the natural vibration mode at the specific frequency, and wherein the at least one resonator resonates at a specific frequency so as to reduce a sound pressure at a position corresponding to an antinode of a sound pressure in a natural vibration mode at the specific frequency.

5. The sound adjusting system according to claim 1, wherein the at least one resonator is disposed such that the open end portion is located at a position corresponding to an antinode of a sound pressure in a natural vibration mode at a specific frequency at which is generated a counterforce that suppresses a vibration of the at least one speaker caused when the sound is emitted, and wherein the at least one resonator resonates at the specific frequency so as to reduce the sound pressure at the position corresponding to the antinode of the sound pressure in the natural vibration mode at the specific frequency.

6. The sound adjusting system according to claim 1, comprising: a plurality of speakers each as the at least one speaker; a partition plate which partitions the inner space into a plurality of spaces such that the plurality of speakers are divided into at least two groups; and a plurality of resonators each as the at least one resonator, at least one of the plurality of resonators being disposed in at least two of the plurality of spaces in each of which at least one of the plurality of speakers is accommodated.

7. A sound adjusting system, comprising:

a sound-signal generating circuit configured to generate a sound signal;

at least one speaker configured to emit sound in accordance with the sound signal generated by the sound signal generating circuit;

a speaker accommodating body which accommodates, in an inner space thereof, the at least one speaker; and at least one resonator disposed in the speaker accommodating body, wherein the speaker accommodating body includes a sound emission path by which the sound emitted by the at least one speaker is introduced to an exterior of the speaker accommodating body via the inner space so as to permit the sound to propagate to the exterior, wherein a control point of the at least one resonator is located at a position corresponding to an antinode of a sound pressure in a natural vibration mode at a specific frequency generated in the inner space by driving of the at least one speaker, wherein the at least one resonator resonates at the specific frequency so as to adjust the sound pressure in the natural vibration mode at the specific frequency, whereby the sound is emitted from the sound emission path to the exterior of the speaker accommodating body, wherein the speaker accommodating body further accommodates at least one circuit component, and wherein the at least one resonator includes:

at least one first resonator whose control point is located at a position corresponding to an antinode of a sound pressure in a natural vibration mode at a first frequency, the at least one first resonator resonating at the first frequency so as to reduce the sound pressure at the position corresponding to the antinode of the sound pressure in the natural vibration mode at the first frequency; and, at least one second resonator whose control point is located at a position corresponding to an antinode of a sound pressure in a natural vibration mode at a second frequency which is different from the first frequency and at which is generated a counterforce that suppresses a vibration of the at least one speaker caused when the sound is emitted, the at least one second resonator resonating at the second frequency so as to reduce the sound pressure at the position corresponding to the antinode of the sound pressure in the natural vibration mode at the second frequency.

8. The sound adjusting system according to claim 7, further comprising a holding member for disposing, in the speaker accommodating body, the at least one first resonator and the at least one second resonator as a unit.

9. A sound adjusting system, comprising:

a sound-signal generating circuit configured to generate a sound signal;

at least one speaker configured to emit sound in accordance with the sound signal generated by the sound signal generating circuit;

a speaker accommodating body which accommodates, in an inner space thereof, the at least one speaker; and at least one resonator disposed in the speaker accommodating body, wherein the speaker accommodating body includes a sound emission path by which the sound emitted by the at least one speaker is introduced to an exterior of the speaker accommodating body via the inner space so as to permit the sound to propagate to the exterior, wherein a control point of the at least one resonator is located at a position corresponding to an antinode of a sound pressure in a natural vibration mode at a specific frequency generated in the inner space by driving of the at least one speaker, wherein the at least one resonator resonates at the specific frequency so as to adjust the sound pressure in the natural vibration mode at the specific frequency, whereby the sound is emitted from the sound emission path to the exterior of the speaker accommodating body, wherein the speaker accommodating body further accommodates at least one circuit component, and wherein the at least one resonator includes:

at least one first resonator whose control point is located at a position corresponding to an antinode of a sound pressure in a natural vibration mode at a first frequency, the at least one first resonator resonating at the first frequency so as to reduce the sound pressure at the position corresponding to the antinode of the sound pressure in the natural vibration mode at the first frequency; and, at least one third resonator whose control point is located at a position corresponding to an antinode of a sound pressure in a natural vibration mode at a third frequency different from the first frequency, the at least one third resonator resonating at the third frequency, whereby the antinode of the sound pressure in the natural vibration mode at the third frequency is located at a position at which the sound emission path communicates with the exterior of the speaker accommodating body.

10. The sound adjusting system according to claim 9, further comprising a holding member for disposing, in the speaker accommodating body, the at least one first resonator and the at least one third resonator as a unit.

* * * * *